US011298599B2

(12) United States Patent
Mata et al.

(10) Patent No.: US 11,298,599 B2
(45) **Date of Patent: *Apr. 12, 2022**

(54) GOLF CLUB HEAD

(71) Applicant: Taylor Made Golf Company, Inc., Carlsbad, CA (US)

(72) Inventors: Jason Andrew Mata, Carlsbad, CA (US); Joseph Henry Hoffman, Carlsbad, CA (US); Bradley Poston, San Diego, CA (US); Matthew David Johnson, San Diego, CA (US); Mark Vincent Greaney, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/146,097

(22) Filed: Jan. 11, 2021

(65) Prior Publication Data

US 2021/0205674 A1 Jul. 8, 2021

Related U.S. Application Data

(63) Continuation of application No. 16/579,666, filed on Sep. 23, 2019, now Pat. No. 10,905,929, which is a (Continued)

(51) Int. Cl.
*A63B 53/06* (2015.01)
*A63B 53/04* (2015.01)
(Continued)

(52) U.S. Cl.
CPC ..... *A63B 53/06* (2013.01); *A63B 53/02* (2013.01); *A63B 53/04* (2013.01);
(Continued)

(58) Field of Classification Search
CPC ..... A63B 53/06; A63B 53/0466; A63B 60/02; A63B 53/02; A63B 53/04; A63B 60/52;
(Continued)

(56) References Cited

U.S. PATENT DOCUMENTS 411,000 A 9/1889 Anderson
1,133,129 A 3/1915 Govan
(Continued)

FOREIGN PATENT DOCUMENTS

CN 2436182 6/2001
CN 201353407 12/2009
(Continued)

OTHER PUBLICATIONS

Adams Golf Speedline F11 Ti 14.5 degree fairway wood (www.bombsquadgolf.com, posted Oct. 18, 2010).
(Continued)

*Primary Examiner* — Sebastiano Passaniti
(74) *Attorney, Agent, or Firm* — Klarquist Sparkman, LLP

(57) ABSTRACT

A golf club head having a flexible channel to improve the performance of the club head, and a channel tuning system to reduce undesirable club head characteristics introduced, or heightened, via the flexible channel. The channel tuning system includes a sole engaging channel tuning element in
(Continued)

contact with the sole and the channel. The club head may include an aerodynamic configuration, as well as a body tuning system.

22 Claims, 26 Drawing Sheets

Related U.S. Application Data continuation of application No. 15/645,587, filed on Jul. 10, 2017, now Pat. No. 10,434,384, which is a continuation of application No. 14/939,648, filed on Nov. 12, 2015, now Pat. No. 9,707,457, which is a continuation-in-part of application No. 14/871,789, filed on Sep. 30, 2015, now Pat. No. 9,700,763, which is a continuation of application No. 14/701,476, filed on Apr. 30, 2015, now Pat. No. 9,211,447, which is a continuation of application No. 14/495,795, filed on Sep. 24, 2014, now Pat. No. 9,186,560, which is a continuation of application No. 13/828,675, filed on Mar. 14, 2013, now Pat. No. 8,888,607, which is a continuation-in-part of application No. 13/469,031, filed on May 10, 2012, now Pat. No. 9,220,953, which is a continuation-in-part of application No. 13/338,197, filed on Dec. 27, 2011, now Pat. No. 8,900,069.

(60) Provisional application No. 61/427,772, filed on Dec. 28, 2010.

(51) Int. Cl.
*A63B 60/02* (2015.01)
*A63B 53/02* (2015.01)
*A63B 60/52* (2015.01)

(52) U.S. Cl.
CPC ..... *A63B 53/0466* (2013.01); *A63B 60/02* (2015.10); *A63B 60/52* (2015.10); *A63B 53/023* (2020.08); *A63B 53/0408* (2020.08); *A63B 53/0433* (2020.08); *A63B 53/0437* (2020.08); *A63B 2053/0491* (2013.01); *A63B 2225/01* (2013.01)

(58) Field of Classification Search
CPC ..... A63B 2053/0491; A63B 2225/01; A63B 53/023; A63B 53/0408; A63B 53/0433; A63B 53/0437
USPC ..... 473/324–350, 287–292
See application file for complete search history.

(56) References Cited

U.S. PATENT DOCUMENTS 1,135,621 A 4/1915 Roberts et al.
1,320,163 A 10/1919 Fitz
1,518,316 A 12/1924 Ellingham
1,526,438 A 2/1925 Scott
1,538,312 A 5/1925 Beat
1,592,463 A 7/1926 Marker
1,658,581 A 2/1928 Tobia
1,697,846 A 1/1929 Anderson
1,704,119 A 3/1929 Buhrke
1,705,997 A 3/1929 Quynn
1,854,548 A 4/1932 Hunt
D107,007 S 11/1937 Cashmore
2,214,356 A 9/1940 Wettlaufer
2,225,930 A 12/1940 Sexton
2,257,575 A 9/1941 Reach
2,328,583 A 9/1943 Reach
2,360,364 A 10/1944 Reach
2,375,249 A 5/1945 Richer
2,460,435 A 2/1949 Schaffer
2,652,256 A 9/1953 Thomas
2,691,525 A 10/1954 Callaghan
3,064,980 A 11/1962 Steiner
3,084,940 A 4/1963 Cissel
3,466,047 A 9/1969 Rodia et al.
3,486,755 A 12/1969 Hodge
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,680,868 A 8/1972 Jacob
3,692,306 A 9/1972 Glover
3,743,297 A 7/1973 Dennis
3,810,631 A 5/1974 Braly
3,860,244 A 1/1975 Cosby
3,897,066 A 7/1975 Belmont
3,976,299 A 8/1976 Lawrence et al.
3,979,122 A 9/1976 Belmont
3,979,123 A 9/1976 Belmont
3,997,170 A 12/1976 Goldberg
4,008,896 A 2/1977 Gordos
4,043,563 A 8/1977 Churchward
4,052,075 A 10/1977 Daly
4,076,254 A 2/1978 Nygren
4,085,934 A 4/1978 Churchward
4,121,832 A 10/1978 Ebbing
4,150,702 A 4/1979 Holmes
4,189,976 A 2/1980 Becker
4,214,754 A 7/1980 Zebelean
D259,698 S 6/1981 MacNeill
4,322,083 A 3/1982 Imai
4,340,229 A 7/1982 Stuff, Jr.
4,398,965 A 8/1983 Campau
4,411,430 A 10/1983 Dian
4,423,874 A 1/1984 Stuff, Jr.
4,438,931 A 3/1984 Motomiya
4,471,961 A 9/1984 Masghati et al.
4,489,945 A 12/1984 Kobayashi
4,530,505 A 7/1985 Stuff
4,553,755 A 11/1985 Yamada
D284,346 S 6/1986 Masters
4,602,787 A 7/1986 Sugioka et al.
4,607,846 A 8/1986 Perkins
4,712,798 A 12/1987 Preato
4,730,830 A 3/1988 Tilley
4,754,974 A 7/1988 Kobayashi
4,754,977 A 7/1988 Sahm
4,762,322 A 8/1988 Molitor et al.
4,795,159 A 1/1989 Nagamoto
4,803,023 A 2/1989 Enomoto et al.
4,809,983 A 3/1989 Langert
4,867,457 A 9/1989 Lowe
4,867,458 A 9/1989 Sumikawa et al.
4,869,507 A 9/1989 Sahm
4,878,666 A 11/1989 Hosoda
4,895,371 A 1/1990 Bushner
4,915,558 A 4/1990 Muller
4,962,932 A 10/1990 Anderson
5,006,023 A 4/1991 Kaplan
5,020,950 A 6/1991 Ladouceur
5,028,049 A 7/1991 McKeighen
5,042,806 A 8/1991 Helmstetter
5,050,879 A 9/1991 Sun et al.
5,058,895 A 10/1991 Igarashi
5,067,715 A 11/1991 Schmidt et al.
5,076,585 A 12/1991 Bouquet
5,078,400 A 1/1992 Desbiolles et al.
5,121,922 A 6/1992 Harsh, Sr.
5,122,020 A 6/1992 Bedi
5,193,810 A 3/1993 Antonious
5,213,328 A 5/1993 Long et al.
5,219,408 A 6/1993 Sun
5,221,086 A 6/1993 Antonious
5,232,224 A 8/1993 Zeider
5,244,210 A 9/1993 Au
5,251,901 A 10/1993 Solheim et al.
5,253,869 A 10/1993 Dingle et al.

(56) References Cited

U.S. PATENT DOCUMENTS

D343,558 S 1/1994 Latraverse et al.
5,297,794 A 3/1994 Lu
5,301,941 A 4/1994 Allen
5,306,008 A 4/1994 Kinoshita
5,316,305 A 5/1994 McCabe
5,320,005 A 6/1994 Hsiao
5,328,176 A 7/1994 Lo
5,330,187 A 7/1994 Schmidt et al.
5,346,216 A 9/1994 Aizawa
5,346,217 A 9/1994 Tsuchiya et al.
5,385,348 A 1/1995 Wargo
5,395,113 A 3/1995 Antonious
5,410,798 A 5/1995 Lo
5,419,556 A 5/1995 Take
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
5,449,260 A 9/1995 Whittle
5,451,056 A 9/1995 Manning
5,467,983 A 11/1995 Chen
D365,615 S 12/1995 Shimatani
5,472,201 A 12/1995 Aizawa et al.
5,472,203 A 12/1995 Schmidt et al.
5,480,152 A 1/1996 Schmidt et al.
5,511,786 A 4/1996 Antonious
5,518,243 A 5/1996 Redman
5,533,730 A 7/1996 Ruvang
5,538,245 A 7/1996 Moore
5,564,705 A 10/1996 Kobayashi et al.
5,571,053 A 11/1996 Lane
5,573,467 A 11/1996 Chou et al.
5,582,553 A 12/1996 Ashcraft et al.
5,603,668 A 2/1997 Antonious
5,613,917 A 3/1997 Kobayashi et al.
5,616,088 A 4/1997 Aizawa et al.
5,620,379 A 4/1997 Borys
5,624,331 A 4/1997 Lo et al.
5,629,475 A 5/1997 Chastonay
5,632,694 A 5/1997 Lee
5,658,206 A 8/1997 Antonious
5,669,827 A 9/1997 Nagamoto
5,681,228 A 10/1997 Mikame et al.
5,683,309 A 11/1997 Reimers
5,688,189 A 11/1997 Bland
5,709,613 A 1/1998 Sheraw
5,718,641 A 2/1998 Lin
5,720,674 A 2/1998 Galy
D392,526 S 3/1998 Nicely
5,735,754 A 4/1998 Antonious
5,746,664 A 5/1998 Reynolds, Jr.
5,749,795 A 5/1998 Schmidt
5,755,627 A 5/1998 Yamazaki et al.
5,762,567 A 6/1998 Antonious
5,766,095 A 6/1998 Antonious
5,769,737 A 6/1998 Holladay et al.
5,776,010 A 7/1998 Helmstetter et al.
5,776,011 A 7/1998 Su et al.
5,788,584 A 8/1998 Parente et al.
5,788,587 A 8/1998 Tseng
5,803,829 A 9/1998 Hayashi
RE35,955 E 11/1998 Lu
5,851,160 A 12/1998 Rugge et al.
5,873,791 A 2/1999 Allen
5,888,148 A 3/1999 Allen
5,908,356 A 6/1999 Nagamoto
5,911,638 A 6/1999 Parente et al.
5,913,735 A 6/1999 Kenmi
5,916,042 A 6/1999 Reimers
5,924,938 A 7/1999 Hines
D412,547 S 8/1999 Fong
5,935,019 A 8/1999 Yamamoto
5,935,020 A 8/1999 Stites et al.
5,941,782 A 8/1999 Cook
5,947,840 A 9/1999 Ryan
5,967,905 A 10/1999 Nakahara et al.
5,971,867 A 10/1999 Galy
5,976,033 A 11/1999 Takeda
5,997,415 A 12/1999 Wood
6,015,354 A 1/2000 Ahn et al.
6,017,177 A 1/2000 Lanham
6,019,686 A 2/2000 Gray
6,023,891 A 2/2000 Robertson et al.
6,032,677 A 3/2000 Blechman et al.
6,033,318 A 3/2000 Drajan, Jr. et al.
6,033,321 A 3/2000 Yamamoto
6,042,486 A 3/2000 Gallagher
6,056,649 A 5/2000 Imai
6,062,988 A 5/2000 Yamamoto
6,074,308 A 6/2000 Domas
6,077,171 A 6/2000 Yoneyama
6,086,485 A 7/2000 Hamada
6,089,994 A 7/2000 Sun
6,120,384 A 9/2000 Drake
6,123,627 A 9/2000 Antonious
6,139,445 A 10/2000 Werner et al.
6,149,533 A 11/2000 Finn
6,162,132 A 12/2000 Yoneyama
6,162,133 A 12/2000 Peterson
6,171,204 B1 1/2001 Starry
6,186,905 B1 2/2001 Kosmatka
6,190,267 B1 2/2001 Marlowe et al.
6,193,614 B1 2/2001 Sasamoto et al.
6,203,448 B1 3/2001 Yamamoto
6,206,789 B1 3/2001 Takeda
6,210,290 B1 4/2001 Erickson et al.
6,217,461 B1 4/2001 Galy
6,238,303 B1 5/2001 Fite
6,244,974 B1 6/2001 Hanberry, Jr.
6,248,025 B1 6/2001 Murphy et al.
6,254,494 B1 7/2001 Hasebe et al.
6,264,414 B1 7/2001 Hartmann et al.
6,270,422 B1 8/2001 Fisher
6,277,032 B1 8/2001 Smith
6,290,609 B1 9/2001 Takeda
6,299,546 B1 10/2001 Wang
6,299,547 B1 10/2001 Kosmatka
6,306,048 B1 10/2001 McCabe et al.
6,319,149 B1 11/2001 Lee
6,319,150 B1 11/2001 Werner et al.
6,334,817 B1 1/2002 Ezawa et al.
6,338,683 B1 1/2002 Kosmatka
6,340,337 B2 1/2002 Hasebe et al.
6,344,000 B1 2/2002 Hamada
6,344,001 B1 2/2002 Hamada et al.
6,344,002 B1 2/2002 Kajita
6,348,012 B1 2/2002 Erickson et al.
6,348,013 B1 2/2002 Kosmatka
6,348,014 B1 2/2002 Chiu
6,354,961 B1 3/2002 Allen
6,364,788 B1 4/2002 Helmstetter et al.
6,379,264 B1 4/2002 Forzano
6,379,265 B1 4/2002 Hirakawa et al.
6,383,090 B1 5/2002 O'Doherty et al.
6,386,987 B1 5/2002 Lejeune, Jr.
6,386,990 B1 5/2002 Reyes et al.
6,390,933 B1 5/2002 Galloway
6,409,612 B1 6/2002 Evans et al.
6,422,951 B1 7/2002 Burrows
6,425,832 B2 7/2002 Cackett et al.
6,434,811 B1 8/2002 Helmstetter et al.
6,436,142 B1 8/2002 Paes et al.
6,440,009 B1 8/2002 Guibaud et al.
6,440,010 B1 8/2002 Deshmukh
6,447,405 B1 9/2002 Chen
6,458,044 B1 10/2002 Vincent et al.
6,461,249 B2 10/2002 Liberatore
6,471,604 B2 10/2002 Hocknell et al.
6,475,101 B2 11/2002 Burrows
6,475,102 B2 11/2002 Helmstetter et al.
6,478,692 B2 11/2002 Kosmatka
6,491,592 B2 12/2002 Cackett et al.
6,508,978 B1 1/2003 Deshmukh

(56) References Cited

U.S. PATENT DOCUMENTS 6,514,154 B1 2/2003 Finn
6,524,197 B2 2/2003 Boone
6,524,198 B2 2/2003 Takeda
6,527,649 B1 3/2003 Neher et al.
6,530,847 B1 3/2003 Antonious
6,530,848 B2 3/2003 Gillig
6,533,679 B1 3/2003 McCabe et al.
6,547,676 B2 4/2003 Cackett et al.
6,558,273 B2 5/2003 Kobayashi et al.
6,565,452 B2 5/2003 Helmstetter et al.
6,569,029 B1 5/2003 Hamburger
6,572,489 B2 6/2003 Miyamoto et al.
6,575,845 B2 6/2003 Galloway et al.
6,575,854 B1 6/2003 Yang et al.
6,582,323 B2 6/2003 Soracco et al.
6,592,468 B2 7/2003 Vincent et al.
6,602,149 B1 8/2003 Jacobson
6,604,568 B2 8/2003 Bliss et al.
6,605,007 B1 8/2003 Bissonnette et al.
6,607,452 B2 8/2003 Helmstetter et al.
6,612,938 B2 9/2003 Murphy et al.
6,616,547 B2 9/2003 Vincent et al.
6,638,180 B2 10/2003 Tsurumaki
6,638,183 B2 10/2003 Takeda
D482,089 S 11/2003 Burrows
D482,090 S 11/2003 Burrows
D482,420 S 11/2003 Burrows
6,641,487 B1 11/2003 Hamburger
6,641,490 B2 11/2003 Ellemor
6,648,772 B2 11/2003 Vincent et al.
6,648,773 B1 11/2003 Evans
6,652,387 B2 11/2003 Liberatore
D484,208 S 12/2003 Burrows
6,663,506 B2 12/2003 Nishimoto et al.
6,669,571 B1 12/2003 Cameron et al.
6,669,578 B1 12/2003 Evans
6,669,580 B1 12/2003 Cackett et al.
6,676,536 B1 1/2004 Jacobson
6,679,786 B2 1/2004 McCabe
6,695,712 B1 2/2004 Iwata et al.
6,716,111 B2 4/2004 Liberatore
6,716,114 B2 4/2004 Nishio
6,719,510 B2 4/2004 Cobzaru
6,719,641 B2 4/2004 Dabbs et al.
6,739,982 B2 5/2004 Murphy et al.
6,739,983 B2 5/2004 Helmstetter et al.
6,743,118 B1 6/2004 Soracco
6,749,523 B1 6/2004 Forzano
6,758,763 B2 7/2004 Murphy et al.
6,773,360 B2 8/2004 Willett et al.
6,773,361 B1 8/2004 Lee
6,776,726 B2 8/2004 Sano
6,800,038 B2 10/2004 Willett et al.
6,805,643 B1 10/2004 Lin
6,808,460 B2 10/2004 Namiki
6,824,475 B2 11/2004 Burnett et al.
6,835,145 B2 12/2004 Tsurumaki
D501,036 S 1/2005 Burrows
6,855,068 B2 2/2005 Antonious
6,860,818 B2 3/2005 Mahaffey et al.
6,860,823 B2 3/2005 Lee
6,860,824 B2 3/2005 Evans
6,875,124 B2 4/2005 Gilbert et al.
6,875,129 B2 4/2005 Erickson et al.
6,881,158 B2 4/2005 Yang et al.
6,881,159 B2 4/2005 Galloway et al.
6,887,165 B2 5/2005 Tsurumaki
6,890,267 B2 5/2005 Mahaffey et al.
6,904,663 B2 6/2005 Willett et al.
6,923,734 B2 8/2005 Meyer
6,926,619 B2 8/2005 Helmstetter et al.
6,939,247 B1 9/2005 Schweigert et al.
6,960,142 B2 11/2005 Bissonnette et al.
6,964,617 B2 11/2005 Williams
6,969,326 B2 11/2005 De Shiell
6,974,393 B2 12/2005 Caldwell et al.
6,988,960 B2 1/2006 Mahaffey et al.
6,991,558 B2 1/2006 Beach et al.
D515,165 S 2/2006 Zimmerman et al.
6,997,820 B2 2/2006 Willett et al.
7,004,852 B2 2/2006 Billings
7,025,692 B2 4/2006 Erickson et al.
7,029,403 B2 4/2006 Rice et al.
7,077,762 B2 7/2006 Kouno et al.
7,086,964 B2 8/2006 Chen et al.
7,134,971 B2 11/2006 Franklin et al.
7,137,905 B2 11/2006 Kohno
7,137,906 B2 11/2006 Tsunoda et al.
7,140,974 B2 11/2006 Chao et al.
7,147,572 B2 12/2006 Kohno
7,147,573 B2 12/2006 DiMarco
7,153,220 B2 12/2006 Lo
7,163,468 B2 1/2007 Gibbs et al.
7,166,038 B2 1/2007 Williams et al.
7,166,040 B2 1/2007 Hoffman et al.
7,166,041 B2 1/2007 Evans
7,169,060 B2 1/2007 Stevens et al.
7,179,034 B2 2/2007 Ladouceur
7,186,190 B1 3/2007 Beach et al.
7,189,169 B2 3/2007 Billings
7,198,575 B2 4/2007 Beach et al.
7,201,669 B2 4/2007 Stites et al.
7,223,180 B2 5/2007 Willett et al.
7,252,600 B2 8/2007 Murphy et al.
7,255,654 B2 8/2007 Murphy et al.
7,267,620 B2 9/2007 Chao et al.
7,273,423 B2 9/2007 Imamoto
7,278,926 B2 10/2007 Frame
7,278,927 B2 10/2007 Gibbs et al.
7,294,064 B2 11/2007 Tsurumaki et al.
7,294,065 B2 11/2007 Liang et al.
7,351,161 B2 4/2008 Beach
7,377,860 B2 5/2008 Breier et al.
7,396,293 B2 7/2008 Soracco
7,407,447 B2 8/2008 Beach et al.
7,419,441 B2 9/2008 Hoffman et al.
7,445,563 B1 11/2008 Werner
7,448,963 B2 11/2008 Beach et al.
D588,223 S 3/2009 Kuan
7,500,924 B2 3/2009 Yokota
7,500,926 B2 3/2009 Rae et al.
7,520,820 B2 4/2009 Dimarco
7,530,901 B2 5/2009 Imamoto et al.
7,530,903 B2 5/2009 Imamoto et al.
7,530,904 B2 5/2009 Beach et al.
7,540,811 B2 6/2009 Beach et al.
7,563,175 B2 7/2009 Nishitani et al.
7,568,985 B2 8/2009 Beach et al.
7,572,193 B2 8/2009 Yokota
7,578,753 B2 8/2009 Beach et al.
7,582,024 B2 9/2009 Shear
7,585,233 B2 9/2009 Horacek
7,591,737 B2 9/2009 Gibbs et al.
7,591,738 B2 9/2009 Beach et al.
7,621,823 B2 11/2009 Beach et al.
7,628,707 B2 12/2009 Beach et al.
7,632,193 B2 12/2009 Thielen
7,632,194 B2 12/2009 Beach et al.
7,632,196 B2 12/2009 Reed et al.
7,641,569 B2 1/2010 Best et al.
7,670,235 B2 3/2010 Lo
7,674,189 B2 3/2010 Beach et al.
7,682,264 B2 3/2010 Hsu et al.
7,717,803 B2 5/2010 DiMarco
7,744,484 B1 6/2010 Chao
7,749,101 B2 7/2010 Imamoto et al.
7,753,806 B2 7/2010 Beach et al.
7,758,451 B2 7/2010 Liang et al.
7,771,291 B1 8/2010 Willett et al.
7,798,914 B2 9/2010 Noble et al.
7,824,277 B2 11/2010 Bennett et al.
7,857,711 B2 12/2010 Shear
7,857,713 B2 12/2010 Yokota
7,867,105 B2 1/2011 Moon

(56) References Cited

U.S. PATENT DOCUMENTS 7,887,431 B2 2/2011 Beach et al.
7,887,434 B2 2/2011 Beach et al.
7,896,753 B2 3/2011 Boyd et al.
7,914,393 B2 3/2011 Hirsch et al.
7,934,999 B2 5/2011 Cackett et al.
7,946,931 B2 5/2011 Oyama
7,988,565 B2 8/2011 Abe
8,012,038 B1 9/2011 Beach et al.
8,012,039 B2 9/2011 Greaney et al.
8,016,694 B2 9/2011 Llewellyn et al.
8,025,587 B2 9/2011 Beach et al.
8,070,623 B2 12/2011 Stites
8,083,609 B2 12/2011 Burnett et al.
8,088,021 B2 1/2012 Albertsen et al.
8,105,175 B2 1/2012 Breier et al.
8,118,689 B2 2/2012 Beach et al.
8,147,350 B2 4/2012 Beach et al.
8,157,672 B2 4/2012 Greaney et al.
8,167,737 B2 5/2012 Oyama
8,177,661 B2 5/2012 Beach et al.
8,182,364 B2 5/2012 Cole et al.
8,197,358 B1 6/2012 Watson
8,206,244 B2 6/2012 Honea et al.
8,235,831 B2 8/2012 Beach et al.
8,235,841 B2 8/2012 Stites et al.
8,235,844 B2 8/2012 Albertsen et al.
8,241,143 B2 8/2012 Albertsen et al.
8,241,144 B2 8/2012 Albertsen et al.
8,257,195 B1 9/2012 Erickson
8,257,196 B1 9/2012 Abbott et al.
8,262,498 B2 9/2012 Beach et al.
8,262,506 B2 9/2012 Watson et al.
8,277,337 B2 10/2012 Shimazaki
8,292,756 B2 10/2012 Greaney et al.
8,303,431 B2 11/2012 Beach et al.
8,328,659 B2 12/2012 Shear
8,337,319 B2 12/2012 Sargent et al.
8,353,786 B2 1/2013 Beach et al.
D675,692 S 2/2013 Oldknow et al.
D678,964 S 3/2013 Oldknow et al.
D678,965 S 3/2013 Oldknow et al.
D678,968 S 3/2013 Oldknow et al.
D678,969 S 3/2013 Oldknow et al.
D678,970 S 3/2013 Oldknow et al.
D678,971 S 3/2013 Oldknow et al.
D678,972 S 3/2013 Oldknow et al.
D678,973 S 3/2013 Oldknow et al.
8,398,503 B2 3/2013 Beach et al.
8,403,771 B1 3/2013 Rice et al.
D679,354 S 4/2013 Oldknow et al.
8,430,763 B2 4/2013 Beach et al.
8,435,134 B2 5/2013 Tang et al.
8,496,541 B2 7/2013 Beach et al.
8,496,544 B2 7/2013 Curtis et al.
8,517,855 B2 8/2013 Beach et al.
8,517,860 B2 8/2013 Albertsen et al.
8,529,368 B2 9/2013 Rice et al.
8,562,453 B2 10/2013 Sato
8,579,728 B2 11/2013 Morales et al.
8,591,351 B2 11/2013 Albertsen et al.
8,602,907 B2 12/2013 Beach et al.
8,616,999 B2 12/2013 Greaney et al.
D697,152 S 1/2014 Harbert et al.
8,622,847 B2 1/2014 Beach et al.
8,628,433 B2 1/2014 Stites et al.
8,632,419 B2 1/2014 Tang et al.
8,641,555 B2 2/2014 Stites et al.
8,663,029 B2 3/2014 Beach et al.
8,678,949 B2 3/2014 Shimazaki
8,690,704 B2 4/2014 Thomas
8,696,487 B2 4/2014 Beach et al.
8,696,491 B1 4/2014 Myers
8,702,531 B2 4/2014 Boyd et al.
8,721,471 B2 5/2014 Albertsen et al.
8,727,900 B2 5/2014 Beach et al.
D707,768 S 6/2014 Oldknow et al.
D707,769 S 6/2014 Oldknow et al.
D707,773 S 6/2014 Oldknow et al.
8,753,222 B2 6/2014 Beach et al.
8,753,226 B2 6/2014 Rice et al.
8,758,153 B2 6/2014 Sargent et al.
D708,281 S 7/2014 Oldknow et al.
8,790,195 B1 7/2014 Myers et al.
8,821,312 B2 9/2014 Burnett et al.
8,827,831 B2 9/2014 Burnett et al.
8,834,289 B2 9/2014 de la Cruz et al.
8,834,290 B2 9/2014 Bezilla et al.
8,834,293 B2 9/2014 Thomas et al.
8,845,450 B2 9/2014 Beach et al.
8,845,454 B2 9/2014 Boyd et al.
D714,893 S 10/2014 Atwell
8,876,622 B2 11/2014 Beach et al.
8,876,627 B2 11/2014 Beach et al.
8,888,607 B2 11/2014 Beach et al.
8,900,069 B2 12/2014 Beach et al.
D722,122 S 2/2015 Greensmith
8,956,240 B2 2/2015 Beach et al.
8,956,244 B1 2/2015 Westrum et al.
8,986,133 B2 3/2015 Bennett et al.
9,033,821 B2 5/2015 Beach et al.
9,101,811 B1 8/2015 Goudarzi et al.
9,180,348 B2 11/2015 Beach
9,180,349 B1 11/2015 Seluga et al.
9,186,560 B2 11/2015 Harbert
9,199,145 B1 12/2015 Myers
9,205,312 B2 12/2015 Zimmerman et al.
9,211,447 B2 12/2015 Harbert
9,220,953 B2 12/2015 Beach
9,227,115 B2 1/2016 Cameron
9,259,627 B1 2/2016 Myers et al.
9,295,885 B2 3/2016 Matsunaga et al.
9,364,728 B1 6/2016 Myers et al.
9,381,410 B2 7/2016 Golden et al.
9,403,069 B2 8/2016 Boyd et al.
9,486,677 B1 11/2016 Seluga et al.
9,498,688 B2 11/2016 Galvan
9,597,558 B1 3/2017 Seluga et al.
9,597,561 B1 3/2017 Seluga et al.
9,623,291 B2 4/2017 Greensmith et al.
9,623,294 B1 4/2017 Kingston et al.
9,630,069 B2 4/2017 Foster et al.
9,636,552 B2 5/2017 Cleghorn et al.
9,636,553 B1 5/2017 Myers
9,662,545 B2 5/2017 Beach et al.
9,687,701 B1 6/2017 Seluga et al.
9,687,702 B1 6/2017 Seluga et al.
9,694,257 B1 7/2017 Seluga et al.
9,694,261 B2 7/2017 Nunez et al.
9,700,763 B2 7/2017 Harbert et al.
9,700,769 B2 7/2017 Beach et al.
9,707,457 B2 7/2017 Mata et al.
9,717,962 B1 8/2017 Seluga et al.
9,724,577 B1 8/2017 Kingston et al.
9,776,058 B2 10/2017 Seluga et al.
9,795,840 B2 10/2017 Greensmith et al.
9,814,954 B2 11/2017 Westrum et al.
9,855,476 B2 1/2018 Seluga et al.
9,901,794 B2 2/2018 Beno et al.
9,908,017 B2 3/2018 Seluga et al.
9,914,027 B1 3/2018 Harbert et al.
9,914,030 B2 3/2018 Cleghorn et al.
9,931,549 B1 4/2018 Seluga et al.
10,035,049 B1 7/2018 Nielson et al.
10,076,688 B1 9/2018 Harbert et al.
10,086,240 B1 10/2018 Hoffman et al.
10,183,202 B1 1/2019 Harbert et al.
10,434,384 B2 10/2019 Mata et al.
10,478,679 B2 11/2019 Harbert et al.
10,569,144 B2 2/2020 Nielson et al.
10,639,524 B2 5/2020 Penney et al.
10,843,048 B1 11/2020 Hoffman et al.
10,898,764 B2 1/2021 Harbert et al.
10,905,929 B2 * 2/2021 Mata ..... A63B 60/02
2001/0049310 A1 12/2001 Cheng et al.

(56) References Cited

U.S. PATENT DOCUMENTS

| | | | |
|---|---|---|---|
| 2002/0022535 | A1 | 2/2002 | Takeda |
| 2002/0025861 | A1 | 2/2002 | Ezawa |
| 2002/0032075 | A1 | 3/2002 | Vatsvog |
| 2002/0055396 | A1 | 5/2002 | Nishimoto et al. |
| 2002/0072434 | A1 | 6/2002 | Yabu |
| 2002/0123394 | A1 | 9/2002 | Tsurumaki |
| 2002/0137576 | A1 | 9/2002 | Dammen |
| 2002/0160854 | A1 | 10/2002 | Beach et al. |
| 2002/0169036 | A1 | 11/2002 | Boone |
| 2002/0183134 | A1 | 12/2002 | Allen et al. |
| 2003/0013545 | A1 | 1/2003 | Vincent et al. |
| 2003/0032500 | A1 | 2/2003 | Nakahara et al. |
| 2003/0036442 | A1 | 2/2003 | Chao et al. |
| 2003/0130059 | A1 | 7/2003 | Billings |
| 2004/0023729 | A1 | 2/2004 | Nagai et al. |
| 2004/0034986 | A1 | 2/2004 | Cheng et al. |
| 2004/0087388 | A1 | 5/2004 | Beach et al. |
| 2004/0121852 | A1 | 6/2004 | Tsurumaki |
| 2004/0157678 | A1 | 8/2004 | Kohno |
| 2004/0176180 | A1 | 9/2004 | Yamaguchi et al. |
| 2004/0176183 | A1 | 9/2004 | Tsurumaki |
| 2004/0180730 | A1 | 9/2004 | Franklin et al. |
| 2004/0192463 | A1 | 9/2004 | Tsurumaki et al. |
| 2004/0235584 | A1 | 11/2004 | Chao et al. |
| 2004/0242343 | A1 | 12/2004 | Chao |
| 2005/0049075 | A1 | 3/2005 | Chen et al. |
| 2005/0070371 | A1 | 3/2005 | Chen et al. |
| 2005/0096151 | A1 | 5/2005 | Hou et al. |
| 2005/0101404 | A1 | 5/2005 | Long et al. |
| 2005/0124435 | A1 | 6/2005 | Gambetta et al. |
| 2005/0137024 | A1 | 6/2005 | Stites et al. |
| 2005/0181884 | A1 | 8/2005 | Beach et al. |
| 2005/0227781 | A1 | 10/2005 | Huang et al. |
| 2005/0239575 | A1 | 10/2005 | Chao et al. |
| 2005/0239576 | A1 | 10/2005 | Stites et al. |
| 2005/0266933 | A1 | 12/2005 | Galloway |
| 2006/0035722 | A1 | 2/2006 | Beach et al. |
| 2006/0058112 | A1 | 3/2006 | Haralason et al. |
| 2006/0068932 | A1 | 3/2006 | Rice et al. |
| 2006/0073910 | A1 | 4/2006 | Imamoto et al. |
| 2006/0084525 | A1 | 4/2006 | Imamoto et al. |
| 2006/0122004 | A1 | 6/2006 | Chen et al. |
| 2006/0154747 | A1 | 7/2006 | Beach et al. |
| 2006/0172821 | A1 | 8/2006 | Evans |
| 2006/0189407 | A1 | 8/2006 | Soracco |
| 2006/0240908 | A1 | 10/2006 | Adams et al. |
| 2007/0021234 | A1 | 1/2007 | Tsurumaki et al. |
| 2007/0026961 | A1 | 2/2007 | Hou |
| 2007/0049400 | A1 | 3/2007 | Imamoto et al. |
| 2007/0049415 | A1 | 3/2007 | Shear |
| 2007/0049417 | A1 | 3/2007 | Shear |
| 2007/0054750 | A1 | 3/2007 | Rice |
| 2007/0105646 | A1 | 5/2007 | Beach et al. |
| 2007/0105647 | A1 | 5/2007 | Beach et al. |
| 2007/0105648 | A1 | 5/2007 | Beach et al. |
| 2007/0105649 | A1 | 5/2007 | Beach et al. |
| 2007/0105650 | A1 | 5/2007 | Beach et al. |
| 2007/0105651 | A1 | 5/2007 | Beach et al. |
| 2007/0105652 | A1 | 5/2007 | Beach et al. |
| 2007/0105653 | A1 | 5/2007 | Beach et al. |
| 2007/0105654 | A1 | 5/2007 | Beach et al. |
| 2007/0105655 | A1 | 5/2007 | Beach et al. |
| 2007/0117648 | A1 | 5/2007 | Yokota |
| 2007/0117652 | A1 | 5/2007 | Beach et al. |
| 2008/0020861 | A1 | 1/2008 | Adams et al. |
| 2008/0096688 | A1 | 4/2008 | Yokota |
| 2008/0146370 | A1 | 6/2008 | Beach et al. |
| 2008/0161127 | A1 | 7/2008 | Yamamoto |
| 2008/0261715 | A1 | 10/2008 | Carter |
| 2008/0261717 | A1 | 10/2008 | Hoffman et al. |
| 2008/0280698 | A1 | 11/2008 | Hoffman et al. |
| 2009/0062029 | A1 | 3/2009 | Stites et al. |
| 2009/0088269 | A1 | 4/2009 | Beach et al. |
| 2009/0088271 | A1 | 4/2009 | Beach et al. |
| 2009/0137338 | A1 | 5/2009 | Kajita |
| 2009/0170632 | A1 | 7/2009 | Beach et al. |
| 2009/0264214 | A1 | 10/2009 | De La Cruz et al. |
| 2009/0286611 | A1 | 11/2009 | Beach et al. |
| 2009/0286618 | A1 | 11/2009 | Beach et al. |
| 2009/0318245 | A1 | 12/2009 | Yim et al. |
| 2010/0016095 | A1 | 1/2010 | Burnett et al. |
| 2010/0029404 | A1 | 2/2010 | Shear |
| 2010/0029408 | A1 | 2/2010 | Abe |
| 2010/0035701 | A1 | 2/2010 | Kusumoto |
| 2010/0048321 | A1 | 2/2010 | Beach et al. |
| 2010/0075774 | A1 | 3/2010 | Ban |
| 2010/0113176 | A1 | 5/2010 | Boyd et al. |
| 2010/0144461 | A1 | 6/2010 | Ban |
| 2010/0167837 | A1 | 7/2010 | Ban |
| 2010/0197423 | A1 | 8/2010 | Thomas et al. |
| 2010/0197426 | A1 | 8/2010 | De La Cruz et al. |
| 2010/0234127 | A1 | 9/2010 | Snyder et al. |
| 2010/0331103 | A1 | 12/2010 | Takahashi et al. |
| 2011/0021284 | A1 | 1/2011 | Stites et al. |
| 2011/0098127 | A1 | 4/2011 | Yamamoto |
| 2011/0151989 | A1 | 6/2011 | Golden et al. |
| 2011/0151997 | A1 | 6/2011 | Shear |
| 2011/0195798 | A1 | 8/2011 | Sander et al. |
| 2011/0218053 | A1 | 9/2011 | Tang et al. |
| 2011/0294599 | A1 | 12/2011 | Albertsen et al. |
| 2012/0083359 | A1 | 4/2012 | Stites |
| 2012/0083362 | A1 | 4/2012 | Albertsen et al. |
| 2012/0083363 | A1 | 4/2012 | Albertsen et al. |
| 2012/0122601 | A1 | 5/2012 | Beach et al. |
| 2012/0142447 | A1 | 6/2012 | Boyd et al. |
| 2012/0142452 | A1 | 6/2012 | Burnett et al. |
| 2012/0149491 | A1 | 6/2012 | Beach et al. |
| 2012/0165110 | A1 | 6/2012 | Cheng |
| 2012/0165111 | A1 | 6/2012 | Cheng |
| 2012/0196701 | A1 | 8/2012 | Stites et al. |
| 2012/0202615 | A1 | 8/2012 | Beach et al. |
| 2012/0220387 | A1 | 8/2012 | Beach et al. |
| 2012/0244960 | A1 | 9/2012 | Tang et al. |
| 2012/0270676 | A1 | 10/2012 | Burnett et al. |
| 2012/0277029 | A1 | 11/2012 | Albertsen et al. |
| 2012/0277030 | A1 | 11/2012 | Albertsen et al. |
| 2012/0289361 | A1 | 11/2012 | Beach et al. |
| 2012/0302366 | A1 | 11/2012 | Murphy |
| 2013/0065705 | A1 | 3/2013 | Morales et al. |
| 2013/0102410 | A1 | 4/2013 | Stites et al. |
| 2013/0165254 | A1 | 6/2013 | Rice et al. |
| 2013/0210542 | A1 | 8/2013 | Harbert et al. |
| 2013/0324284 | A1 | 12/2013 | Stites et al. |
| 2014/0080629 | A1 | 3/2014 | Sargent et al. |
| 2015/0011328 | A1 | 1/2015 | Harbert et al. |
| 2015/0065265 | A1 | 3/2015 | Motokawa et al. |
| 2015/0105177 | A1 | 4/2015 | Beach et al. |
| 2015/0217167 | A1 | 8/2015 | Frame et al. |
| 2015/0231453 | A1 | 8/2015 | Harbert et al. |
| 2015/0297961 | A1 | 10/2015 | Voshall |
| 2015/0306475 | A1 | 10/2015 | Curtis et al. |
| 2016/0023060 | A1 | 1/2016 | Harbert et al. |
| 2016/0250525 | A1 | 9/2016 | Motokawa et al. |
| 2016/0271464 | A1 | 9/2016 | Murphy et al. |
| 2017/0304692 | A1 | 10/2017 | Beach et al. |

FOREIGN PATENT DOCUMENTS

| | | | |
|---|---|---|---|
| DE | 9012884 | | 9/1990 |
| EP | 0470488 | B1 | 3/1995 |
| EP | 0617987 | B1 | 11/1997 |
| EP | 1001175 | A2 | 5/2000 |
| EP | 2377586 | A2 | 10/2011 |
| GB | 194823 | | 12/1921 |
| JP | 57-157374 | | 10/1982 |
| JP | 4180778 | | 6/1992 |
| JP | 05-317465 | | 12/1993 |
| JP | 06-126004 | | 5/1994 |
| JP | 6190088 | A | 7/1994 |
| JP | 06-238022 | | 8/1994 |
| JP | 6-304271 | | 11/1994 |
| JP | 09-028844 | | 2/1997 |
| JP | 03035480 | U | 3/1997 |
| JP | 09-308717 | | 12/1997 |

(56) References Cited

FOREIGN PATENT DOCUMENTS

| | | | |
|---|---|---|---|
| JP | 09-327534 | | 12/1997 |
| JP | 10-234902 | | 8/1998 |
| JP | 10-277187 | | 10/1998 |
| JP | 11114102 | A | 10/1998 |
| JP | 2000014841 | | 1/2000 |
| JP | 2000197718 | A | 7/2000 |
| JP | 2001054595 | | 2/2001 |
| JP | 2001-129130 | | 5/2001 |
| JP | 2001170225 | | 6/2001 |
| JP | 2001204856 | | 7/2001 |
| JP | 2001346918 | | 12/2001 |
| JP | 2002003969 | | 1/2002 |
| JP | 2002017910 | | 1/2002 |
| JP | 2002052099 | | 2/2002 |
| JP | 2002248183 | | 9/2002 |
| JP | 2002253706 | | 9/2002 |
| JP | 2003038691 | | 2/2003 |
| JP | 2003093554 | A | 4/2003 |
| JP | 2003126311 | | 5/2003 |
| JP | 2003226952 | | 8/2003 |
| JP | 2004174224 | | 6/2004 |
| JP | 2004183058 | | 7/2004 |
| JP | 2004222911 | | 8/2004 |
| JP | 2004-261451 | | 9/2004 |
| JP | 2004267438 | | 9/2004 |
| JP | 2004313762 | A | 11/2004 |
| JP | 2004351054 | A | 12/2004 |
| JP | 2004351173 | A | 12/2004 |
| JP | 2005028170 | | 2/2005 |
| JP | 05-296582 | | 10/2005 |
| JP | 2005-296458 | | 10/2005 |
| JP | 05-323978 | | 11/2005 |
| JP | 2006231063 | A | 9/2006 |
| JP | 2006-320493 | | 11/2006 |
| JP | 2008515560 | A | 5/2008 |
| JP | 4128970 | | 7/2008 |
| JP | 2008200118 | A | 9/2008 |
| JP | 2009000281 | | 1/2009 |
| JP | 2010279847 | A | 12/2010 |
| JP | 2011024999 | A | 2/2011 |
| WO | WO88/02642 | | 4/1988 |
| WO | WO1999/020358 | A1 | 4/1999 |
| WO | WO2001/049376 | A1 | 7/2001 |
| WO | WO01/66199 | | 9/2001 |
| WO | WO02/062501 | | 8/2002 |
| WO | WO03/061773 | | 7/2003 |
| WO | WO2004/043549 | | 5/2004 |
| WO | WO2006/044631 | | 4/2006 |
| WO | WO2014/070343 | A1 | 5/2014 |

OTHER PUBLICATIONS

Callaway Golf, World's Straightest Driver: FT-i Driver downloaded from www.callawaygolf.com/ft%2Di/driver.aspx?lang=en on Apr. 5, 2007.

Declaration of Tim Reed, VP of R&D, Adams Golf, Inc., dated Dec. 7, 2012.

Jackson, Jeff, The Modern Guide to Golf Clubmaking, Ohio: Dynacraft Golf Products, Inc., copyright 1994, p. 237.

Nike Golf, Sasquatch 460, downloaded from www.nike.com/nikegolf/index.htm on Apr. 5, 2007.

Nike Golf, Sasquatch Sumo Squared Driver, downloaded from www.nike.com/nikegolf/index.htm on Apr. 5, 2007.

Office action from the Japanese Patent Office in Patent Application No. 2008-264880, dated Nov. 21, 2012.

Office action from the U.S. Patent and Trademark Office in U.S. Appl. No. 12/781,727, dated Aug. 5, 2010.

Office action from the U.S. Patent and Trademark Office in U.S. Appl. No. 13/338,197, dated Jun. 5, 2014.

Office action from the U.S. Patent and Trademark Office in U.S. Appl. No. 13/401,690, dated May 23, 2012.

Office action from the U.S. Patent and Trademark Office in U.S. Appl. No. 13/401,690, dated Feb. 6, 2013.

Office action from the U.S. Patent and Trademark Office in U.S. Appl. No. 13/469,023, dated Jul. 31, 2012.

Office action from the U.S. Patent and Trademark Office in U.S. Appl. No. 13/469,031, dated Oct. 9, 2014.

Office action from the U.S. Patent and Trademark Office in U.S. Appl. No. 13/469,031, dated May 20, 2015.

Office action from the U.S. Patent and Trademark Office in U.S. Appl. No. 13/975,106, dated Feb. 24, 2014.

Office action from the U.S. Patent and Trademark Office in U.S. Appl. No. 13/828,675, dated Jun. 30, 2014.

Office action from the U.S. Patent and Trademark Office in U.S. Appl. No. 14/495,795, dated Jun. 15, 2015.

Office action from the U.S. Patent and Trademark Office in U.S. Appl. No. 14/701,476, dated Jun. 15, 2015.

Taylor Made Golf Company, Inc. Press Release, Burner Fairway Wood, www.tmag.com/media/pressreleases/2007/011807_burner_fairway_rescue.html, Jan. 26, 2007.

Taylor Made Golf Company Inc., R7 460 Drivers, downloaded from www.taylormadegolf.com/product_detail.asp?pID=14section=overview on Apr. 5, 2007.

Titleist 907D1, downloaded from www.tees2greens.com/forum/Uploads/Images/7ade3521-192b-4611-870b-395d.jpg on Feb. 1, 2007.

* cited by examiner

GOLF CLUB HEAD

CROSS-REFERENCE TO RELATED APPLICATIONS

This application is a continuation of U.S. patent application Ser. No. 16/579,666, filed Sep. 23, 2019, which is a continuation of U.S. patent application Ser. No. 15/645,587, filed Jul. 10, 2017, now U.S. Pat. No. 10,434,384, which is a continuation of U.S. patent application Ser. No. 14/939,648, filed Nov. 12, 2015, now U.S. Pat. No. 9,707,457, which is a continuation-in-part of U.S. patent application Ser. No. 14/871,789, filed Sep. 30, 2015, now U.S. Pat. No. 9,700,763, which is a continuation of U.S. patent application Ser. No. 14/701,476, filed Apr. 30, 2015, now U.S. Pat. No. 9,211,447, which is a continuation of U.S. patent application Ser. No. 14/495,795, filed Sep. 24, 2014, now U.S. Pat. No. 9,186,560, which is a continuation of U.S. patent application Ser. No. 13/828,675, filed Mar. 14, 2013, now U.S. Pat. No. 8,888,607, which is a continuation-in-part of U.S. patent application Ser. No. 13/469,031, filed May 10, 2012, now U.S. Pat. No. 9,220,953, which is a continuation-in-part of U.S. patent application Ser. No. 13/338,197, filed Dec. 27, 2011, now U.S. Pat. No. 8,900,069, which claims the benefit of U.S. Provisional Patent Application No. 61/427,772, filed Dec. 28, 2010, all of which applications are incorporated by reference herein in their entireties.

INCORPORATIONS BY REFERENCE

Additional related applications concerning golf clubs include U.S. patent application Ser. Nos. 13/839,727, 13/956,046, 14/260,328, 14/330,205, 14/259,475, 14/488,354, 14/734,181, 14/472,415, 14/253,159, 14/449,252, 14/658,267, 14/456,927, 14/227,008, 14/074,481, and 14/575,745, all of which are incorporated by reference herein in their entireties.

FIELD

The present application concerns golf club heads, and more particularly, golf club heads having increased striking face flexibility and unique relationships between golf club head variables to ensure club head attributes work together to achieve desired performance.

BACKGROUND

Golf club manufacturers often must choose to improve one performance characteristic at the expense of another. In fact, the incorporation of new technologies that improve performance may necessitate changes to other aspects of a golf club head so that the features work together rather than reduce the associated benefits. Further, it is often difficult to identify the tradeoffs and changes that must be made to ensure aspects of the club head work together to achieve the desired performance. The disclosed embodiments tackle these issues.

SUMMARY

This application discloses, among other innovations, golf club heads that provide improved sound, durability, ball speed, forgiveness, and playability. The club head may include a flexible channel to improve the performance of the club head, and a channel tuning system to reduce undesirable club head characteristics introduced, or heightened, via the flexible channel. The channel tuning system includes a sole engaging channel tuning element in contact with the sole and the channel. The club head may also include an aerodynamic configuration, as well as a body tuning system. The foregoing and other features and advantages of the golf club head will become more apparent from the following detailed description, which proceeds with reference to the accompanying figures.

DETAILED DESCRIPTION

The following describes embodiments of golf club heads for metalwood type golf clubs, including drivers, fairway woods, rescue clubs, hybrid clubs, and the like. Several of the golf club heads incorporate features that provide the golf club heads and/or golf clubs with increased moments of inertia and low centers of gravity, centers of gravity located in preferable locations, improved club head and face geometries, increased sole and lower face flexibility, desirable club head tuning, higher coefficients or restitution ("COR") and characteristic times ("CT"), and/or decreased backspin rates relative to other golf club heads that have come before.

The following makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same object.

Accordingly, the following detailed description shall not to be construed in a limiting sense and the scope of property rights sought shall be defined by the appended claims and their equivalents.

Normal Address Position

Club heads and many of their physical characteristics disclosed herein will be described using "normal address position" as the club head reference position, unless otherwise indicated.

Figure 1:
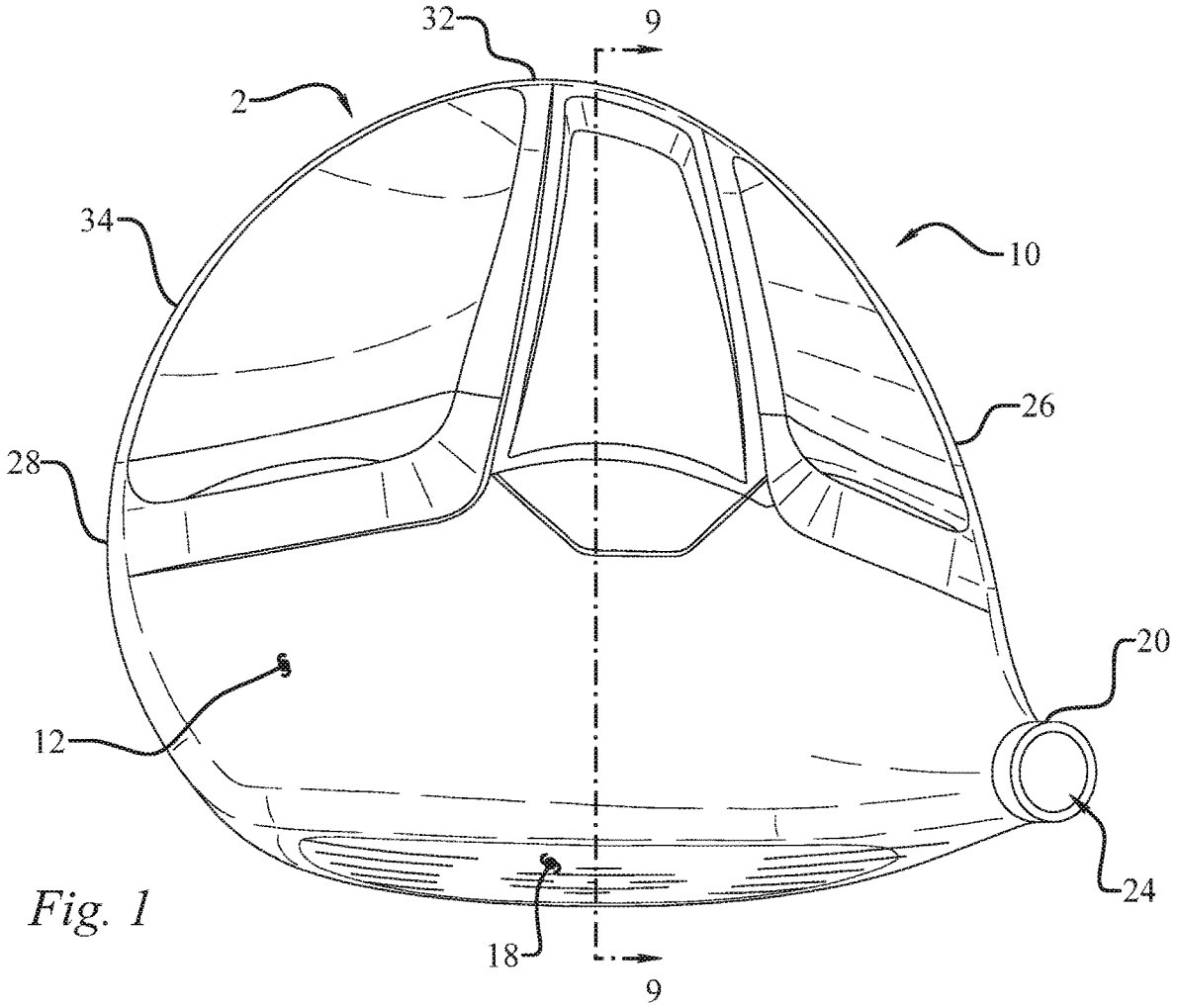
FIG. 1 is a top plan view of one embodiment of a golf club head.
Figure 2:
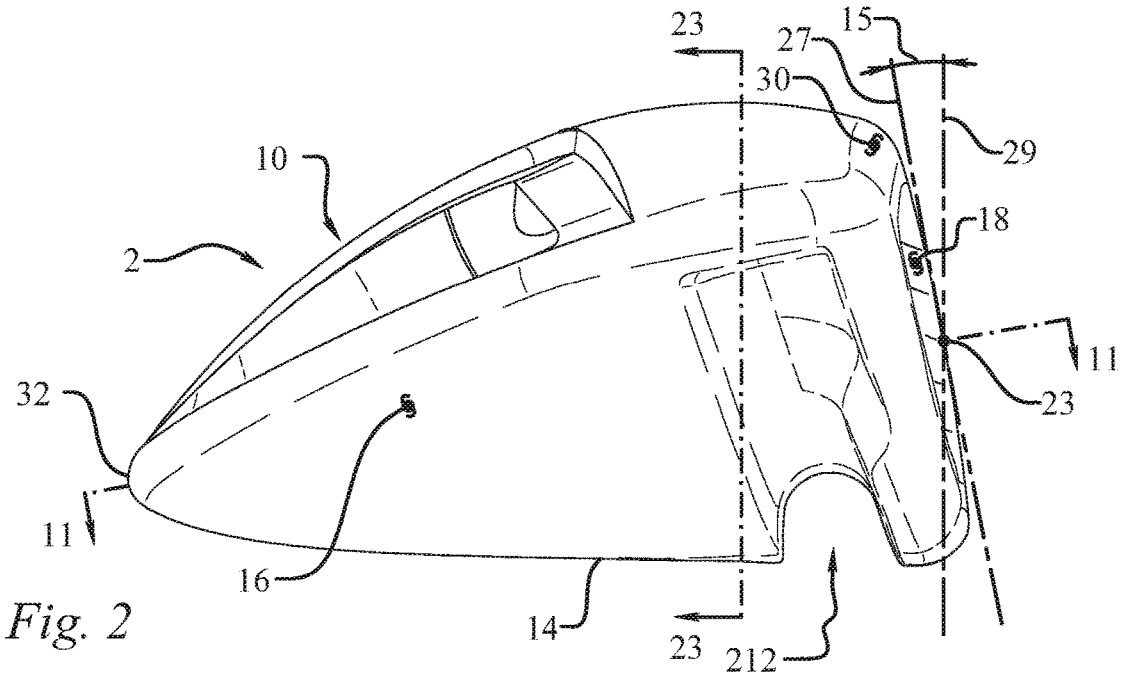
FIG. 2 is a side elevation view from a toe side of the golf club head of FIG. 1.
Figure 3:
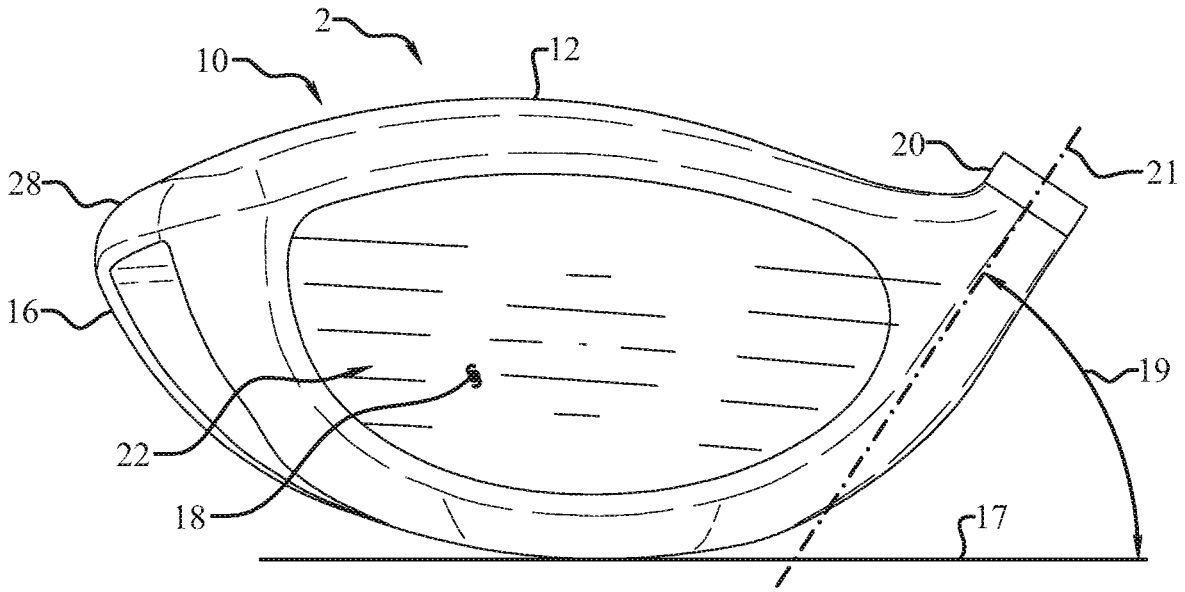
FIG. 3 is a front elevation view of the golf club head of FIG. 1.

FIGS. 1-3 illustrate one embodiment of a golf club head at normal address position. FIG. 1 illustrates a top plan view of the club head 2, FIG. 2 illustrates a side elevation view from the toe side of the club head 2, and FIG. 3 illustrates a front elevation view. By way of preliminary description, the club head 2 includes a hosel 20 and a ball striking club face 18. At normal address position, the club head 2 rests on the ground plane 17, a plane parallel to the ground.

As used herein, "normal address position" means the club head position wherein a vector normal to the club face 18 substantially lies in a first vertical plane (i.e., a vertical plane is perpendicular to the ground plane 17), the centerline axis 21 of the club shaft substantially lies in a second vertical plane, and the first vertical plane and the second vertical plane substantially perpendicularly intersect.

Club Head

A golf club head, such as the golf club head 2, includes a hollow body 10 defining a crown portion 12, a sole portion 14 and a skirt portion 16. A striking face, or face portion, 18 attaches to the body 10. The body 10 can include a hosel 20, which defines a hosel bore 24 adapted to receive a golf club shaft. The body 10 further includes a heel portion 26, a toe portion 28, a front portion 30, and a rear portion 32.

The club head 2 also has a volume, typically measured in cubic-centimeters ($cm^3$), equal to the volumetric displacement of the club head 2, assuming any apertures are sealed by a substantially planar surface. (See United States Golf Association "Procedure for Measuring the Club Head Size of Wood Clubs," Revision 1.0, Nov. 21, 2003). In some implementations, the golf club head 2 has a volume between approximately 120 $cm^3$ and approximately 460 $cm^3$, and a total mass between approximately 185 g and approximately 245 g. Additional specific implementations having additional specific values for volume and mass are described elsewhere herein.

Figure 23:
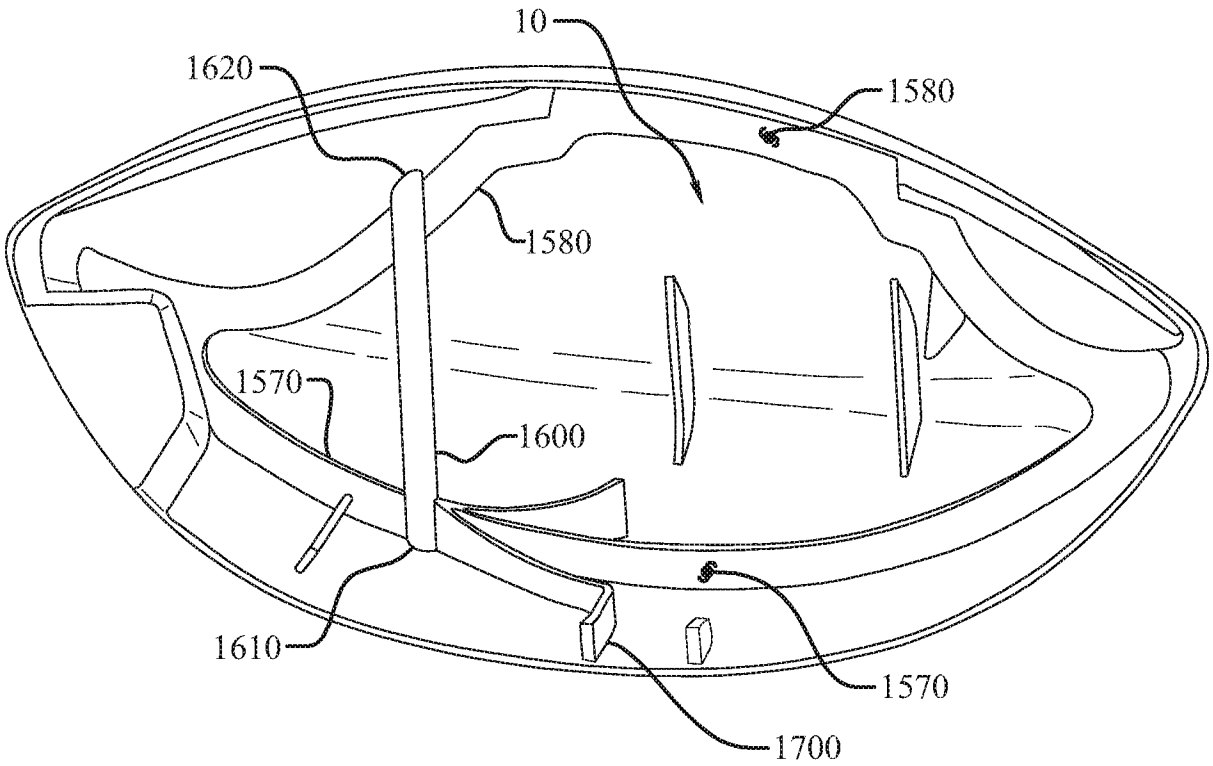
FIG. 23 is a cross-sectional view of one embodiment of a golf club head.
Figure 24:
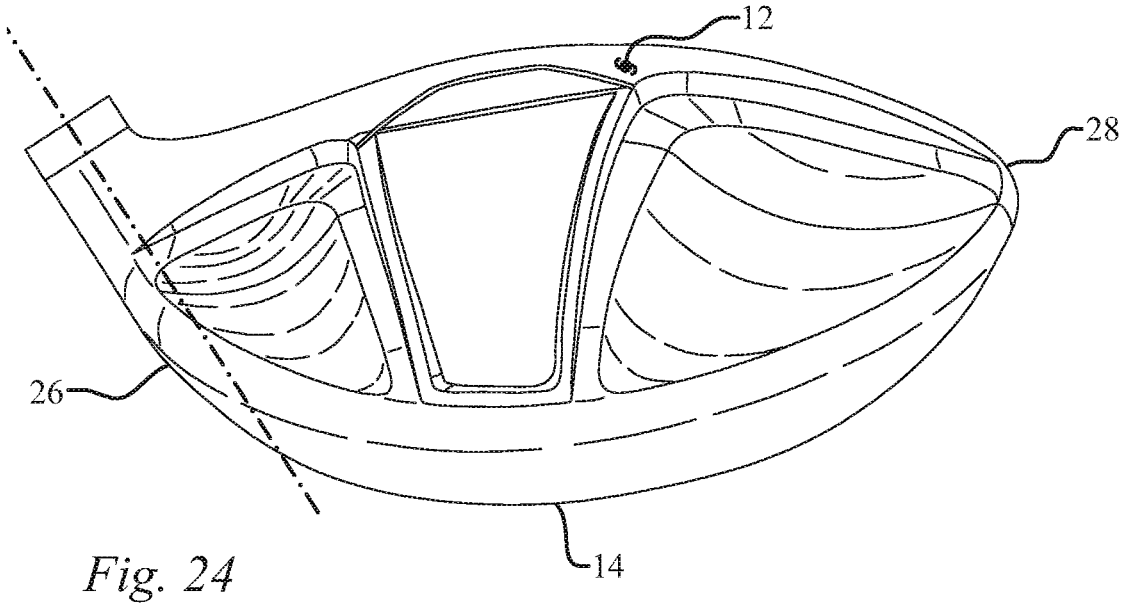
FIG. 24 is a rear elevation view of one embodiment of a golf club head.
Figure 25:
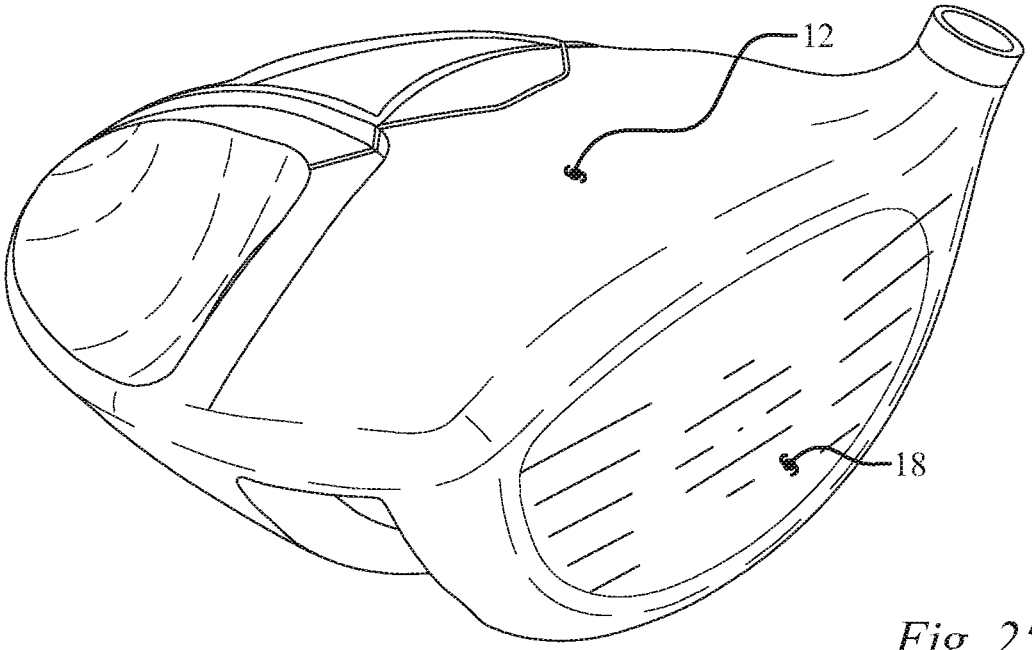
FIG. 25 is a perspective view of one embodiment of a golf club head.

As used herein, "crown" means an upper portion of the club head above a peripheral outline 34 of the club head as viewed from a top-down direction and rearward of the topmost portion of the striking face 18, as seen in FIG. 1. FIGS. 11-22 and 39 illustrate embodiments of a cross-sectional view of the golf club head of FIG. 1 taken along line 11-11 of FIG. 2 showing internal features of the golf club head. FIGS. 9-10 and 29-31 illustrate embodiments of a cross-sectional view of the golf club head of FIG. 1 taken along line 9-9 of FIG. 1 showing internal features of the golf club head. FIG. 23 illustrates an embodiment of a cross-sectional view of the golf club head of FIG. 1 taken along line 23-23 of FIG. 2 showing internal features of the golf club head. As used herein, "sole" means a lower portion of the club head 2 extending upwards from a lowest point of the club head when the club head is at normal address position. In other implementations, the sole 14 extends upwardly from the lowest point of the golf club body 10 a shorter distance than the sole 14 of golf club head 2. Further, the sole 14 can define a substantially flat portion extending substantially horizontally relative to the ground 17 when in normal address position. In some implementations, the bottommost portion of the sole 14 extends substantially parallel to the ground 17 between approximately 5% and approximately 70% of the depth Dch of the golf club body 10. In some implementations, an adjustable mechanism is provided on the sole 14 to "decouple" the relationship between face angle and hosel/shaft loft, i.e., to allow for separate adjustment of square loft and face angle of a golf club. For example, some embodiments of the golf club head 2 include an adjustable sole portion that can be adjusted relative to the club head body 2 to raise and lower the rear end of the club head relative to the ground. Further detail concerning the adjustable sole portion is provided in U.S. patent application Ser. No. 14/734,181, which is incorporated herein by reference. As used herein, "skirt" means a side portion of the club head 2 between the crown 12 and the sole 14 that extends across a periphery 34 of the club head, excluding the face 18, from the toe portion 28, around the rear portion 32, to the heel portion 26.

Figure 9:
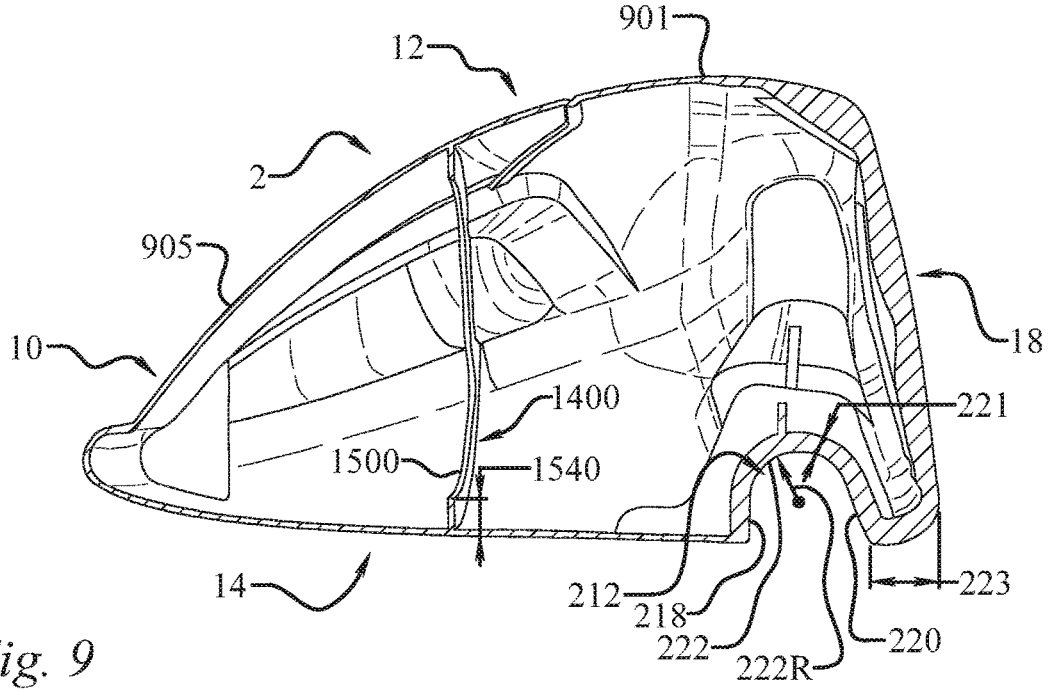
FIG. 9 is a cross-sectional view of one embodiment of a golf club head.

As used herein, "striking surface" means a front or external surface of the striking face 18 configured to impact a golf ball (not shown). In several embodiments, the striking face or face portion 18 can be a striking plate attached to the body 10 using conventional attachment techniques, such as welding, as will be described in more detail below. In some embodiments, the striking surface 22 can have a bulge and roll curvature. As illustrated by FIG. 9, the average face thickness for the illustrated embodiment is in the range of from about 1.0 mm to about 4.5 mm, such as between about 2.0 mm and about 2.2 mm.

The body 10 can be made from a metal alloy (e.g., an alloy of titanium, an alloy of steel, an alloy of aluminum, and/or an alloy of magnesium), a composite material, such as a graphitic composite, a ceramic material, or any combination thereof (e.g., a metallic sole and skirt with a composite, magnesium, or aluminum crown). The crown 12, sole 14, and skirt 16 can be integrally formed using techniques such as molding, cold forming, casting, and/or forging and the striking face 18 can be attached to the crown, sole and skirt by known means. For example, in some embodiments, the body 10 can be formed from a cup-face structure, with a wall or walls extending rearward from the edges of the inner striking face surface and the remainder of the body formed as a separate piece that is joined to the walls of the cup-face by welding, cementing, adhesively bonding, or other technique known to those skilled in the art.

Figure 7:
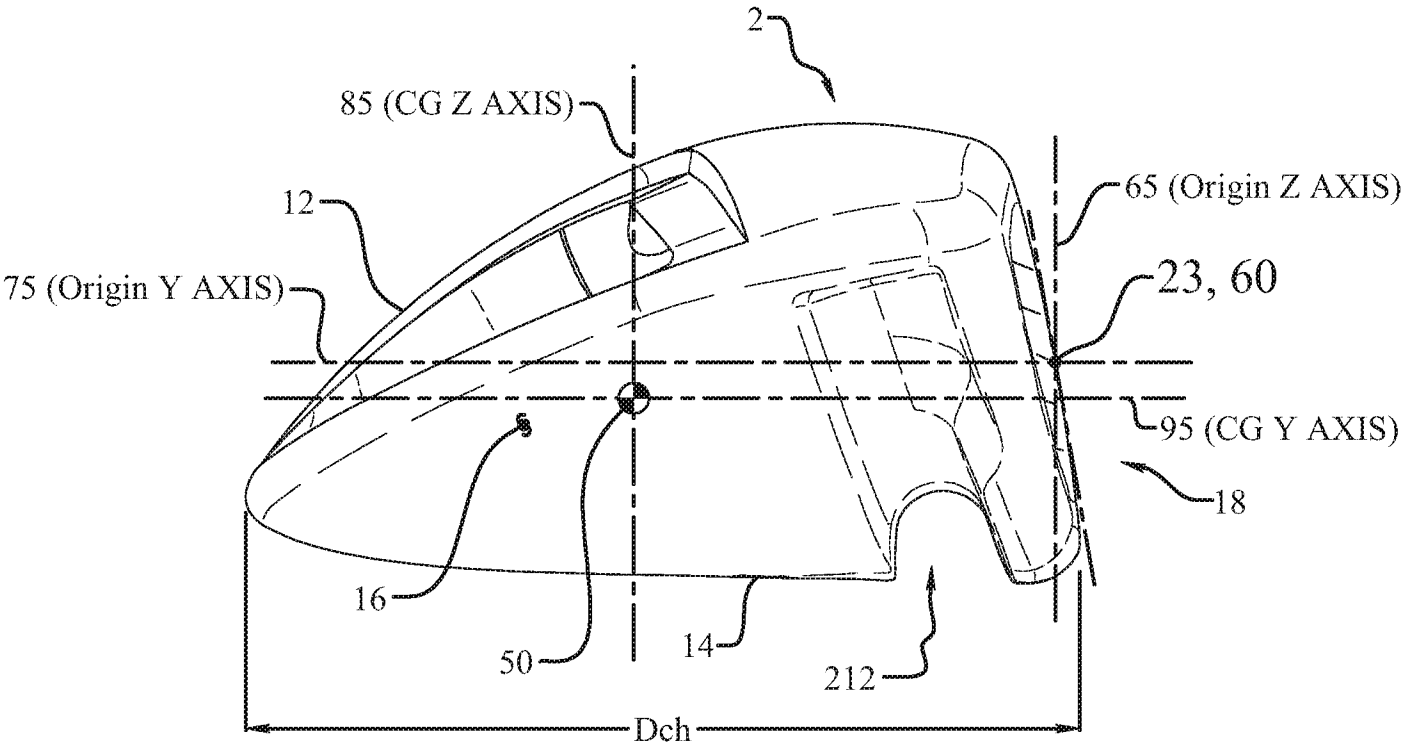
FIG. 7 is a side elevation view of one embodiment of a golf club head.
Figure 8:
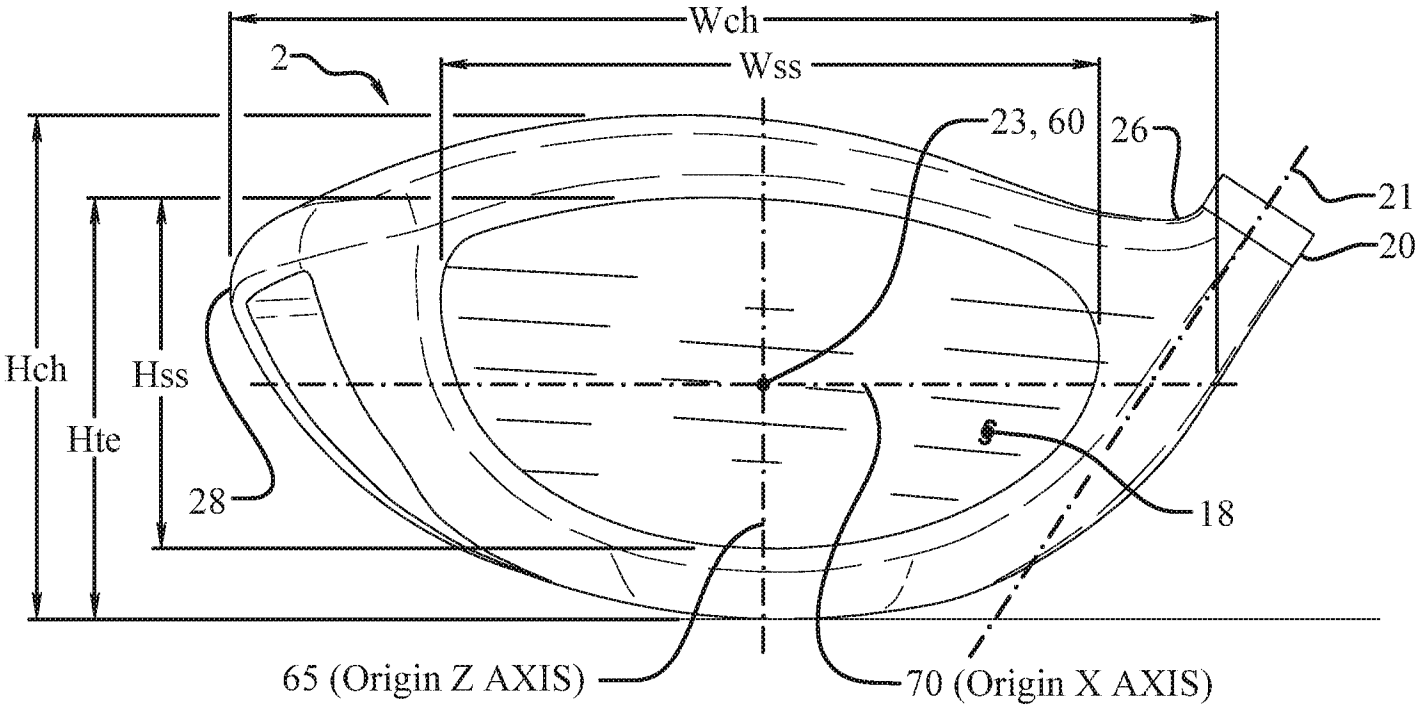
FIG. 8 is a front elevation view of one embodiment of a golf club head.
Figure 10:
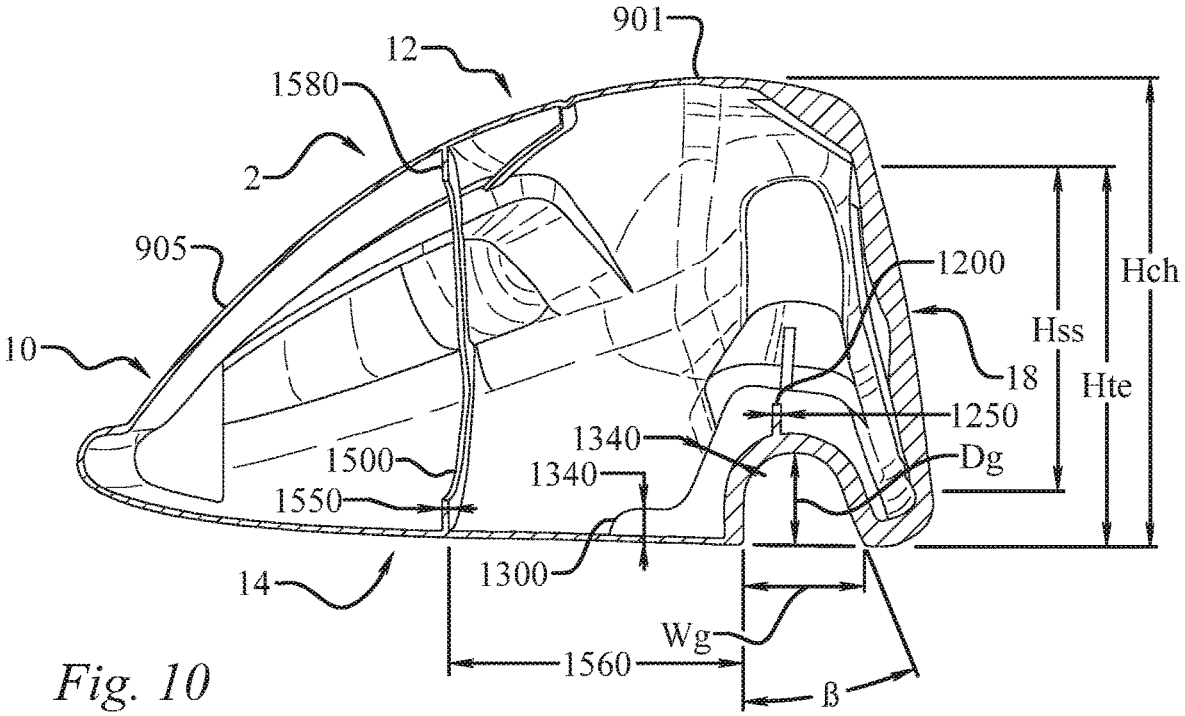
FIG. 10 is a cross-sectional view of one embodiment of a golf club head.

Referring to FIGS. 7 and 8, the ideal impact location 23 of the golf club head 2 is disposed at the geometric center of the face 18. The ideal impact location 23 is typically defined as the intersection of the midpoints of a height Hss and a width Wss of the face 18. Both Hss and Wss are determined using the striking face curve Sss. The striking face curve is bounded on its periphery by all points where the face transitions from a substantially uniform bulge radius (face heel-to-toe radius of curvature) and a substantially uniform roll radius (face crown-to-sole radius of curvature) to the body. In the illustrated example, Hss is the distance from the periphery proximate to the sole portion of Sss to the perhiphery proximate to the crown portion of Sss measured in a vertical plane (perpendicular to ground) that extends through the geometric center of the face 18 (e.g., this plane is substantially normal to the x-axis). Further, as seen in FIGS. 8 and 10, the face 18 has a top edge elevation, Hte, measured from the ground plane. Similarly, Wss is the distance from the periphery proximate to the heel portion of Sss to the periphery proximate to the toe portion of Sss measured in a horizontal plane (e.g., substantially parallel to ground) that extends through the geometric center of the face (e.g., this plane is substantially normal to the z-axis). See USGA "Procedure for Measuring the Flexibility of a Golf Clubhead," Revision 2.0 for the methodology to measure the geometric center of the striking face. In some implementations, the golf club head face 18 has a height (Hss) between approximately 20 mm and approximately 45 mm, and a width (Wss) between approximately 60 mm and approximately 120 mm. In one specific implementation, the face 18 has a height Hss of approximately 26 mm, width Wss of approximately 71 mm, and total striking surface area of approximately 2050 $mm^2$. Additional specific implementations having additional specific values for face height Hss, face width Wss, and total striking surface area are described elsewhere herein.

In some embodiments, the striking face 18 is made of a composite material such as described in U.S. patent application Ser. No. 14/154,513, which is incorporated herein by reference. In other embodiments, the striking face 18 is made from a metal alloy (e.g., an alloy of titanium, steel, aluminum, and/or magnesium), ceramic material, or a combination of composite, metal alloy, and/or ceramic materials. Examples of titanium alloys include 3-2.5, 6-4, SP700, 15-3-3-3, 10-2-3, or other alpha/near alpha, alpha-beta, and beta/near beta titanium alloys. Examples of steel alloys include 304, 410, 450, or 455 stainless steel.

In still other embodiments, the striking face 18 is formed of a maraging steel, a maraging stainless steel, or a precipitation-hardened (PH) steel or stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In some embodiments, a non-stainless maraging steel contains about 17-19% nickel, 8-12% cobalt, 3-5% molybdenum, and 0.2-1.6% titanium. Maraging stainless steels have less nickel than maraging steels, but include significant amounts of chromium to prevent rust.

An example of a non-stainless maraging steel suitable for use in forming a striking face 18 includes NiMark® Alloy 300, having a composition that includes the following components: nickel (18.00 to 19.00%), cobalt (8.00 to 9.50%), molybdenum (4.70 to 5.10%), titanium (0.50 to 0.80%), manganese (maximum of about 0.10%), silicon (maximum of about 0.10%), aluminum (about 0.05 to 0.15%), calcium (maximum of about 0.05%), zirconium (maximum of about 0.03%), carbon (maximum of about 0.03%), phosphorus (maximum of about 0.010%), sulfur (maximum of about 0.010%), boron (maximum of about 0.003%), and iron (balance). Another example of a non-stainless maraging steel suitable for use in forming a striking face 18 includes NiMark® Alloy 250, having a composition that includes the following components: nickel (18.00 to 19.00%), cobalt (7.00 to 8.00%), molybdenum (4.70 to 5.00%), titanium (0.30 to 0.50%), manganese (maximum of about 0.10%), silicon (maximum of about 0.10%), aluminum (about 0.05 to 0.15%), calcium (maximum of about 0.05%), zirconium (maximum of about 0.03%), carbon (maximum of about 0.03%), phosphorus (maximum of about 0.010%), sulfur (maximum of about 0.010%), boron (maximum of about 0.003%), and iron (balance). Other maraging steels having comparable compositions and material properties may also be suitable for use.

In several specific embodiments, a golf club head includes a body 10 that is formed from a metal (e.g., steel), a metal alloy (e.g., an alloy of titanium, an alloy of aluminum, and/or an alloy of magnesium), a composite material, such as a graphitic composite, a ceramic material, or any combination thereof, as described above. In some of these embodiments, a striking face 18 is attached to the body 10, and is formed from a non-stainless steel, such as one of the maraging steels described above. In one specific example, a golf club head includes a body 10 that is formed from a stainless steel (e.g., Custom 450® Stainless) and a striking face 18 that is formed from a non-stainless maraging steel (e.g., NiMark® Alloy 300).

In several alternative embodiments, a golf club head includes a body 10 that is formed from a non-stainless steel, such as one of the maraging steels described above. In some of these embodiments, a striking face 18 is attached to the body 10, and is also formed from a non-stainless steel, such as one of the maraging steels described above. In one specific example, a golf club head includes a body 10 and a striking face 18 that are each formed from a non-stainless maraging steel (e.g., NiMark® Alloy 300 or NiMark® Alloy 250).

When at normal address position as seen in FIG. 3, the club head 2 is disposed at a lie-angle 19 relative to the club shaft axis 21 and the club face has a loft angle 15. The lie-angle 19 refers to the angle between the centerline axis 21 of the club shaft and the ground plane 17 at normal address position. Lie angle for a fairway wood typically ranges from about 54 degrees to about 62 degrees, most typically about 56 degrees to about 60 degrees. Referring to FIG. 2, loft-angle 15 refers to the angle between a tangent line 27 to the club face 18 and a vector normal to the ground plane 29 at normal address position. Loft angle for a driver is typically greater than about 7 degrees, and the loft angle for a fairway wood is typically greater than about 13 degrees. For example, loft for a driver typically ranges from about 7 degrees to about 13 degrees, and the loft for a fairway wood typically ranges from about 13 degrees to about 28 degrees, and more preferably from about 13 degrees to about 22 degrees.

A club shaft is received within the hosel bore 24 and is aligned with the centerline axis 21. In some embodiments, a connection assembly is provided that allows the shaft to be easily disconnected from the club head 2. In still other embodiments, the connection assembly provides the ability for the user to selectively adjust the loft-angle 15 and/or lie-angle 19 of the golf club. For example, in some embodiments, a sleeve is mounted on a lower end portion of the shaft and is configured to be inserted into the hosel bore 24. The sleeve has an upper portion defining an upper opening that receives the lower end portion of the shaft, and a lower portion having a plurality of longitudinally extending, angularly spaced external splines located below the shaft and adapted to mate with complimentary splines in the hosel opening 24. The lower portion of the sleeve defines a longitudinally extending, internally threaded opening adapted to receive a screw for securing the shaft assembly to the club head 2 when the sleeve is inserted into the hosel opening 24. Further detail concerning the shaft connection assembly is provided in U.S. patent application Ser. No. 14/074,481, which is incorporated herein by reference, and some embodiments are described later herein.

Golf Club Head Coordinates

Figure 6:
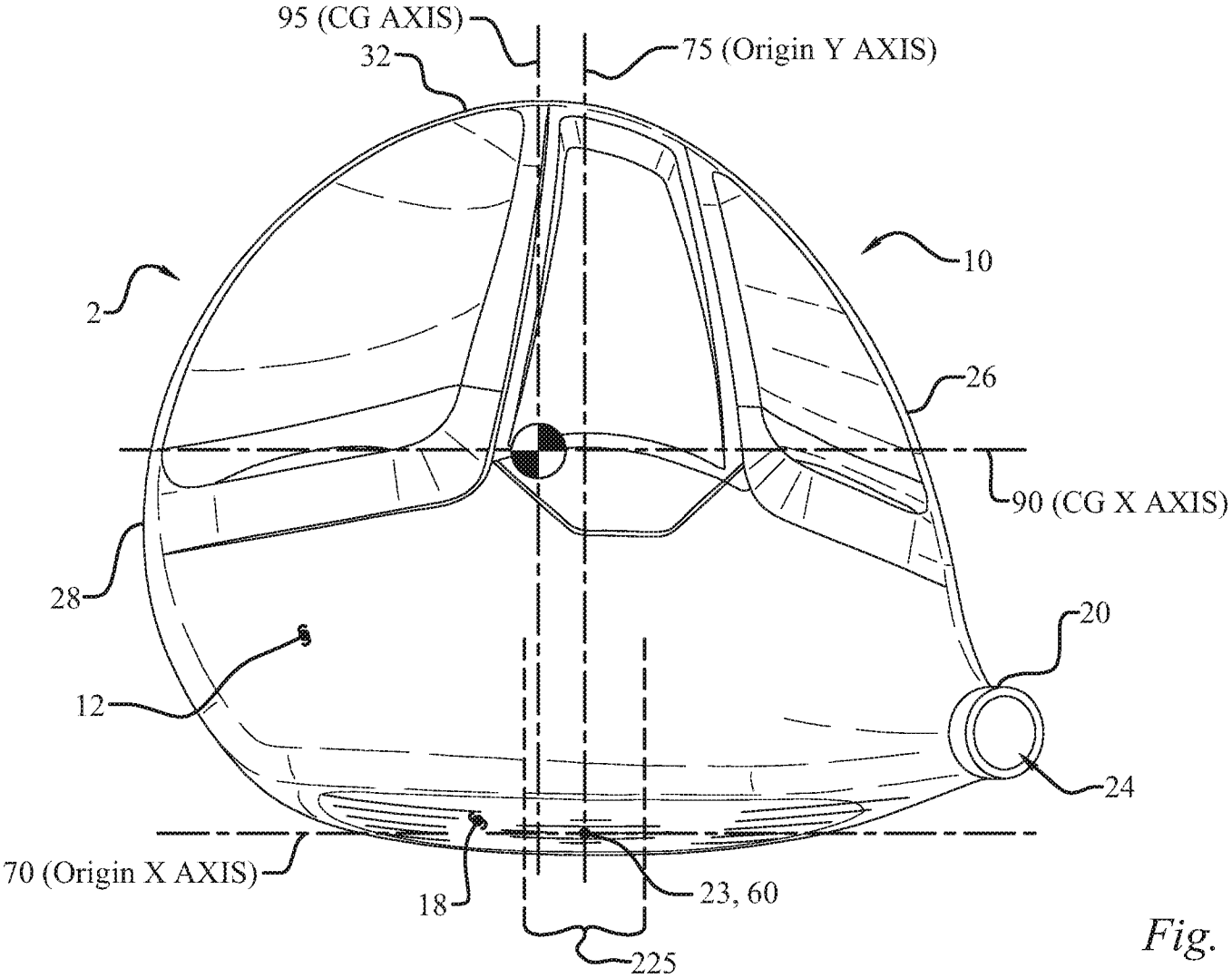
FIG. 6 is a top plan view of one embodiment of a golf club head.

Referring to FIGS. 6-8, a club head origin coordinate system can be defined such that the location of various features of the club head (including, e.g., a club head center-of-gravity (CG) 50) can be determined. A club head origin 60 is illustrated on the club head 2 positioned at the ideal impact location 23, or geometric center, of the face 18.

The head origin coordinate system defined with respect to the head origin 60 includes three axes: a z-axis 65 extending through the head origin 60 in a generally vertical direction relative to the ground 17 when the club head 2 is at normal address position; an x-axis 70 extending through the head origin 60 in a toe-to-heel direction generally parallel to the face 18, e.g., generally tangential to the face 18 at the ideal impact location 23, and generally perpendicular to the z-axis 65; and a y-axis 75 extending through the head origin 60 in a front-to-back direction and generally perpendicular to the x-axis 70 and to the z-axis 65. The x-axis 70 and the y-axis 75 both extend in generally horizontal directions relative to the ground 17 when the club head 2 is at normal address position. The x-axis 70 extends in a positive direction from the origin 60 to the heel 26 of the club head 2. The y-axis 75 extends in a positive direction from the origin 60 towards the rear portion 32 of the club head 2. The z-axis 65 extends in a positive direction from the origin 60 towards the crown 12. An alternative, above ground, club head coordinate system places the origin 60 at the intersection of the z-axis 65 and the ground plane 17, providing positive z-axis coordinates for every club head feature. As used herein, "Zup" means the CG z-axis location determined according to the above ground coordinate system. Zup generally refers to the height of the CG 50 above the ground plane 17.

In several embodiments, the golf club head can have a CG with an x-axis coordinate between approximately −2.0 mm and approximately 6.0 mm, such as between approximately −2.0 mm and approximately 3.0 mm, a y-axis coordinate between approximately 15 mm and approximately 40 mm, such as between approximately 20 mm and approximately 30 mm, or between approximately 23 mm and approximately 28 mm, and a z-axis coordinate between approximately 0.0 mm and approximately −12.0 mm, such as between approximately −1.0 mm and approximately −9.0 mm, or between approximately −1.0 mm and approximately −5.0 mm. In certain embodiments, a z-axis coordinate between about 0.0 mm and about −12.0 mm provides a Zup value of between approximately 10 mm and approximately 30 mm. Additional specific implementations having additional specific values for the CG x-axis coordinate, CG y-axis coordinate, CG z-axis coordinate, and Zup are described elsewhere herein.

Another alternative coordinate system uses the club head center-of-gravity (CG) 50 as the origin when the club head 2 is at normal address position. Each center-of-gravity axis passes through the CG 50. For example, the CG x-axis 90 passes through the center-of-gravity 50 substantially parallel to the ground plane 17 and generally parallel to the origin x-axis 70 when the club head is at normal address position. Similarly, the CG y-axis 95 passes through the center-of-gravity 50 substantially parallel to the ground plane 17 and generally parallel to the origin y-axis 75, and the CG z-axis 85 passes through the center-of-gravity 50 substantially perpendicular to the ground plane 17 and generally parallel to the origin z-axis 65 when the club head is at normal address position.

Mass Moments of Inertia

Referring to FIGS. 6-7, golf club head moments of inertia are typically defined about the three CG axes that extend through the golf club head center-of-gravity 50.

For example, a moment of inertia about the golf club head CG z-axis 85 can be calculated by the following equation $$Izz=\int(x^2+y^2)dm$$

where x is the distance from a golf club head CG yz-plane to an infinitesimal mass, dm, and y is the distance from the golf club head CG xz-plane to the infinitesimal mass, dm. The golf club head CG yz-plane is a plane defined by the golf club head CG y-axis 95 and the golf club head CG z-axis 85.

The moment of inertia about the CG z-axis (Izz) is an indication of the ability of a golf club head to resist twisting about the CG z-axis. Greater moments of inertia about the CG z-axis (Izz) provide the golf club head 2 with greater forgiveness on toe-ward or heel-ward off-center impacts with a golf ball. In other words, a golf ball hit by a golf club head 2 on a location of the striking face 18 between the toe 28 and the ideal impact location 23 tends to cause the golf club head to twist rearwardly and the golf ball to draw (e.g., to have a curving trajectory from right-to-left for a right-handed swing). Similarly, a golf ball hit by a golf club head 2 on a location of the striking face 18 between the heel 26 and the ideal impact location 23 causes the golf club head 2 to twist forwardly and the golf ball to slice (e.g., to have a curving trajectory from left-to-right for a right-handed swing). Increasing the moment of inertia about the CG z-axis (Izz) reduces forward or rearward twisting of the golf club head, reducing the negative effects of heel or toe mis-hits.

A moment of inertia about the golf club head CG x-axis 90 can be calculated by the following equation $$Ixx=\int(y^2+z^2)dm$$

where y is the distance from a golf club head CG xz-plane to an infinitesimal mass, dm, and z is the distance from a golf club head CG xy-plane to the infinitesimal mass, dm. The golf club head CG xz-plane is a plane defined by the golf club head CG x-axis 90 and the golf club head CG z-axis 85. The CG xy-plane is a plane defined by the golf club head CG x-axis 90 and the golf club head CG y-axis 95.

As the moment of inertia about the CG z-axis (Izz) is an indication of the ability of a golf club head to resist twisting about the CG z-axis, the moment of inertia about the CG x-axis (Ixx) is an indication of the ability of the golf club head to resist twisting about the CG x-axis. Greater moments of inertia about the CG x-axis (Ixx) improve the forgiveness of the golf club head 2 on high and low off-center impacts with a golf ball. In other words, a golf ball hit by a golf club head 2 on a location of the striking surface 18 above the ideal impact location 23 causes the golf club head 2 to twist upwardly and the golf ball to have a higher trajectory than desired. Similarly, a golf ball hit by a golf club head 2 on a location of the striking face 18 below the ideal impact location 23 causes the golf club head 2 to twist downwardly and the golf ball to have a lower trajectory than desired. Increasing the moment of inertia about the CG x-axis (Ixx) reduces upward and downward twisting of the golf club head 2, reducing the negative effects of high and low mis-hits.

Discretionary Mass

Desired club head mass moments of inertia, club head center-of-gravity locations, and other mass properties of a golf club head can be attained by distributing club head mass to particular locations. Discretionary mass generally refers to the mass of material that can be removed from various structures providing mass that can be distributed elsewhere for tuning one or more mass moments of inertia and/or locating the club head center-of-gravity.

Club head walls provide one source of discretionary mass. In other words, a reduction in wall thickness reduces the wall mass and provides mass that can be distributed elsewhere. For example, in some implementations, one or more walls of the club head can have a thickness (constant or average) less than approximately 0.7 mm, such as between about 0.55 mm and about 0.65 mm. In some embodiments, the crown 12 can have a thickness (constant or average) of approximately 0.60 mm or approximately 0.65 mm throughout more than about 70% of the crown, with the remaining portion of the crown 12 having a thickness (constant or average) of approximately 0.76 mm or approximately 0.80 mm. See for example FIG. 9, which illustrates a back crown thickness 905 of about 0.60 mm and a front crown thickness 901 of about 0.76 mm. In addition, the skirt 16 can have a similar thickness and the wall of the sole 14 can have a thickness of between approximately 0.6 mm and approximately 2.0 mm. In contrast, many conventional club heads have crown wall thicknesses in excess of about 0.75 mm, and some in excess of about 0.85 mm.

Thin walls, particularly a thin crown 12, provide significant discretionary mass compared to conventional club heads. For example, a club head 2 made from an alloy of steel can achieve about 4 grams of discretionary mass for each 0.1 mm reduction in average crown thickness. Similarly, a club head 2 made from an alloy of titanium can achieve about 2.5 grams of discretionary mass for each 0.1 mm reduction in average crown thickness. Discretionary mass achieved using a thin crown 12, e.g., less than about 0.65 mm, can be used to tune one or more mass moments of inertia and/or center-of-gravity location.

To achieve a thin wall on the club head body 10, such as a thin crown 12, a club head body 10 can be formed from an alloy of steel or an alloy of titanium. Thin wall investment casting, such as gravity casting in air for alloys of steel and centrifugal casting in a vacuum chamber for alloys of titanium, provides one method of manufacturing a club head body with one or more thin walls.

Weights and Weight Ports

Various approaches can be used for positioning discretionary mass within a golf club head 2. For example, many club heads 2 have integral sole weight pads cast into the head 2 at predetermined locations that can be used to lower, to move forward, to move rearward, or otherwise to adjust the location of the club head's center-of-gravity. Also, epoxy can be added to the interior of the club head 2 through the club head's hosel opening to obtain a desired weight distribution. Alternatively, weights formed of high-density materials can be attached to the sole, skirt, and other parts of a club head. With such methods of distributing the discretionary mass, installation is critical because the club head endures significant loads during impact with a golf ball that can dislodge the weight. Accordingly, such weights are usually permanently attached to the club head and are limited to a fixed total mass, which of course, permanently fixes the club head's center-of-gravity and moments of inertia.

Figure 27:
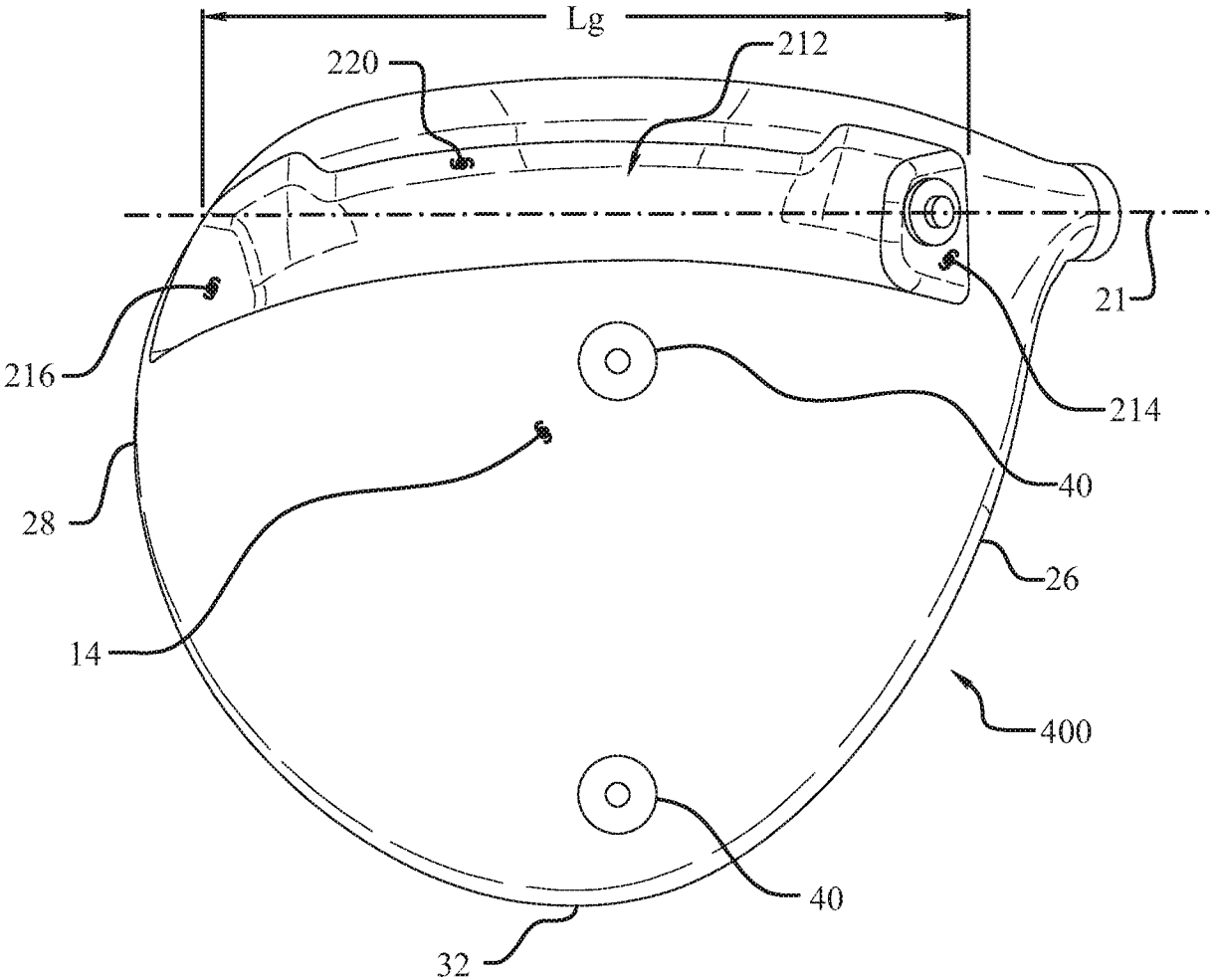
FIG. 27 is a bottom plan view of one embodiment of a golf club head.
Figure 28:
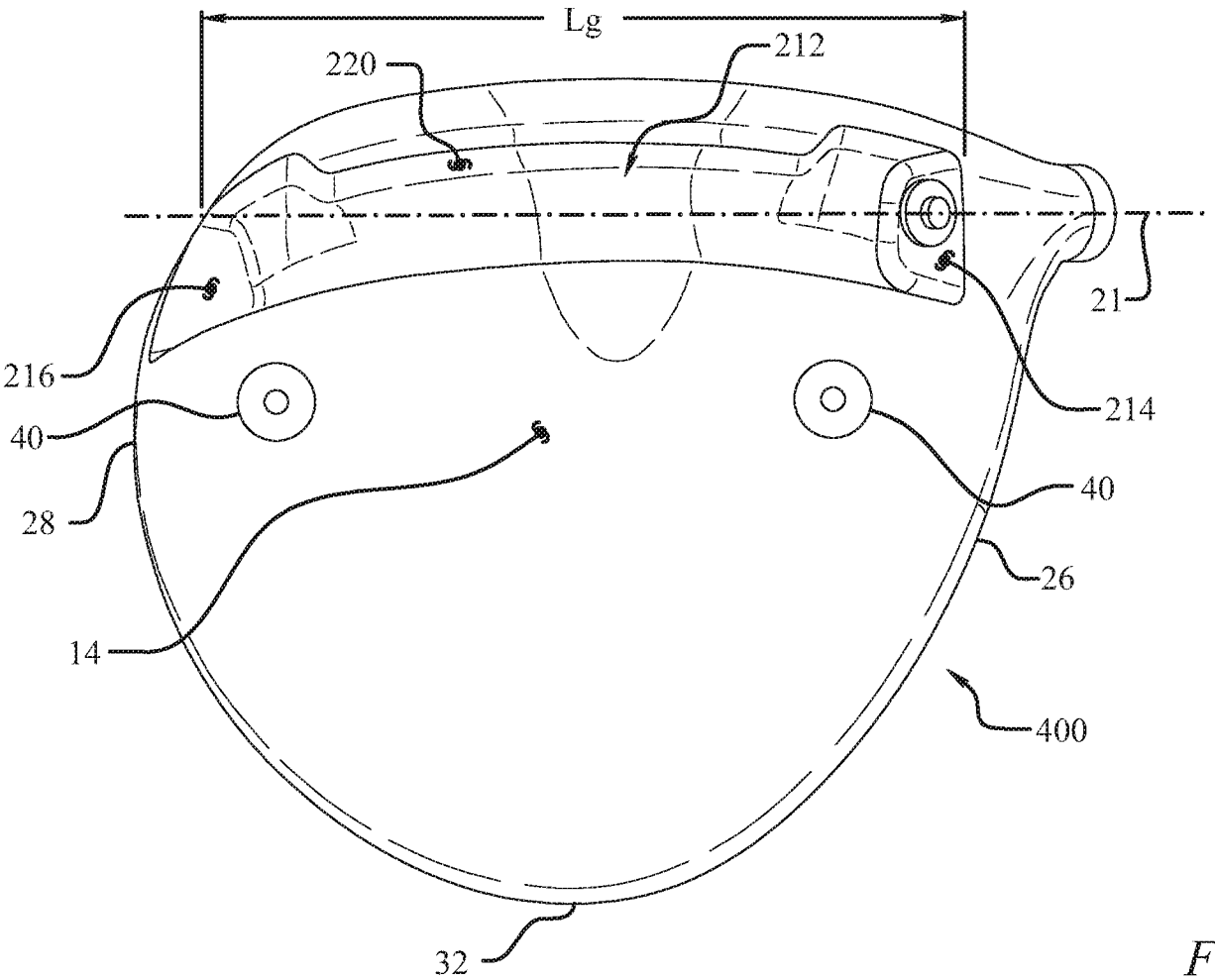
FIG. 28 is a bottom plan view of one embodiment of a golf club head.

Alternatively, as seen in FIGS. 27-28 the golf club head 2 can define one or more weight ports 40 formed in the body 10 that are configured to receive one or more weights. For example, one or more weight ports 40 can be disposed in the crown 12, skirt 16 and/or sole 14. The weight port 40 can have any of a number of various configurations to receive and retain any of a number of weights or weight assemblies, such as described in U.S. Pat. Nos. 7,407,447 and 7,419,441, which are incorporated herein by reference. For example, the weight port 40 may provide the capability of a weight to be removably engageable with the sole 14. In some embodiments, a single weight port 40 and engageable weight is provided, while in others, a plurality of weight ports 40 (e.g., two, three, four, or more) and engageable weights are provided. In one embodiment the weight port 40 defines internal threads that correspond to external threads formed on the weight. Weights and/or weight assemblies configured for weight ports in the sole can vary in mass from about 0.5 grams to about 20 grams.

Inclusion of one or more weights in the weight port(s) 40 provides a customizable club head mass distribution, and corresponding mass moments of inertia and center-of-gravity 50 locations. Adjusting the location of the weight port(s) 40 and the mass of the weights and/or weight assemblies provides various possible locations of center-of-gravity 50 and various possible mass moments of inertia using the same club head 2.

As discussed in more detail below, in some embodiments, a playable fairway wood club head can have a low, rearward center-of-gravity. Placing one or more weight ports 40 and weights rearward in the sole helps desirably locate the center-of-gravity. In the foregoing embodiments, a center of gravity of the weight is preferably located rearward of a midline of the golf club head along the y-axis 75, such as, for example, within about 40 mm of the rear portion 32 of the club head, or within about 30 mm of the rear portion 32 of the club head, or within about 20 mm of the rear portion of the club head. In other embodiments a playable fairway wood club head can have a center-of-gravity that is located to provide a preferable center-of-gravity projection on the striking surface 22 of the club head. In those embodiments, one or more weight ports 40 and weights are placed in the sole portion 14 forward of a midline of the golf club head along the y-axis 75. For example, in some embodiments, a center of gravity of one or more weights placed in the sole portion 14 of the club head is located within about 30 mm of the nearest portion of the forward edge of the sole, such as within about 20 mm of the nearest portion of the forward edge of the sole, or within about 15 mm of the nearest portion of the forward edge of the sole, or within about 10 mm of the nearest portion of the forward edge of the sole. Although other methods (e.g., using internal weights attached using epoxy or hot-melt glue) of adjusting the center-of-gravity can be used, use of a weight port and/or integrally molding a discretionary weight into the body 10 of the club head reduces undesirable effects on the audible tone emitted during impact with a golf ball.

Club Head Height and Length

In addition to redistributing mass within a particular club head envelope as discussed immediately above, the club head center-of-gravity location 50 can also be tuned by modifying the club head external envelope. Referring now to FIG. 8, the club head 2 has a maximum club head height Hch defined as the maximum above ground z-axis coordinate of the outer surface of the crown 12. Similarly, a maximum club head width Wch can be defined as the distance between the maximum extents of the heel and toe portions 26, 28 of the body measured along an axis parallel to the x-axis when the club head 2 is at normal address position and a maximum club head depth Dch, or length, defined as the distance between the forwardmost and rearwardmost points on the surface of the body 10 measured along an axis parallel to the y-axis when the club head 2 is at normal address position. Generally, the height and width of club head 2 should be measured according to the USGA "Procedure for Measuring the Clubhead Size of Wood Clubs" Revision 1.0. The heel portion 28 of the club head 2 is broadly defined as the portion of the club head 2 from a vertical plane passing through the origin y-axis 75 toward the hosel 20, while the toe portion 26 is that portion of the club head 2 on the opposite side of the vertical plane passing through the origin y-axis 75.

In some fairway wood embodiments, the golf club head 2 has a height Hch less than approximately 55 mm. In some embodiments, the club head 2 has a height Hch less than about 50 mm. For example, some implementations of the golf club head 2 have a height Hch less than about 45 mm. In other implementations, the golf club head 2 has a height Hch less than about 42 mm. Still other implementations of the golf club head 2 have a height Hch less than about 40 mm. Further, some examples of the golf club head 2 have a depth Dch greater than approximately 75 mm. In some embodiments, the club head 2 has a depth Dch greater than about 85 mm. For example, some implementations of the golf club head 2 have a depth Dch greater than about 95 mm. In other implementations, as discussed in more detail below, the golf club head 2 can have a depth Dch greater than about 100 mm.

Forgiveness of Club Heads

Golf club head "forgiveness" generally describes the ability of a club head to deliver a desirable golf ball trajectory despite a mis-hit (e.g., a ball struck at a location on the striking face 18 other than the ideal impact location 23). As described above, large mass moments of inertia contribute to the overall forgiveness of a golf club head. In addition, a low center-of-gravity improves forgiveness for golf club heads used to strike a ball from the turf by giving a higher launch angle and a lower spin trajectory. Providing a rearward center-of-gravity reduces the likelihood of a slice or fade for many golfers. Accordingly, forgiveness of club heads, such as the club head 2, can be improved using the techniques described above to achieve high moments of inertia and low center-of-gravity compared to conventional fairway wood golf club heads.

For example, a club head 2 with a crown thickness less than about 0.65 mm throughout at least about 70% of the crown can provide significant discretionary mass. A 0.60 mm thick crown can provide as much as about 8 grams of discretionary mass compared to a 0.80 mm thick crown. The large discretionary mass can be distributed to improve the mass moments of inertia and desirably locate the club head center-of-gravity. Generally, discretionary mass should be located sole-ward rather than crown-ward to maintain a low center-of-gravity, forward rather than rearward to maintain a forwardly positioned center of gravity, and rearward rather than forward to maintain a rearwardly positioned center-of-gravity. In addition, discretionary mass should be located far from the center-of-gravity and near the perimeter of the club head to maintain high mass moments of inertia.

For example, in some of the embodiments described herein, a comparatively forgiving golf club head 2 for a fairway wood can combine an overall club head height (Hch) of less than about 46 mm and an above ground center-of-gravity location, Zup, less than about 19 mm. Some examples of the club head 2 provide an above ground center-of-gravity location, Zup, less than about 16 mm. In additional fairway wood embodiments, a thin crown 12 as described above provides sufficient discretionary mass to allow the club head 2 to have a volume less than about 240 $cm^3$ and/or a front to back depth (DCH) greater than about 85 mm. Without a thin crown 12, a similarly sized golf club head would either be overweight or would have an undesirably located center-of-gravity because less discretionary mass would be available to tune the CG location. In addition, in some embodiments of a comparatively forgiving golf club head 2, discretionary mass can be distributed to provide a mass moment of inertia about the CG z-axis 85, Izz, greater than about 300 kg-$mm^2$. In some instances, the mass moment of inertia about the CG z-axis 85, Izz, can be greater than about 320 kg-mm$^2$, such as greater than about 340 kg-mm$^2$ or greater than about 360 kg-mm$^2$. Distribution of the discretionary mass can also provide a mass moment of inertia about the CG x-axis 90, Ixx, greater than about 150 kg-mm$^2$. In some instances, the mass moment of inertia about the CG x-axis 85, Ixx, can be greater than about 170 kg-mm$^2$, such as greater than about 190 kg-mm$^2$.

Alternatively, some examples of a forgiving club head 2 combine an above ground center-of-gravity location, Zup, less than about 19 mm and a high moment of inertia about the CG z-axis 85, Izz. In such club heads, the moment of inertia about the CG z-axis 85, Izz, specified in units of kg-mm$^2$, together with the above ground center-of-gravity location, Zup, specified in units of millimeters (mm), can satisfy the relationship $$Izz \geq 13 \cdot Zup + 105.$$

Alternatively, some forgiving fairway wood club heads have a moment of inertia about the CG z-axis 85, Izz, and a moment of inertia about the CG x-axis 90, Ixx, specified in units of kg-mm$^2$, together with an above ground center-of-gravity location, Zup, specified in units of millimeters, that satisfy the relationship $$Ixx + Izz \geq 20 \cdot Zup + 165.$$

As another alternative, a forgiving fairway wood club head can have a moment of inertia about the CG x-axis, Ixx, specified in units of kg-mm$^2$, and, an above ground center-of-gravity location, Zup, specified in units of millimeters, that together satisfy the relationship $$Ixx \geq 7 \cdot Zup + 60.$$

Coefficient of Restitution, Characteristic Time, and Center of Gravity Projection Another parameter that contributes to the forgiveness and successful playability and desirable performance of a golf club 2 is the coefficient of restitution (COR) and Characteristic Time (CT) of the golf club head 2. Upon impact with a golf ball, the club head's face 18 deflects and rebounds, thereby imparting energy to the struck golf ball. The club head's coefficient of restitution (COR) is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. In order to maximize the moment of inertia (MOI) about the center of gravity (CG) and achieve a high COR, it typically is desirable to incorporate thin walls and a thin face plate into the design of the club head. Thin walls afford the designers additional leeway in distributing club head mass to achieve desired mass distribution, and a thinner face plate may provide for a relatively higher COR.

Thus, selective use of thin walls is important to a club's performance. However, overly thin walls can adversely affect the club head's durability. Problems also arise from stresses distributed across the club head upon impact with the golf ball, particularly at junctions of club head components, such as the junction of the face plate with other club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the club head. Thus, these club heads fail to provide optimal MOI, CG, and/or COR parameters, and as a result, fail to provide much forgiveness for off-center hits for all but the most expert golfers.

In addition to the thickness of the face plate and the walls of the golf club head, the location of the center of gravity also has a significant effect on the COR of a golf club head. For example, a given golf club head having a given CG will have a projected center of gravity or "balance point" or "CG projection" that is determined by an imaginary line passing through the CG and oriented normal to the striking face 18. The location where the imaginary line intersects the striking face 18 is the CG projection, which is typically expressed as a distance above or below the center of the striking face 18. When the CG projection is well above the center of the face, impact efficiency, which is measured by COR, is not maximized. It has been discovered that a fairway wood with a relatively lower CG projection or a CG projection located at or near the ideal impact location on the striking surface of the club face, as described more fully below, improves the impact efficiency of the golf club head as well as initial ball speed. One important ball launch parameter, namely ball spin, is also improved.

The CG projection above centerface of a golf club head can be measured directly, or it can be calculated from several measurable properties of the club head.

Fairway wood shots typically involve impacts that occur below the center of the face, so ball speed and launch parameters are often less than ideal. This results because most fairway wood shots are from the ground and not from a tee, and most golfers have a tendency to hit their fairway wood ground shots low on the face of the club head. Maximum ball speed is typically achieved when the ball is struck at the location on the striking face where the COR is greatest.

For traditionally designed fairway woods, the location where the COR is greatest is the same as the location of the CG projection on the striking surface. This location, however, is generally higher on the striking surface than the below center location of typical ball impacts during play. In contrast to these conventional golf clubs, it has been discovered that greater shot distance is achieved by configuring the club head to have a CG projection that is located near to the center of the striking surface of the golf club head. In some embodiments, the golf club head 2 has a CG projection that is less than about 2.0 mm from the center of the striking surface of the golf club head, i.e., $-2.0$ mm<CG projection <2.0 mm. For example, some implementations of the golf club head 2 have a CG projection that is less than about 1.0 mm from the center of the striking face of the golf club head (i.e., $-1.0$ mm<CG projection <1.0 mm), such as about 0.7 mm or less from the center of the striking surface of the golf club head (i.e., $-0.7$ mm≤CG projection ≤0.7 mm), or such as about 0.5 mm or less from the center of the striking surface of the golf club head (i.e., $-0.5$ mm≤CG projection ≤0.5 mm). In other embodiments, the golf club head 2 has a CG projection that is less than about 2.0 mm (i.e., the CG projection is below about 2.0 mm above the center of the striking face), such as less than about 1.0 mm (i.e., the CG projection is below about 1.0 mm above the center of the striking face), or less than about 0.0 mm (i.e., the CG projection is below the center of the striking face), or less than about $-1.0$ mm (i.e., the CG projection is below about 1.0 mm below the center of the striking face). In each of these embodiments, the CG projection is located above the bottom of the striking face.

In still other embodiments, an optimal location of the CG projection is related to the loft 15 of the golf club head. For example, in some embodiments, the golf club head 2 has a CG projection of about 3 mm or less above the center of the striking face for club heads where the loft angle is at least 15.8 degrees. Similarly, greater shot distance is achieved if the CG projection is about 1.4 mm or less above the center of the striking face for club heads where the loft angle is less than 15.8 degrees. In still other embodiments, the golf club head 2 has a CG projection that is below about 3 mm above the center of the striking face for club heads where the loft angle 15 is more than about 16.2 degrees, and has a CG projection that is below about 2.0 mm above the center of the striking face for club heads where the loft angle 15 is 16.2 degrees or less. In still other embodiments, the golf club head 2 has a CG projection that is below about 3 mm above the center of the striking face for golf club heads where the loft angle 15 is more than about 16.2 degrees, and has a CG projection that is below about 1.0 mm above the center of the striking face for club heads where the loft angle 15 is 16.2 degrees or less. In still other embodiments, the golf club head 2 has a CG projection that is below about 3 mm above the center of the striking face for golf club heads where the loft angle 15 is more than about 16.2 degrees, and has a CG projection that is below about 1.0 mm above the center of the striking face for club heads where the loft angle 15 is between about 14.5 degrees and about 16.2 degrees. In all of the foregoing embodiments, the CG projection is located above the bottom of the striking face. Further, greater initial ball speeds and lower backspin rates are achieved with the lower CG projections.

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are exemplary sections that are relevant. Specifically, the characteristic time is the time for the velocity to rise from 5% of a maximum velocity to 95% of the maximum velocity under the test set forth by the USGA as described above.

Increased Striking Face Flexibility and Select Tuning

It is known that the coefficient of restitution (COR) of a golf club may be increased by increasing the height Hs, of the striking face 18 and/or by decreasing the thickness of the striking face 18 of a golf club head 2. However, in the case of a fairway wood, hybrid, or rescue golf club, and to a lesser degree even with a driver, increasing the face height may be considered undesirable because doing so will potentially cause an undesirable change to the mass properties of the golf club (e.g., center of gravity location) and to the golf club's appearance.

FIGS. 1-39 show golf club heads that provide increased COR by introducing a flexible channel 212 to increase or enhance the perimeter flexibility of the striking face 18 of the golf club without necessarily increasing the height or decreasing the thickness of the striking face 18. The flexible channel 212 allows for improved performance on mis-hits by increasing the coefficient of restitution (COR) and Characteristic Time (CT) across the face 18 and not just at the center of the face 18, and selectively reducing the amount of spin imparted on a golf ball at impact. The golf club head 2 may include a sole 14 defining a bottom portion of the club head 2, a crown 12 defining a top portion of the club head 2, a skirt portion 16 defining a periphery of the club head 2 between the sole 14 and crown 12, a face 18 defining a forward portion of the club head 2, and a hosel 20 defining a hosel bore 24, thereby defining an interior cavity, or hollow body 10. Some club head 2 embodiments include a flexible channel 212 positioned in the sole 14 of the club head 2 and extending into the interior cavity, or hollow body 10, of the club head 2, and in some embodiments the channel 212 extends substantially in a heel-to-toe direction and has a channel length Lg, a channel width Wg, a channel depth Dg, a channel wall thickness 221, an internal channel structure elevation 224, and a channel setback distance 223 from a leading edge of the club head 2.

Figure 4:
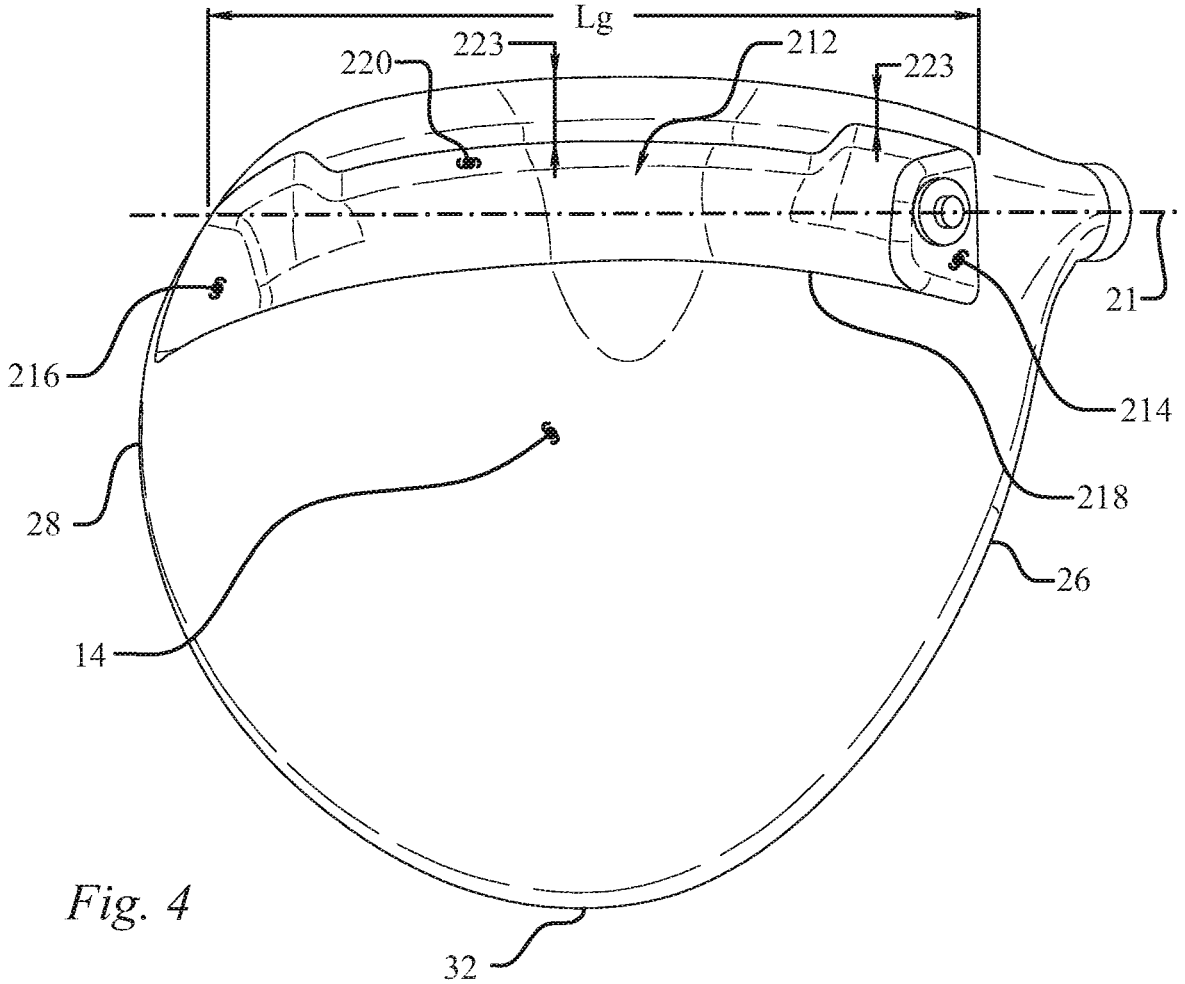
FIG. 4 is a bottom plan view of one embodiment of a golf club head.
Figure 5:
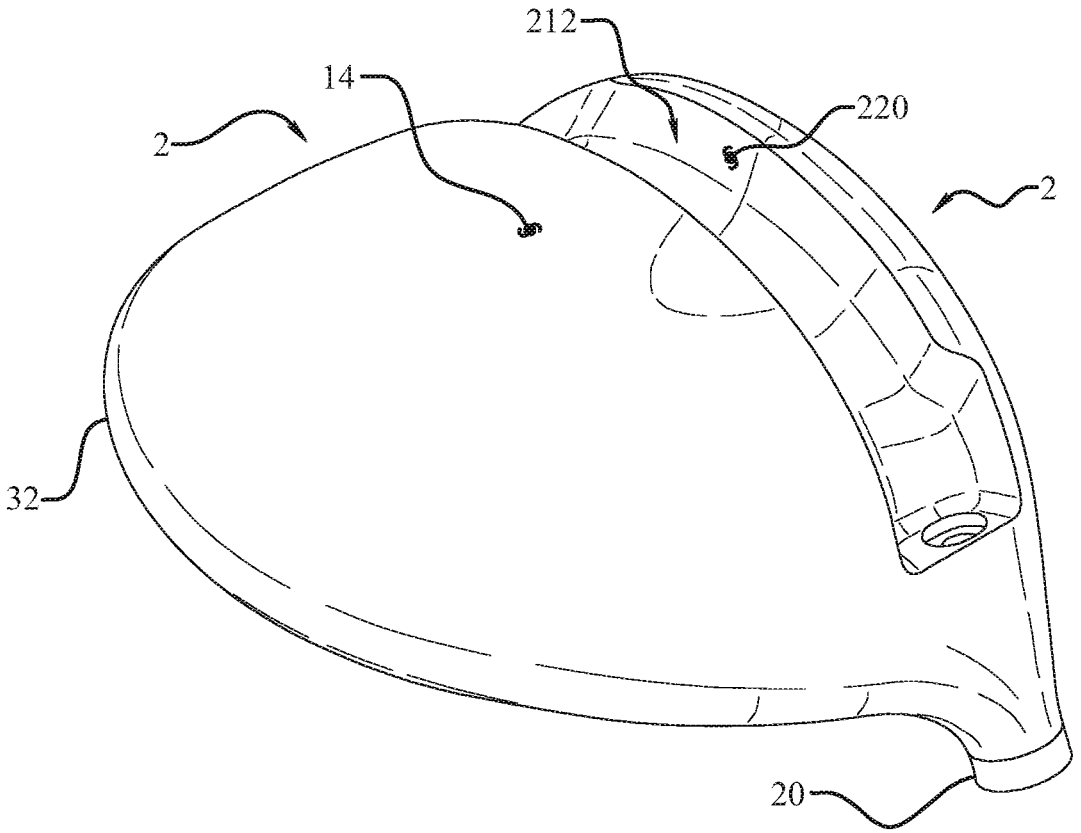
FIG. 5 is a bottom perspective view of one embodiment of a golf club head.

One skilled in the art will appreciate that the leading edge is the forwardmost portion of the club head 2 in a particular vertical section that extends in a face-to-rear direction through the width of the striking face Wss, and the leading edge varies across the width of the striking face Wss. Further, as seen in FIG. 4, the channel setback distance 223 may vary across the width of the striking face Wss, although some embodiments may have a constant channel setback distance 223. Thus the club head 2 will have a maximum channel setback distance 223, which in the embodiment of FIG. 4 occurs near the center of the face 18, and a minimum channel setback distance 223, which occurs toward the heel 26 or toe 28 of the club head 2 in the embodiment of FIG. 4, although other embodiments may have a constant channel setback distance 223 in which case the maximum and minimum will be equal. One particular embodiment experiences preferential face flexibility, while maintaining sufficient durability, when the minimum channel setback distance 223 is less than the maximum channel width Wg, while an even further embodiment has a minimum channel setback distance 223 is less than 75% of the maximum channel width Wg, and an even further embodiment has a minimum channel setback distance 223 is 25-75% of the maximum channel width Wg. In another embodiment the minimum channel setback distance 223 is less than 15 mm, while in a further embodiment the minimum channel setback distance 223 is less than 10 mm, while in an even further embodiment the minimum channel setback distance 223 is 3-8 mm. In another embodiment the maximum channel setback distance 223 is less than 30 mm, while in a further embodiment the maximum channel setback distance 223 is less than 20 mm.

While preferential face flexibility and durability may be enhanced as the size of the channel 212 increases, along with the unique relationships disclosed herein, thereby reducing the stresses in the channel 212, increasing the size of the channel 212, particularly the channel depth Dg and channel width Wg, may produce less than desirable sound and vibration upon impact with a golf ball. Additional embodiments further improve the performance via a center-of-gravity CG that is low and forward in conjunction with the channel 212, as well as aerodynamic embodiments having a particularly bulbous crown 12 which may include irregular contours and very thin areas, any of which may further heighten these less than desirable characteristics. Such undesirable attributes associated with the channel 212, particularly a large channel 212, and/or a low and forward CG position, and/or a bulbous aerodynamic crown, may be mitigated with the introduction of a channel tuning system 1100, such as the embodiments seen in FIGS. 11-22, and/or a body tuning system 1400, as seen in FIG. 9. The channel depth Dg is easily measure by filling the channel 212 with clay until the club head 2 has a smooth continuous exterior surface as if the channel 212 does not exist. A blade oriented in the front-to-back direction may then be inserted vertically to section the clay. The clay may then be removed and the vertical thickness measure to reveal the channel depth Dg at any point along the length of the channel 212.

Referring again go FIGS. 11-22, the channel tuning system 1100 may include a longitudinal channel tuning element 1200 and/or a sole engaging channel tuning element 1300. The longitudinal channel running element 1200 is in contact with the channel 212 and the sole engaging channel tuning element 1300 is in contact with the channel 212; which in one embodiment means that they are integrally cast with the channel 212, while in another embodiment they are attached to the channel 212 via available joining methods including welding, brazing, and adhesive attachment. The longitudinal channel tuning element 1200 extends along a portion of the length of the channel 212, and in one embodiment it extends substantially in a heel-to-toe direction, which may be a linear fashion, a zig-zag or sawtooth type fashion, or a curved fashion. As seen best in FIGS. 10, 11, and 29, the longitudinal channel tuning element 1200 has a longitudinal tuning element toe end 1210, a longitudinal element heel end 1220, a longitudinal tuning element length 1230, a longitudinal tuning element height 1240, a longitudinal tuning element width 1250, a top edge elevation 1260, and a lower edge elevation 1270.

Figure 11:
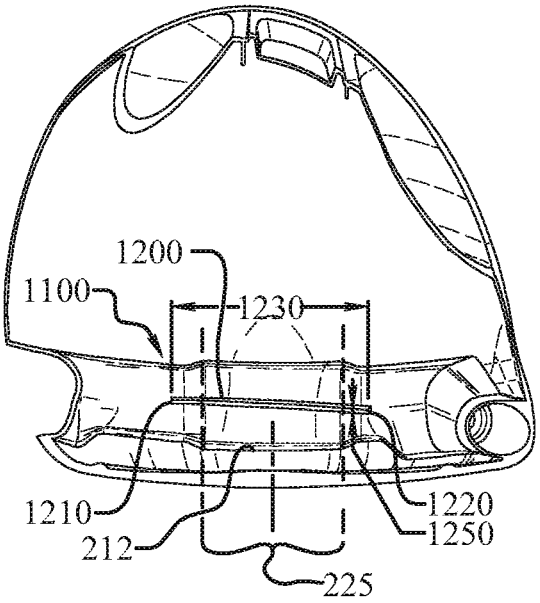
FIG. 11 is a cross-sectional view of one embodiment of a golf club head.

As seen in FIG. 11, in one embodiment the aforementioned undesirable attributes associated with the club head 2 are reduced when the longitudinal tuning element length 1230 is greater than the maximum channel width Wg, and in another embodiment when the longitudinal tuning element length 1230 is greater than 50% of the channel length Lg, while in an even further embodiment the longitudinal tuning element length 1230 is greater than 75% of the channel length Lg. The longitudinal tuning element length 1230 is measured in a straight line along the ground plane from a vertical projection of the longitudinal tuning element toe end 1210 on the ground plane to a vertical projection of the longitudinal element heel end 1220 on the ground plane, which is the same manner the channel length Lg is measured.

Figure 29:
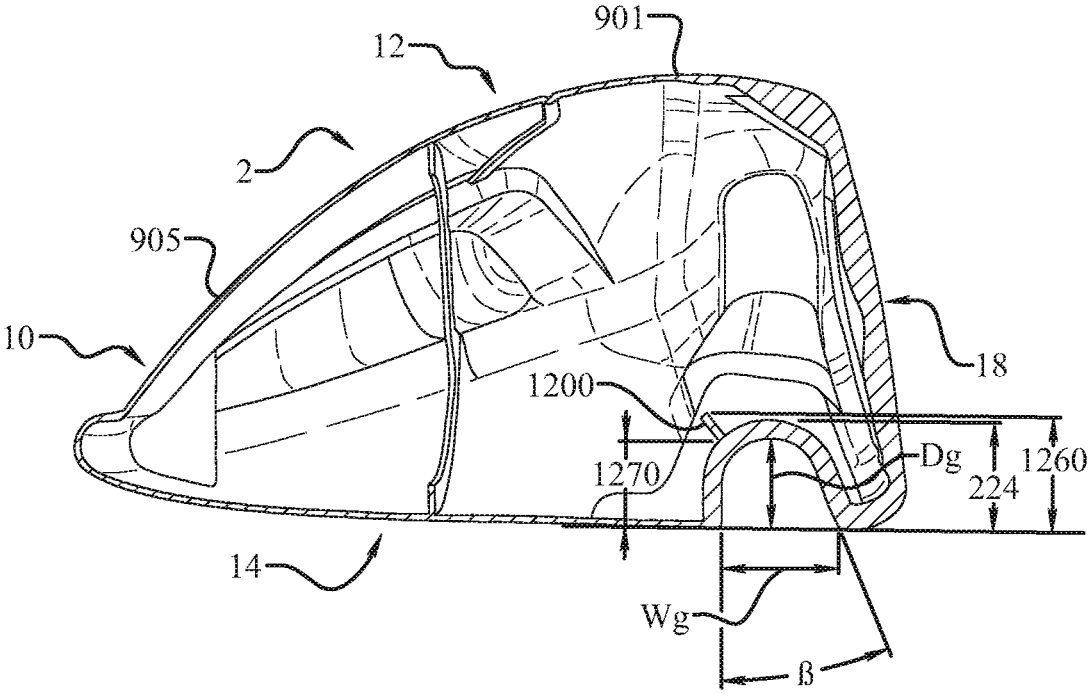
FIG. 29 is a cross-sectional view of one embodiment of a golf club head.

In another embodiment tuning of the club head 2 is further improved when, in at least one front-to-rear vertical section passing through the longitudinal channel tuning element 1200, a portion of the longitudinal tuning element top edge elevation 1260 is greater than the internal channel structure elevation 224, as seen in FIG. 29. As with all the disclosed embodiments, these unique embodiments and relationships among the channel 212, the attributes of the channel tuning system 1100, the aerodynamic crown, thicknesses, and the club head mass properties selectively mitigate the undesirable characteristics without unduly reducing the performance advantages associated with the channel 212, aerodynamic and mass property features, or sacrificing the durability of the club head 2. Unique placement of the longitudinal tuning element top edge elevation 224 aids in tuning the channel 212 to achieve desirable sound and vibration upon the impact of the club head 2 with a golf ball while not significantly impacting the flexibility of the channel 212 or durability of the club head 2.

In a further embodiment, in at least one front-to-rear vertical section passing through the longitudinal channel tuning element 1200, a portion of the longitudinal tuning element top edge elevation 1260 is at least 10% greater than the internal channel structure elevation 224, while in an even further embodiment a portion of the longitudinal tuning element top edge elevation 1260 is than the internal channel structure elevation 224 by a distance that is greater than the maximum channel wall thickness 221. While the prior embodiments are directed to characteristics in at least one front-to-rear vertical section passing through the longitudinal channel tuning element 1200, in further embodiments the relationships are true through at least 25% of the channel length (Lg), and in even further embodiments through at least 50% of the channel length (Lg), and at least 75% in yet another embodiment. Another embodiment, seen in FIG. 33, has a portion of the longitudinal tuning element top edge elevation 1260 above the elevation of the ideal impact location 23, while in another embodiment a portion of the longitudinal tuning element top edge elevation 1260 is greater than the Zup value. In an even further embodiment, seen best in FIG. 33, at least a portion of the longitudinal channel tuning element 1200 is in contact with both the channel 212 and the hosel bore 24, further tuning the club head 2 without unduly adding rigidity to the channel 212.

In another embodiment at least a portion of the longitudinal channel tuning element 1200 is positioned along the top edge of the channel 212, as seen in FIG. 10, such as in at least one front-to-rear vertical section passing through the longitudinal channel tuning element 1200 the lower edge elevation 1270 is equal to the internal channel structure elevation 224, seen in FIG. 29. While the prior embodiment is directed to characteristics in at least one front-to-rear vertical section passing through the longitudinal channel tuning element 1200, in further embodiments the relationships are true through at least 25% of the channel length Lg, and in even further embodiments through at least 50% of the channel length Lg, and at least 75% in yet another embodiment. As seen in FIG. 10, at least a portion of the longitudinal channel tuning element 1200 may be oriented substantially vertically from the channel 212, oriented at an angle toward the rear of the club head 2 as seen in FIG. 29, or even at an angle toward the face 18, not shown but easily understood. A substantial vertical orientation reduces the impact that the longitudinal channel tuning element 1200 has on the stiffness of the channel 212, and therefore in another embodiment the orientation is substantially vertical through at least 25% of the channel length Lg, and in even further embodiments through at least 50% of the channel length Lg, and at least 75% in yet another embodiment. Further, the substantial vertical orientation aids in the manufacturability of the club head 2 and reduces the likelihood of adding areas of significantly increased rigidity in the channel 212, and the associated peak stress throughout the channel 212, thereby improving the durability of the club head 2, which is also true for the disclosed sizes of the longitudinal channel tuning element, namely the longitudinal tuning element height 1240, the longitudinal tuning element width 1250, and the longitudinal tuning element length 1230.

Figure 32:
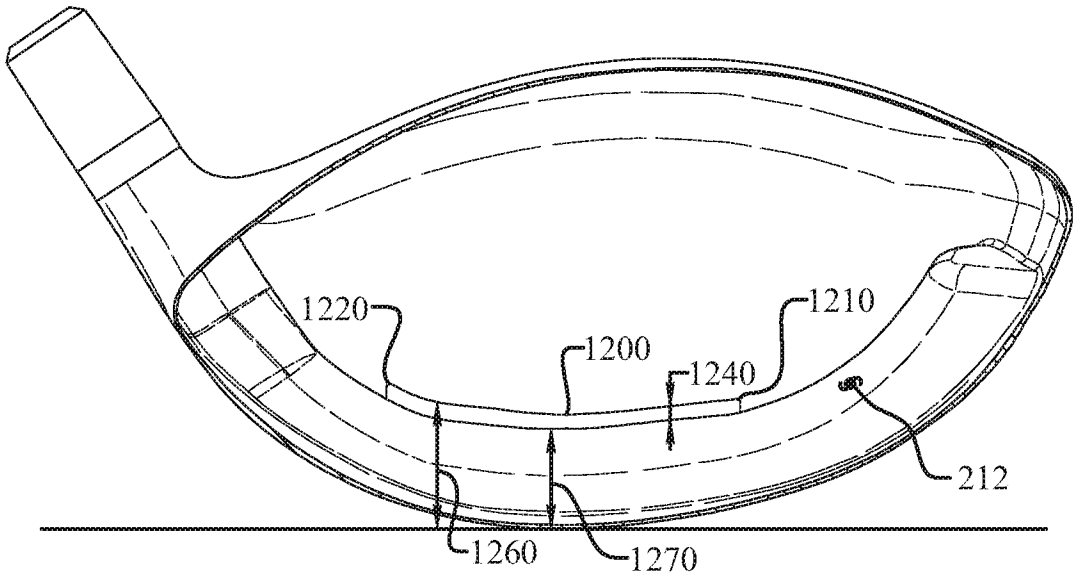
FIG. 32 is a cross-sectional view of one embodiment of a golf club head.

A further embodiment has a longitudinal tuning element height 1240, seen in FIG. 32, is at least 20% of the channel depth Dg in at least one front-to-rear vertical section passing through the longitudinal channel tuning element, while in a further embodiment this relationship is true throughout at least 25% of the channel length Lg, and in even further embodiments through at least 50% of the channel length Lg, and at least 75% in yet another embodiment. A further embodiment balances the aforementioned tradeoff with the longitudinal tuning element height being 20-70% of the channel depth Dg throughout at least 50% of the longitudinal tuning element length 1230.

As with the length 1230 and height 1240, the longitudinal tuning element width 1250, seen in FIG. 10, plays a role in balancing the benefits and negative effects of the longitudinal channel tuning element 1200. In one embodiment at least a portion of the longitudinal channel tuning element 1200 has a longitudinal tuning element width 1250 of less than the maximum channel wall thickness 221. In a further embodiment the longitudinal tuning element width 1250 is less than the maximum channel wall thickness 221 throughout at least 50% of the longitudinal tuning element length 1230, while in an even further embodiment this is true throughout at least 75% of the longitudinal tuning element length 1230. In an even further embodiment at least a portion of the longitudinal tuning element width 1250 of less than 70% of the maximum channel wall thickness 221. In a further embodiment the longitudinal tuning element width 1250 is less than 70% of the maximum channel wall thickness 221 throughout at least 50% of the longitudinal tuning element length 1230, while in an even further embodiment this is true throughout at least 75% of the longitudinal tuning element length 1230. Yet an even further embodiment has at least a portion of the longitudinal tuning element width 1250 of less than 70% of the maximum channel wall thickness 221. In a further embodiment the longitudinal tuning element width 1250 of 25-60% of the maximum channel wall thickness 221 throughout at least 50% of the longitudinal tuning element length 1230, while in an even further embodiment this is true throughout at least 75% of the longitudinal tuning element length 1230.

Figure 12:
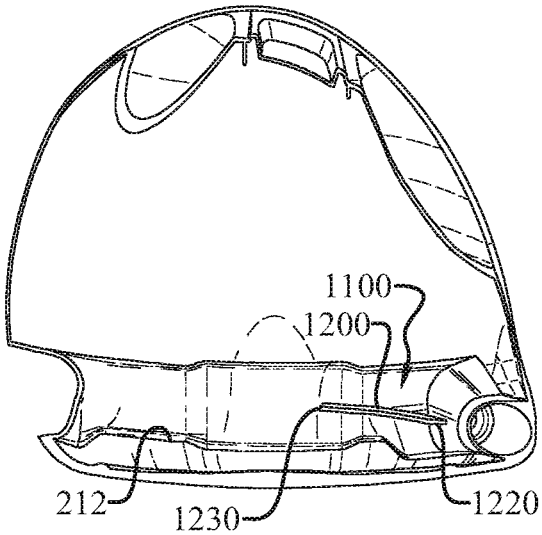
FIG. 12 is a cross-sectional view of one embodiment of a golf club head.
Figure 13:
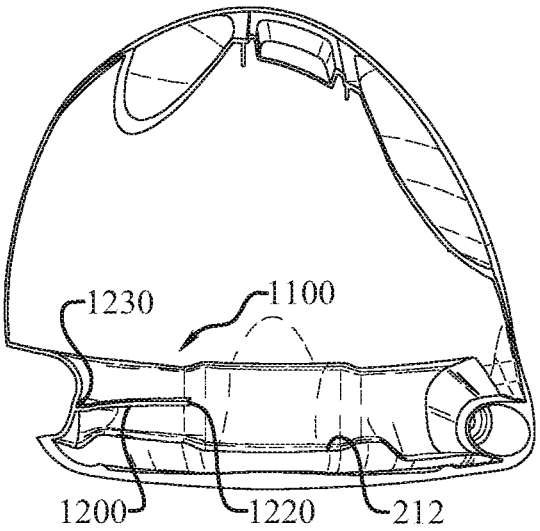
FIG. 13 is a cross-sectional view of one embodiment of a golf club head.
Figure 14:
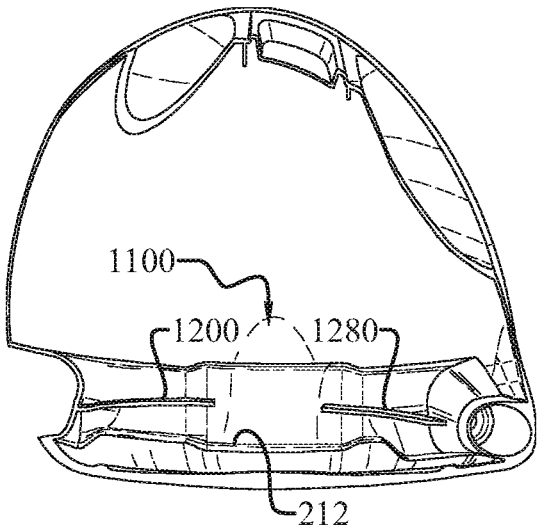
FIG. 14 is a cross-sectional view of one embodiment of a golf club head.
Figure 33:
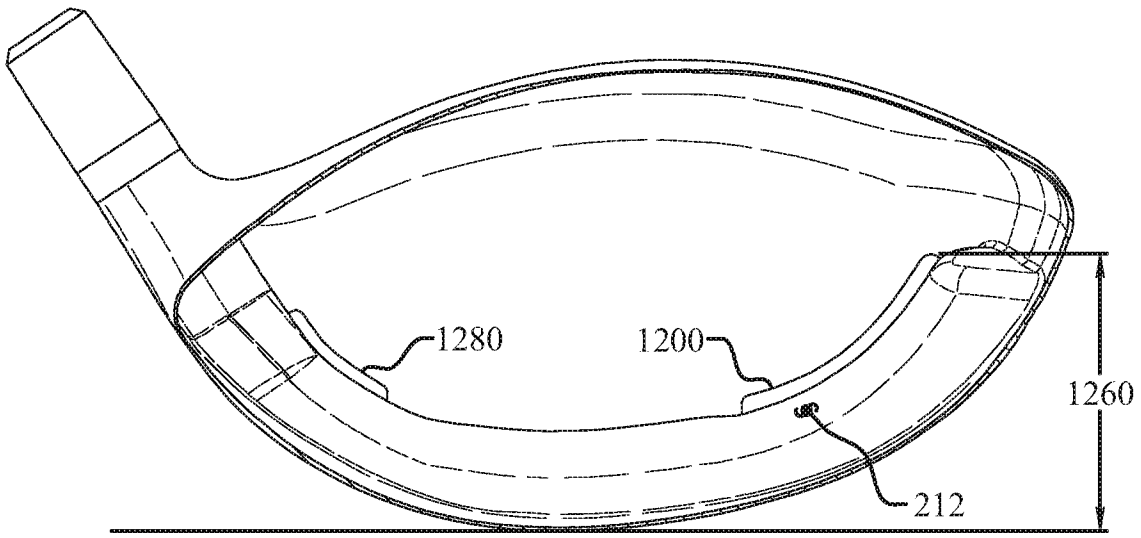
FIG. 33 is a cross-sectional view of one embodiment of a golf club head.

Like the length 1230, height 1240, width 1250, longitudinal tuning element top edge elevation 1260, seen in FIGS. 29 and 32-33, and orientation, the location of the longitudinal channel tuning element 1200 plays a role in balancing the benefits and negative effects. As seen in FIG. 11, in one embodiment the longitudinal channel tuning element 1200 extends throughout a channel central region 225, which in one embodiment is defined as the portion of the channel 212 within ½ inch on either side of the ideal impact location 23. Deflection of the channel 212 in this channel central region 225 is not as important to improving the performance of the club head 2 and therefore is a good location for a longitudinal channel tuning element 1200 to influence the tuning of the club head 2 while having minimal effect on enhanced performance associated with the channel 212, which is also why further embodiments, described elsewhere in detail, have increased channel wall thickness 221 in the channel central region 225. Another embodiment capitalizes on tuning gains afforded by having at least a portion of the longitudinal channel tuning element 1200 is in contact with both the channel 212 and the hosel bore 24, further tuning the club head 2 without unduly adding rigidity to the channel 212, as seen in FIGS. 12 and 33. An alternative embodiment is seen in FIG. 13 whereby the longitudinal channel tuning element 1200 is located on the toe portion of the channel 212. In some embodiment the channel 212 extends high up the skirt portion 16, as seen in FIG. 33, and therefore enables the previously described embodiment in which a portion of the longitudinal tuning element top edge elevation 1260 is above the elevation of the ideal impact location 23, and the embodiment having a portion of the longitudinal tuning element top edge elevation 1260 is greater than the Zup value. A common mishit involves striking the golf ball high on the toe portion of the face and these embodiments achieve preferential tuning so that the pitch and vibrations associated with such mishits is not as significantly different from impacts at the ideal impact location 23 as may be experienced with a club head 2 having a channel 212 without a channel tuning system 1100. This improved consistency in pitch and vibration is also heightened in embodiments having a portion of the longitudinal channel tuning element 1200 joining a heel portion of the channel 212 with a portion of the hosel bore 24, also seen in FIG. 33. Yet another embodiment seen in FIG. 14 has a longitudinal channel tuning element 1200 on the toe side of the channel 212, like the embodiment of FIG. 13, and a second longitudinal channel tuning element 1280 on the heel side of the channel 212, like the embodiment of FIG. 14. Still further embodiments such as those seen in FIGS. 19-22 have a longitudinal channel tuning element 1200 extending continuously from the heel to the toe of the channel 212.

Figure 15:
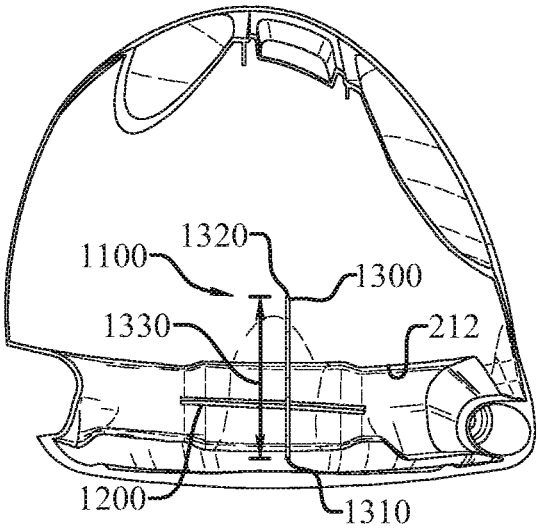
FIG. 15 is a cross-sectional view of one embodiment of a golf club head.

As previously mentioned, the channel tuning system 1100 may further includes a sole engaging channel tuning element 1300 in contact with the sole 14 and the channel 212, seen best in FIGS. 15 and 10, which may be in addition to, or in lieu of, the longitudinal channel tuning element 1200. The sole engaging channel tuning element 1300 has a face end 1310, a rear end 1320, a sole engaging tuning element length 1330, seen in FIG. 15, a sole engaging tuning element height 1340, seen in FIG. 10, a sole engaging tuning element width 1350, seen in FIG. 16, a sole engaging portion 1360 in contact with the sole 14 and having a sole engaging portion length 1362, seen in FIG. 30, and a channel engaging portion 1370 in contact with the channel 212 and having a channel engaging portion length 1372 and a channel engaging portion elevation 1374, also seen in FIG. 30. As with the longitudinal channel tuning element 1200, the unique relationships disclosed strike a delicate balance in reducing the undesirable attributes associated with the channel 212 with preferential tuning, while not significantly compromising the performance and flexibility of the channel 212, as well as the durability of the club head 2.

Figure 16:
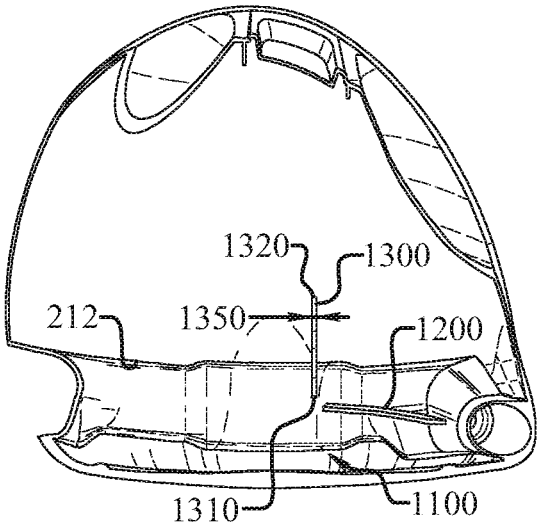
FIG. 16 is a cross-sectional view of one embodiment of a golf club head.
Figure 30:
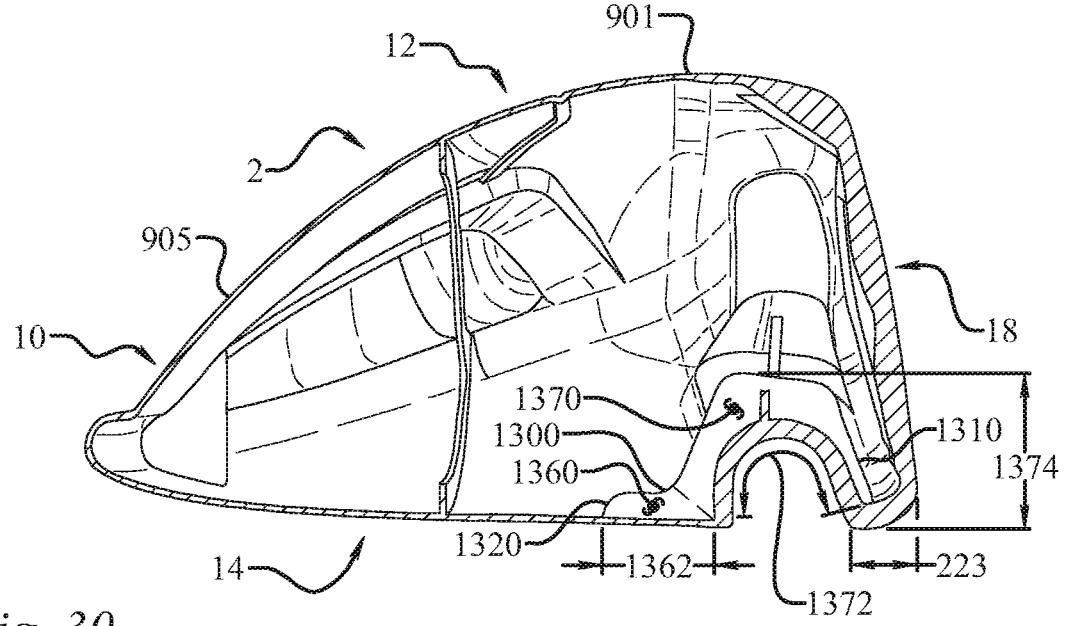
FIG. 30 is a cross-sectional view of one embodiment of a golf club head.
Figure 31:
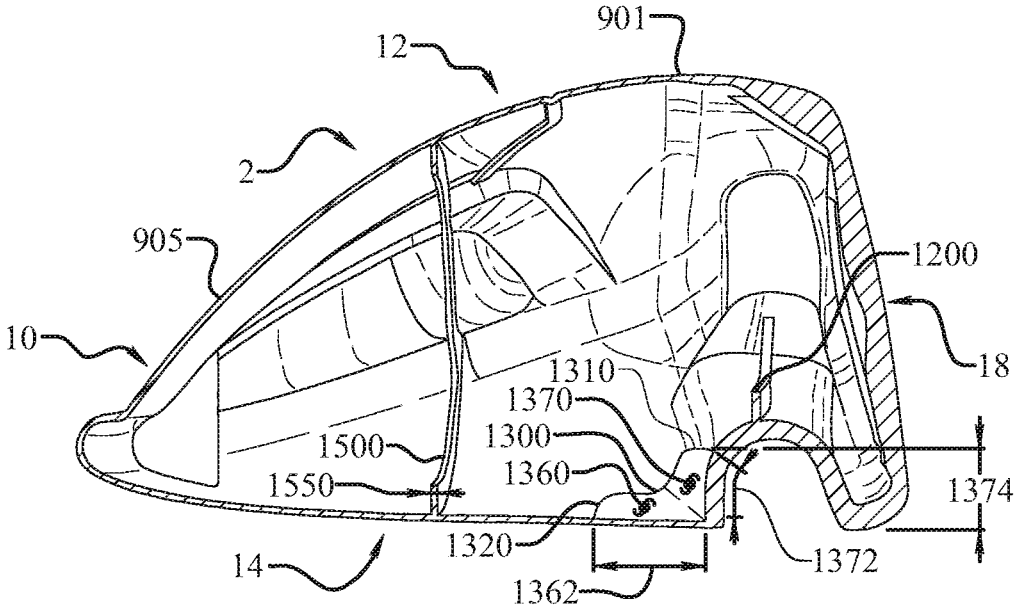
FIG. 31 is a cross-sectional view of one embodiment of a golf club head.

With continued reference to FIG. 30, in one such embodiment the goals are achieved with a sole engaging portion length 1362 is at least 50% of the maximum channel width Wg. A further embodiment achieves the goals when the sole engaging portion 1360 has a sole engaging tuning element height 1340 of at least 15% of the maximum channel depth Dg. Still further, another embodiment, seen in FIG. 31, has a channel engaging portion 1370 that extends up the channel 212 to a channel engaging portion elevation 1374 that is at least 50% of the channel depth Dg in the same vertical plane as the channel engaging portion 1370, while another embodiment has a channel engaging portion 1370 that extends up the channel 212 to a channel engaging portion elevation 1374 that is at least 50-100% of the channel depth Dg in the same vertical plane as the channel engaging portion 1370. In such embodiments the channel engaging portion 1370 does not extend along more than 50% of the channel 212, as also illustrated in FIG. 16, in a face-to-rear vertical section, and serves to tune the club head 2 while also supporting the rear channel wall 218, yet facilitating significant deflection of the channel 212 for improved performance. Still further, another embodiment has a channel engaging portion 1370 that extends up the channel 212 to a channel engaging portion elevation 1374 greater than the internal channel structure elevation 224, as seen in FIG. 30. In fact in some embodiments such as that seen in FIGS. 30, 15, and 18 the channel engaging portion 1370 extends all the way over the channel 212, and in some embodiments engages a portion of the sole 14 between the channel 212 and the face 18, as seen in FIG. 30. In one such entirely over the channel embodiment the channel engaging portion 1370 is located in the channel central region 225 to have a significant influence on the tuning of the club head 2 while having minimal effect on enhanced performance associated with the channel 212 because the slight decrease in potential deflection of the channel 212 in the channel central region 225 is not as impactful on overall club head 2 performance. Likewise, the channel engaging portion length 1372, seen in FIGS. 30-31, and the sole engaging tuning element width 1350, seen in FIG. 16, play a role in achieving the goals without unduly limiting the performance benefits gained through the addition of the channel 212. For example, in one embodiment the channel engaging portion length 1372 is greater than the maximum channel depth Dg. The channel engaging portion length 1372 is measured along the intersection of the channel engaging portion 1370 and the channel 212. In yet another embodiment the channel engaging portion length 1372 is less than the sum of the maximum channel depth Dg and the maximum channel width Wg, further controlling the amount of rigidity that is added to the flexible channel 212. Still further, in another embodiment the sole engaging portion length 1362 is less than 150% of the maximum channel width Wg, thereby further controlling the amount of rigidity that is added to the channel 212. Similarly, in another embodiment the goals are further enhanced when the sole engaging tuning element width 1350 is less than 70% of the maximum channel wall thickness 221, and even further in an embodiment in which the sole engaging tuning element width 1350 is 25-60% of the maximum channel wall thickness 221.

Figure 17:
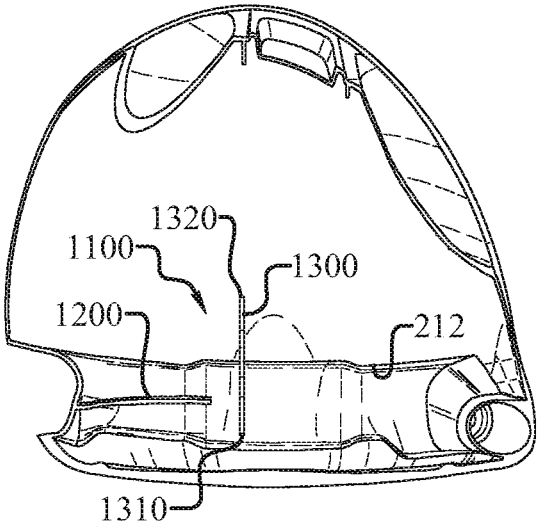
FIG. 17 is a cross-sectional view of one embodiment of a golf club head.
Figure 18:
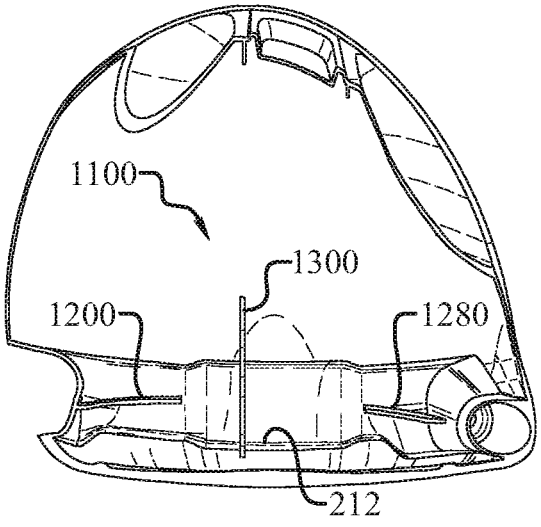
FIG. 18 is a cross-sectional view of one embodiment of a golf club head.
Figure 19:
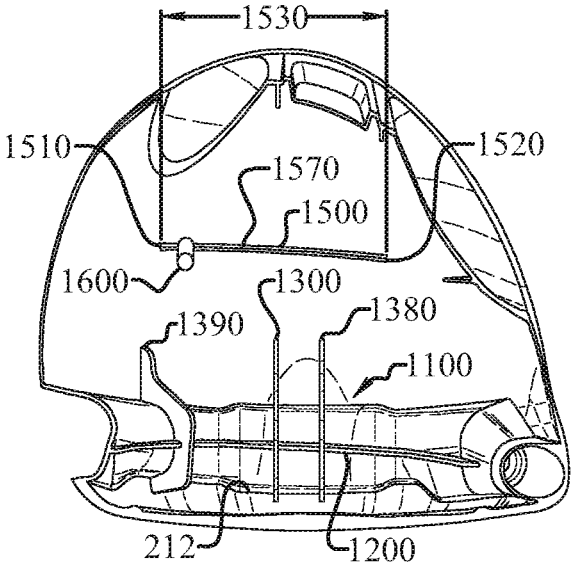
FIG. 19 is a cross-sectional view of one embodiment of a golf club head.
Figure 20:
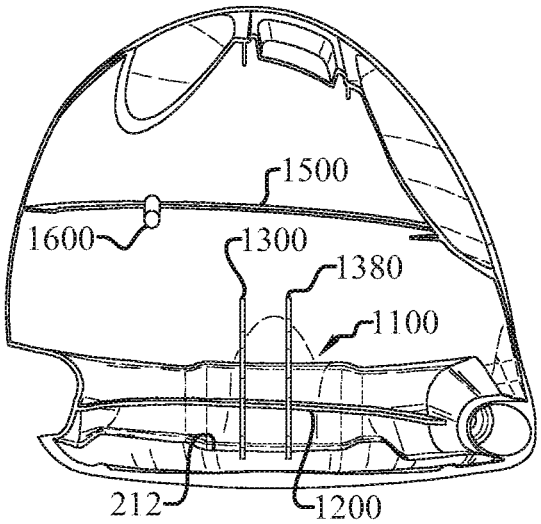
FIG. 20 is a cross-sectional view of one embodiment of a golf club head.
Figure 21:
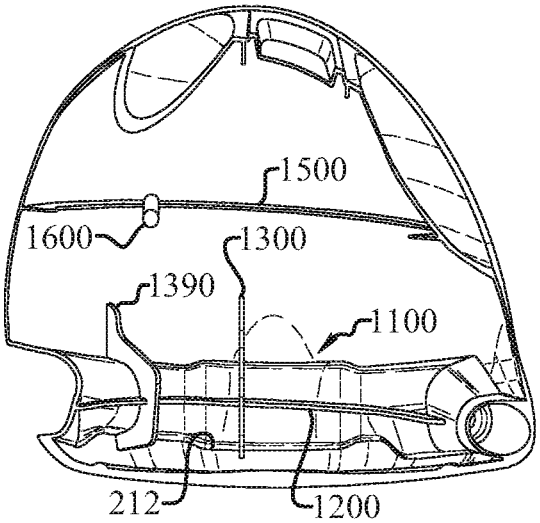
FIG. 21 is a cross-sectional view of one embodiment of a golf club head.
Figure 22:
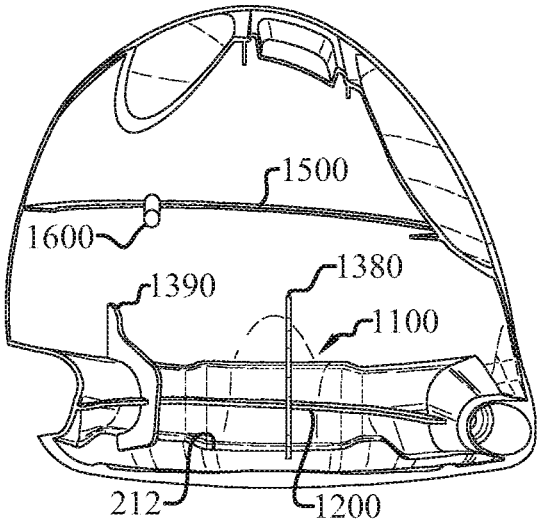
FIG. 22 is a cross-sectional view of one embodiment of a golf club head.

The orientation and location of the sole engaging channel tuning element 1300 also influences the tuning goals. The sole engaging channel tuning element 1300 is preferably oriented in a direction that is plus, or minus, 45 degrees from a vertical face-to-rear plane passing through the ideal impact location 23, as can be easily visualized in FIGS. 15-18, however in a further embodiment the sole engaging channel tuning element 1300 is oriented in a direction that is plus, or minus, 20 degrees from a vertical face-to-rear plane passing through the ideal impact location 23, and in yet another embodiment the sole engaging channel tuning element 1300 extends in a substantially face-to-rear direction. In the embodiment of FIG. 15 the location of the sole engaging channel tuning element 1300 is substantially aligned with a vertical face-to-rear plane passing through the ideal impact location 23, while in another embodiment, seen in FIG. 16, the sole engaging channel tuning element 1300 is located in a heel portion 26 of the club head 2, and in yet another embodiment, seen in FIG. 17, the sole engaging channel tuning element 1300 is located in a toe portion 26 of the club head 2. Each location achieves different tuning levels, and influences the performance of the channel 212 differently. Embodiments having both a longitudinal channel tuning element 1200 and at least one sole engaging channel tuning element 1300 may have the elements exist independently, as seen in FIGS. 16-18, or they may intersect, as seen in FIGS. 15 and 19-22. Some embodiments may incorporate multiple sole engaging channel tuning elements, such as two, namely the sole engaging channel tuning element 1300 and a second sole engaging channel tuning element 1380, as seen in FIG. 20, or even three, namely the sole engaging channel tuning element 1300, the second sole engaging channel tuning element 1380, and a third sole engaging channel tuning element 1390, as seen in FIG. 19. The quantity and location of each achieves different tuning levels, and influence the performance of the channel 212 differently. One particular embodiment has a sole engaging channel tuning element 1300 within the channel central region 225 to provide a degree of tuning in the area that has a low impact on performance, and a second sole engaging channel tuning element 1380 located in a toe portion of the club head 2, outside of the channel central region 2, where the channel thickness 221 and club head thickness is less thereby having a greater impact on the tuning.

Preferably, the overall frequency of the golf club head 2, i.e., the average of the first mode frequencies of the crown, sole and skirt portions of the golf club head, generated upon impact with a golf ball is greater than 3,000 Hz. Frequencies above 3,000 Hz provide a user of the golf club with an enhanced feel and satisfactory auditory feedback, while in some embodiments frequencies above 3,200 Hz are obtained and preferred. However, a golf club head 2 having relatively thin walls, a channel 212, and/or a thin bulbous crown 12, can reduce the first mode vibration frequencies to undesirable levels. The addition of the channel tuning system 1100 described herein can significantly increase the first mode vibration frequencies, thus allowing the first mode frequencies to approach a more desirable level and improving the feel of the golf club 2 to a user. For example, golf club head 2 designs were modeled using commercially available computer aided modeling and meshing software, such as Pro/Engineer by Parametric Technology Corporation for modeling and Hypermesh by Altair Engineering for meshing. The golf club head 2 designs were analyzed using finite element analysis (FEA) software, such as the finite element analysis features available with many commercially available computer aided design and modeling software programs, or stand-alone FEA software, such as the ABAQUS software suite by ABAQUS, Inc. The golf club head 2 design was made of titanium and shaped similar to the club head 2 shown in the figures, except that several iterations were run in which the golf club head 2 had different combinations of the channel tuning system 1100 present or absent. The predicted first or normal mode frequency of the golf club head 2, i.e., the frequency at which the head will oscillate when the golf club head 2 impacts a golf ball, was obtained using FEA software for the various embodiments. A first mode frequency for the club head 2 without any form of a channel tuning system 1100 is below the preferred lower limit of 3000 Hz.

Figure 39:
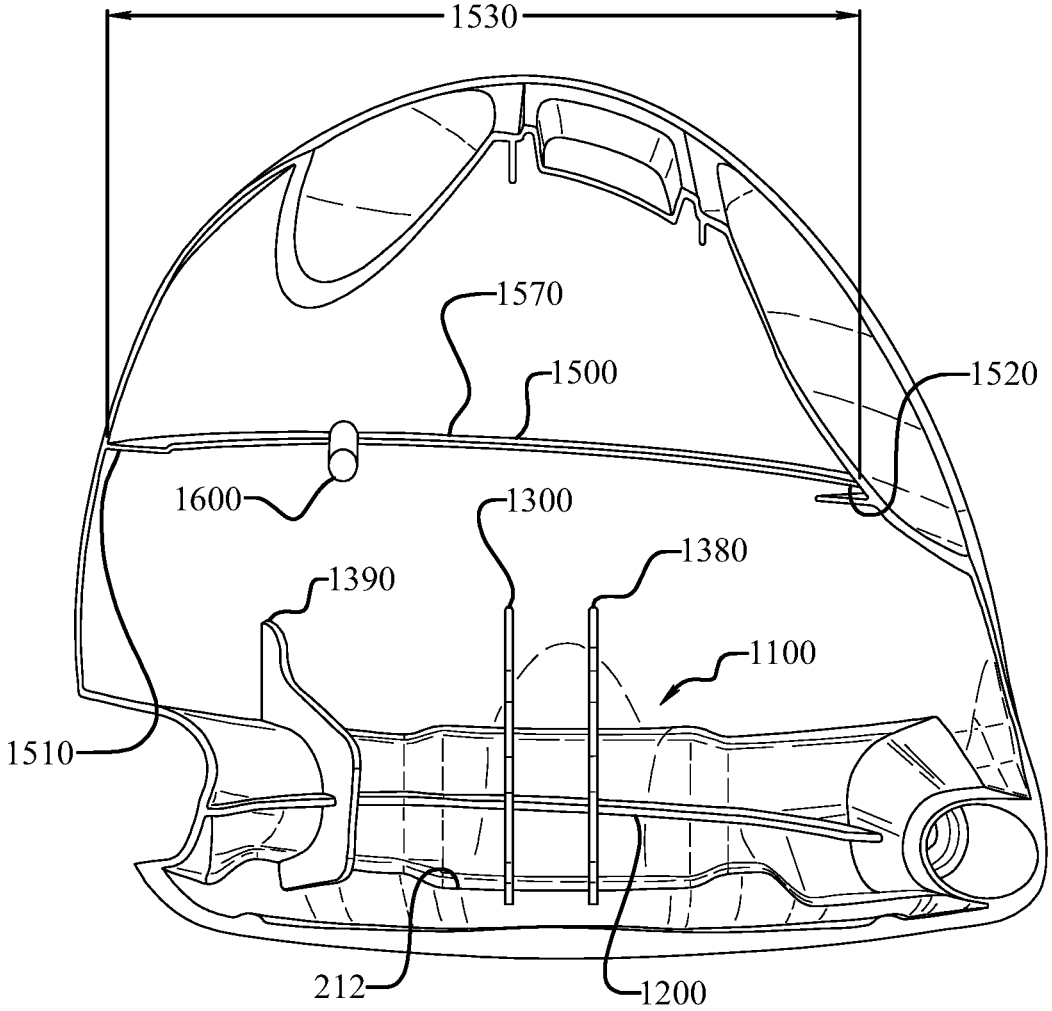
FIG. 39 is a cross-sectional view of one embodiment of a golf club head.

Table 1 below, and reference to FIG. 39, illustrates the significant tuning capabilities associated with the channel tuning system 1100. First, the channel tuning system 1100 includes a longitudinal channel tuning element 1200, a sole engaging channel tuning element 1300, a second sole engaging channel tuning element 1380, and a third sole engaging channel tuning element 1390, the first mode frequency is increased to 3530 Hz and the second mode frequency is increased to 3729 Hz. The next embodiment removes the third sole engaging channel tuning element 1390, leaving the longitudinal channel tuning element 1200, the sole engaging channel tuning element 1300, and the second sole engaging channel tuning element 1380 to produce a club head 2 with a first mode frequency of 3328 Hz and a second mode frequency of 3727 Hz; thus removal of the third sole engaging channel tuning element 1390 located toward the toe resulted in a first mode frequency drop of 202 Hz and a second mode frequency drop of 2 Hz. The next embodiment removes the sole engaging channel tuning element 1300, leaving the longitudinal channel tuning element 1200, the second sole engaging channel tuning element 1380, and the third sole engaging channel tuning element 1390, to produce a club head 2 with a first mode frequency of 3322 Hz and a second mode frequency of 3694 Hz; thus removal of the centrally located sole engaging channel tuning element 1300 resulted in a first mode frequency drop of 208 Hz and a second mode frequency drop of 35 Hz. The next embodiment removes the second sole engaging channel tuning element 1380, leaving the longitudinal channel tuning element 1200, the sole engaging channel tuning element 1300, and the third sole engaging channel tuning element 1390 to produce a club head 2 with a first mode frequency of 3377 Hz and a second mode frequency of 3726 Hz; thus removal of the centrally located second sole engaging channel tuning element 1380 resulted in a first mode frequency drop of 153 Hz and a second mode frequency drop of 3 Hz. The last embodiment removes the longitudinal channel tuning element 1200, leaving the sole engaging channel tuning element 1300, the second sole engaging channel tuning element 1380, and the third sole engaging channel tuning element 1390 to produce a club head 2 with a first mode frequency of 3503 Hz and a second mode frequency of 3728 Hz; thus removal of the longitudinal channel tuning element 1200 resulted in a first mode frequency drop of 27 Hz and a second mode frequency drop of 1 Hz.

TABLE 1

| Elements of the Channel Tuning System (1100) Present | Mode 1 (Hz) | Mode 2 (Hz) | Mode 1 Drop (Hz) | Mode 2 Drop (Hz) |
|---|---|---|---|---|
| 1200 + 1300 + 1380 + 1390 | 3530 | 3729 | | |
| 1200 + 1300 + 1380 | 3328 | 3727 | 202 | 2 |
| 1200 + 1380 + 1390 | 3322 | 3694 | 208 | 35 |
| 1200 + 1300 + 1390 | 3377 | 3726 | 153 | 3 |
| 1300 + 1380 + 1390 | 3503 | 3728 | 27 | 1 |

Another advantage of the channel tuning system 1100 is that it is located in the forward half of the club head 2, further promoting a low forward location of the club head 2 center-of-gravity.

Yet a further embodiment incorporates a body tuning system 1400 having a body tuning element 1500, seen best in FIGS. 9-10, 19-23, which may be used in addition to the longitudinal channel tuning element 1200 and/or the sole engaging channel tuning element 1300, or entirely independent of them. The body tuning system 1400 is able to tune the club head 2 and reduce some of the undesirable attributes associated with the introduction of the channel 212 and does so without contacting the channel 212 and therefore without influencing the flexibility of the channel 212. The body tuning system 1400 is particularly beneficial in embodiments having irregular contours of the crown 12, such as the embodiments seen best in FIGS. 1-2 and 23-25, or a particularly bulbous crown 12 that extends significantly above the top edge of the face 18, as seen in FIG. 8. In one body tuning system 1400 embodiment the body tuning element 1500 includes a body tuning element toe end 1510, a body tuning element heel end 1520, a body tuning element length 1530, a body tuning element height 1540, and a body tuning element width 1550, seen best in FIGS. 9-10, 19, 23, and 31. As seen in FIG. 23, an embodiment of the body tuning element 1500 has a body tuning element sole portion 1570 in contact with the sole 14 and extending in a substantially heel-to-toe direction. The body tuning element 1500 is separated from the channel 212 by a body tuning separation distance 1560, seen in FIG. 10, which is greater than the maximum channel width Wg. The body tuning element length 1530 is measured in a straight line along the ground plane from a vertical projection of the body tuning element toe end 1510 on the ground plane to a vertical projection of the body tuning element heel end 1520 on the ground plane. Similarly, the body tuning separation distance 1560 is measured in a straight line along the ground plane from a vertical projection of a location on the body tuning element 1500 to the nearest vertical projection of the channel 212 onto the ground plane. In another embodiment the body tuning separation distance 1560 is greater than the maximum channel width Wg throughout at least 50% of the body tuning element length 1530; whereas in another embodiment the body tuning separation distance 1560 is at least twice the maximum channel width Wg throughout at least 50% of the body tuning element length 1530; in yet a further embodiment the body tuning separation distance 1560 is 150-300% of the maximum channel width Wg throughout at least 50% of the body tuning element length 1530; and in a further embodiment the body tuning separation distance 1560 is 175-250% of the maximum channel width Wg throughout at least 50% of the body tuning element length 1530

Figure 26:
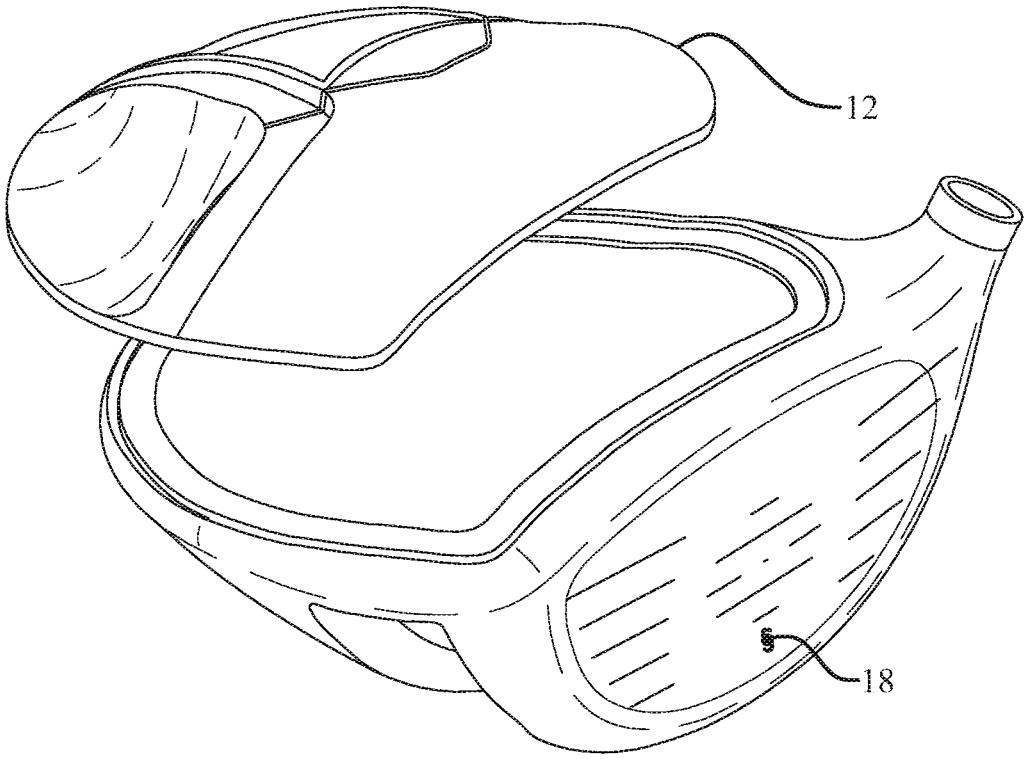
FIG. 26 is a perspective view of one embodiment of a golf club head.

Beneficial tuning is achieved in a further embodiment without adding undue rigidity to the club head 2 and limiting beneficial flexing of the club head 2 when at least a portion of the body tuning element height 1540 is at least 15% of the maximum channel depth Dg, and in a further embodiment at least a portion of the body tuning element height 1540 is no more than 75% of the maximum channel depth Dg, while in an even further embodiment at least a portion of the body tuning element height 1540 is 25-50% of the maximum channel depth Dg. While the prior embodiments are directed to characteristics in at least one front-to-rear vertical section passing through the body tuning element 1500, in further embodiments the relationships are true through at least 25% of the body tuning element length 1530, and in even further embodiments through at least 50% of the body tuning element length 1530, and at least 75% in yet another embodiment. The delicate balance of beneficial tuning, and avoidance of undue rigidity, is further achieved in embodiments having a body tuning element length 1530, as seen in FIG. 19, of at least 50% of the channel length Lg, while in another embodiment the body tuning element length 1530 is at least 75% of the channel length Lg. Even further embodiments having a longitudinal channel tuning element 1200 link the body tuning element length 1530 to the longitudinal tuning element length 1230 such that in one embodiment the body tuning element length 1530 is at least 50% of the longitudinal tuning element length 1230, while in a further embodiment the body tuning element length 1530 is at least 75% of the longitudinal tuning element length 1230. Thus, any of the described relationships of the body tuning element 1500 with respect to percentages of the body tuning element length 1530, may also be applied throughout the indicated percentages of the longitudinal tuning element length 1230 and/or the channel length Lg to achieve the desired tuning and avoidance of undue club head 2 rigidity. As previously noted, the body tuning system 1400 is particularly beneficial in embodiments having irregular contours of the crown 12, such as the embodiments seen best in FIGS. 1-2 and 23-25, and embodiments having a bulbous crown with an apex that is significantly above a top edge of the face 18, therefore some embodiments may have a body tuning system 1500 that further includes a body tuning element crown portion 1580 in contact with the crown 12, as seen in FIG. 23. One such embodiment has a body tuning element crown portion 1580 in contact with the crown 12 throughout at least 50% of the longitudinal tuning element length 1230 and/or at least 50% of the channel length Lg; while a further embodiment has the body tuning element crown portion 1580 in contact with the crown 12 throughout at least 75% of the longitudinal tuning element length 1230 and/or at least 75% of the channel length Lg. One particular embodiment has at least a portion of the body tuning element crown portion 1580 connected to the body tuning element sole portion 1570, while in an even further embodiment the body tuning element crown portion 1580 is connected to the body tuning element sole portion 1570 at both the heel portion 26 and the toe portion 28, as seen in FIG. 23. One embodiment having irregular crown contours has a body tuning element crown portion 1580 with at least one section that is concave downward toward the sole 14 and at least one section that is concave upward toward the crown 12, while the embodiment of FIG. 23 includes one section that is concave downward toward the sole 14 and two sections that are concave upward toward the crown 12 separated by the concave downward section. In one embodiment the concave downward section is integrally formed with at least one concave upward section. As seen in FIG. 26, the crown 12 may be a crown insert attached to the club head 2, and in such embodiments the crown insert may be constructed of a different, generally lighter, material, which may further contribute to the need for a channel tuning system 1100 and/or a body tuning system 1400.

As with the longitudinal channel tuning element 1200 and the sole engaging channel tuning element 1300 being in contact with the channel 212 either integrally or via a number of joining methods, portions of the body tuning system 1400 are in contact with the sole 14 and/or crown 12, which in one embodiment means that they are integrally cast with the sole 14 and/or crown 12, while in another embodiment they are attached to the sole 14 and/or crown 12 via available joining methods including welding, brazing, and adhesive attachment.

The body tuning element 1500 is preferably oriented in a direction that is plus, or minus, 45 degrees from a vertical heel-to-toe plane parallel to a vertical heel-to-toe plane containing the centerline axis 21, however in a further embodiment the body tuning element 1500 is preferably oriented in a direction that is plus, or minus, 20 degrees from a vertical heel-to-toe plane parallel to a vertical heel-to-toe plane containing the centerline axis 21, and in an even further embodiment the body tuning element 1500 is preferably oriented in a direction that is substantially parallel to a vertical heel-to-toe plane containing the centerline axis 21. The body tuning element 1500 may traverse a portion of the club head 2 a linear fashion, a zig-zag or sawtooth type fashion, or a curved fashion.

Another embodiment incorporates the aerodynamic benefits of a uniquely shaped crown 12 as disclosed in U.S. patent application Ser. Nos. 14/260,328, 14/330,205, 14/259,475, and 14/88,354, all of which are incorporated by reference in their entirety herein. One such embodiment has a club head depth Dch, seen in FIG. 7, that is at least 4.4 inches, while in a further embodiment the club head depth Dch is at least 4.5 inches, and at least 4.6 inches in yet a further embodiment. Aerodynamic characteristics are particularly beneficial in embodiments having a maximum top edge elevation, Hte, of at least 2.0 inches, while in a further embodiment the maximum top edge elevation, Hte, is at least 2.2 inches, and at least 2.4 inches in yet a further embodiment. The highest point on the crown 12 establishes the club head height, Hch, above the ground plane, as seen in FIGS. 8 and 10, and this highest point on the crown 12 is referred to as the crown apex. An apex ratio is the ratio of club head height, Hch, to the maximum top edge elevation, Hte. In one embodiment the apex ratio is at least 1.13, thereby encouraging airflow reattachment and reduced aerodynamic drag, while the apex ratio is at least 1.15 in a further embodiment, at least 1.17 in an even further embodiment, and at least 1.19 in yet another embodiment.

While such bulbous crown embodiments are aerodynamically beneficial, it is desirable to control the center-of-gravity of the club head 2 so that it does not increase significantly due to the bulbous crown 12. One manner of controlling the height of the CG is to incorporate a crown structure such as that disclosed in U.S. patent application Ser. No. 14/734,181, which is incorporated by reference in its entirety herein. Therefore, in one embodiment majority of the crown 12 has a thickness of 0.7 mm or less, while in a further embodiment majority of the crown 12 has a thickness of 0.65 mm or less. In another embodiment at least a portion of the crown 12 has a thickness of 0.5 mm or less, while in yet a further embodiment at least a portion of the crown 12 has a thickness of 0.4 mm or less; in another embodiment such crown 12 embodiments having thin portions may also have a portion with a thickness of at least 0.7 mm. For instance, the crown 12 may have a front crown portion 901, as seen in FIG. 9, with a relatively greater thickness than a back crown portion 905 in order to provide greater durability to the golf club head 2. In some embodiments, the front crown portion 901 has a thickness of from about 0.6 to about 1.0 mm, such as from about 0.7 to about 0.9 mm, or about 0.8 mm. In a further embodiment at least a portion of the back crown portion 905 has a thickness that is less than 60% of the front crown portion 901.

Now looking at just the portion of the crown 12 located at an elevation above the maximum face top edge elevation, Hte, in one embodiment majority of this portion of the crown 12 has a thickness of 0.7 mm or less, while in a further embodiment majority of this portion of the crown 12 has a thickness of 0.6 mm or less, while in yet another embodiment majority of this portion of the crown 12 has a thickness of 0.5 mm or less. The foregoing thicknesses refer to the components of the golf club head 2 after all manufacturing steps have been taken, including construction (e.g., casting, stamping, welding, brazing, etc.), finishing (e.g., polishing, etc.), and any other steps. Another manner of controlling the height of the CG, while still incorporating an aerodynamically bulbous crown, is to incorporate at least one recessed area into the crown, as seen in FIGS. 1 and 2, in lieu of a traditional crown 12 of relatively consistent curvature.

Such bulbous crown embodiments, and the associated thin-crown embodiments and recessed area crown embodiments, are designed to reduce the impact of the bulbous crown on the CG location, often introduce new less desirable characteristics to the club head 2, similar to those discussed with the introduction of the channel 212. Fortunately embodiments incorporating a body tuning system 1400 may reduce the less desirable characteristics. For instance, one embodiment incorporates a body tuning element crown portion 1580 that is partially above the maximum top edge elevation, Hte, of the face 18, as seen in FIG. 10, while a further embodiment has at least a portion of the body tuning element crown portion 1580 at an elevation that is at least 5% greater than the maximum top edge elevation, Hte, of the face 18, and yet another embodiment has at least a portion of the body tuning element crown portion 1580 at an elevation that is at least 10% greater than the maximum top edge elevation, Hte, of the face 18. Another embodiment incorporates a body tuning element crown portion 1580 that extends continuously across the portion of the crown 12 that is located at an elevation above the maximum face top edge elevation, Hte, of the face 18. Such embodiments, along with the previously disclosed embodiments disclosing relationships of the body tuning separation distance 1560 to other club head 2 variables, effectively establish the portion of the crown 12 that lies above the maximum face top edge elevation, Hte, of the face 18.

In yet a further embodiment the body tuning system 1400 further includes a body tuning element connecting element 1600 having a connecting element sole end 1610 engaging the body tuning element sole portion 1570, and a connecting element crown end 1620 engaging the body tuning element crown portion 1580, as seen in FIG. 23. In one embodiment the body tuning element connecting element 1600, or a portion of it, may be integrally cast with the body tuning element sole portion 1570 and/or the body tuning element crown portion 1580, while in another embodiment the attachment may be made via available joining methods including welding, brazing, and adhesive attachment, or mechanically attached such as in an embodiment like FIG. 26 having a crown insert. In such crown insert embodiment the body tuning element connecting element 1600 may be a single piece connected to either the body tuning element sole portion 1570 and/or the body tuning element crown portion 1580 that then engages the other portion when the crown insert is installed, or the body tuning element connecting element 1600 may be composed of multiple sections that then engages the other section when the crown insert is installed. Thus, either, or both, the body tuning element sole portion 1570 and/or the body tuning element crown portion 1580 may be formed to include a receiver to cooperate and receive an end of the body tuning element connecting element 1600. The body tuning element connecting element 1600 effectively joins the crown 12 and sole 14 to further tune the club head 2 and reduce undesirable vibrations.

The location of the body tuning element connecting element 1600 is largely dictated by the location of the body tuning element sole portion 1570 and the body tuning element crown portion 1580, and therefore all the relationships disclosed regarding their location with respect to the channel 212 also apply to the location of the body tuning element connecting element 1600. Further, one particular embodiment provides preferred performance when the body tuning element connecting element 1600 is located on the toe side of the club head 2, or between the ideal impact location 23 and the toe 28. In another embodiment the body tuning element connecting element 1600 is located on the toe side of the club head 2 and in the rear half of the club head 2, using the club head depth Dch seen in FIG. 7 to determine the rear half. Still further, in another embodiment the connecting element crown end 1620 engages the body tuning element crown portion 1580 at an elevation below the maximum face top edge elevation, Hte, of the face 18. Likewise, the orientation and construction of the body tuning element connecting element 1600 influences the benefits associated with it. In one embodiment the body tuning element connecting element 1600 is oriented at an angle that is plus, or minus, 10 degrees from vertical; while in a further embodiment the orientation is plus, or minus, 5 degrees from vertical; and in an even further embodiment the orientation is substantially vertical. The cross-sectional shape of the body tuning element connecting element 1600 in a plane perpendicular to a longitudinal axis of the body tuning element connecting element 1600 is round in one embodiment. Further, in one embodiment the body tuning element connecting element 1600 is solid, while in an alternative embodiment the body tuning element connecting element 1600 is hollow. Regardless, the minimum cross-sectional dimension of the body tuning element connecting element 1600 is at least as great as the minimum body tuning element width 1550, while in a further embodiment it is at least as great as the maximum body tuning element width 1500, while in yet another embodiment it is at least twice the maximum body tuning element width 1500, and in still a further embodiment it is 2-5 times the maximum body tuning element width 1500. In hollow body tuning element connecting element 1600 embodiments the minimum wall thickness of the body tuning element connecting element 1600 is at least as great as the minimum body tuning element width 1550. A further embodiment includes a bridge 1700, seen in FIG. 23, connecting the body tuning element 1500 with the sole engaging channel tuning element 1300, and in one embodiment the bridge 1700 engages the body tuning element 1500 at the connecting element sole end 1610.

The benefits of the channel tuning system 1100 and/or body tuning system 1400 are heightened as the size of the channel 212 increases. For example in one embodiment the disclosed embodiments are used in conjunction with a channel 212 having a volume that is at least 3% of the club head 2 volume, while in a further embodiment the channel 212 has a volume that is 4-10% of the club head 2 volume, and in an even further embodiment the channel 212 has a volume that is at least 5% of the club head 2 volume. In one particular embodiment the channel 212 has a volume that is at least 15 cubic centimeters (cc), while a further embodiment has a channel 212 volume that is 15-40 cc, and an even further embodiment has a channel 212 volume of at least 20 cc. One skilled in the art will know how to determine such volumes by submerging at least a portion of the club head in a liquid, and then doing the same with the channel 212 covered, or by filling the channel 212 with clay or other malleable material to achieve a smooth exterior profile of the club head and then removing and measuring the volume of the malleable material.

Further, the benefits of the channel tuning system 1100 and/or body tuning system 1400 are heightened as the channel width Wg, channel depth Dg, and/or channel length Lg increase. As previously disclosed, beneficial flexing of the club head 2, and reduced stress in the channel 212, may be achieved as the size of the channel 212 increases, however there is a point at which the negatives outweigh the positives, yet the channel tuning system 1100 and/or body tuning system 1400, as well as the upper channel wall radius of curvature 222R, beneficially shift, or control, when the negatives outweigh the positives. In one embodiment any of the disclosed embodiments are used in conjunction with a channel 212 that has a portion with a channel depth Dg that is at least 20% of the Zup value, while a further embodiment has a portion with the channel depth Dg being at least 30% of the Zup value, and an even further embodiment has a portion with the channel depth Dg being 30-70% of the Zup value. In another embodiment any of the disclosed embodiments are used in conjunction with a channel 212 that has a portion with a channel depth Dg that is at least 8 mm, while a further embodiment has a portion with the channel depth Dg being at least 10 mm, while an even further embodiment has a portion with the channel depth Dg being at least 12 mm, and yet another embodiment has a portion with the channel depth Dg being 10-15 mm. One embodiment has a Zup value that is less than 30 mm. The length Lg of the channel 212 may be defined relative to the width of the striking face Wss. For example, in some embodiments, the length Lg of the channel 212 is from about 70% to about 140%, or about 80% to about 140%, or about 100% of the width of the striking face Wss.

Further, the configuration of the crown 12, including the shape, and in some embodiments the amount of the bulbous crown 12 at an elevation above the maximum face top edge elevation, Hte, of the face 18, as well as the crown thickness, influence the overall rigidity, or alternatively the flexibility, of the club head 2, which must compliment the benefits associated with the channel 212, and vice versa, rather than fight the benefits associated with the channel 212 and/or crown thickness, and in some embodiments the relationships further serve to achieve the desired tuning characteristics of the club head 2. As such, in one bulbous crown embodiment the difference between the maximum club head height, Hch, or apex height, and the maximum face top edge elevation, Hte, of the face 18, is at least 50% of the maximum channel depth, Dg, while in a further embodiment the difference is at least 70% of the maximum channel depth, Dg, in yet another embodiment the difference is 70-125% of the maximum channel depth, Dg, and in still a further embodiment the difference is 80-110% of the maximum channel depth, Dg. In another bulbous crown embodiment the difference between the maximum club head height, Hch, or apex height, and the maximum face top edge elevation, Hte, of the face 18, is at least 25% of the maximum channel width, Wg, while in a further embodiment the difference is at least 50% of the maximum channel width, Wg, in yet another embodiment the difference is 60-120% of the maximum channel width, Wg, and in still a further embodiment the difference is 70-110% of the maximum channel width, Wg. A further bulbous crown embodiment has an apex ratio of at least 1.13 and the maximum channel depth, Dg, is at least 10% of the difference between the maximum club head height, Hch, or apex height, and the maximum face top edge elevation, Hte, of the face 18; while in a further embodiment the apex ratio is at least 1.15 and the maximum channel depth, Dg, is at least 20% of the difference between the maximum club head height, Hch, or apex height, and the maximum face top edge elevation, Hte, of the face 18; and in yet another embodiment the apex ratio is at least 1.15 and the maximum channel depth, Dg, is 60-120% of the difference between the maximum club head height, Hch, or apex height, and the maximum face top edge elevation, Hte, of the face 18.

In a further embodiment wherein a majority of the portion of the crown 12 located at an elevation above the maximum face top edge elevation, Hte, has a crown thickness of 0.7 mm or less; while in another embodiment majority of the portion of the crown 12 located at an elevation above the maximum face top edge elevation, Hte, has a crown thickness that is less than a maximum channel wall thickness 221; and in yet an even further embodiment majority of the portion of the crown 12 located at an elevation above the maximum face top edge elevation, Hte, has a crown thickness that is less than a minimum channel wall thickness 221. In another embodiment majority of the portion of the crown 12 located at an elevation above the maximum face top edge elevation, Hte, has a crown thickness that is 25-75% of a minimum channel wall thickness 221.

Now turning to the channel width Wg, in one embodiment any of the disclosed embodiments are used in conjunction with a channel 212 that has a portion with a channel width Wg that is at least 20% of the Zup value, while a further embodiment has a portion with the channel width Wg being at least 30% of the Zup value, and an even further embodiment has a portion with the channel width Wg being 25-60% of the Zup value. In one driver embodiment the Zup value is 20-36 mm, while in a further embodiment the Zup value is 24-32 mm, while in an even further embodiment the Zup value is 26-30 mm. In one fairway wood embodiment the Zup value is 8-20 mm, while in a further embodiment the Zup value is 10-18 mm, while in an even further embodiment the Zup value is 12-16 mm.

Another embodiment further improves the stress distribution in the channel 212 when any of the disclosed embodiments are used in conjunction with a channel 212 that has a portion with an upper channel wall radius of curvature 222R, seen in FIG. 9, that is at least 20% of the maximum channel width Wg, while a further embodiment has a portion with an upper channel wall radius of curvature 222R that is at least 25% of the maximum channel width Wg, and an even further embodiment has a portion with an upper channel wall radius of curvature 222R that is at least 30% of the maximum channel width Wg. While the embodiments described immediately above in this paragraph are directed to characteristics in at least one front-to-rear vertical section passing through the longitudinal channel tuning element 1200, in further embodiments the relationships are true through at least 25% of the channel length Lg, and in even further embodiments through at least 50% of the channel length Lg, and at least 75% in yet another embodiment. Now turning to the channel length Lg, in one embodiment any of the disclosed embodiments are used in conjunction with a channel 212 that has a channel length Lg that is at least 50% of the face width Wss, while in another embodiment any of the disclosed embodiments are used in conjunction with a channel 212 that has a channel length Lg that is at least 75% of the face width Wss, and in an even further embodiment any of the disclosed embodiments are used in conjunction with a channel 212 that has a channel length Lg that is greater than the face width Wss.

The channel 212 may further include an aperture as disclosed in U.S. patent application Ser. No. 14/472,415, which is incorporated herein by reference. Further, the crown 12 may include a post apex attachment promoting region as disclosed in U.S. patent application Ser. No. 14/259,475, which is incorporated herein by reference, a drop contour area as disclosed in U.S. patent application Ser. No. 14/488,354, which is incorporated herein by reference, a trip step as disclosed in U.S. patent application Ser. No. 14/330,205, which is incorporated herein by reference, and/or unique crown curvature as disclosed in U.S. patent application Ser. No. 14/260,328, which is incorporated herein by reference Another embodiment introduces a thickened channel central region 225, seen best in FIGS. 6 and 11, to further complement the benefits of the channel tuning system 1100 and/or body tuning system 1400. In one embodiment the channel central region 225 is the portion of the channel 212 within ½ inch on either side of the ideal impact location 23, and within the channel central region 225 a portion of the channel 212 has a wall thickness 221 that is at least twice the thinnest portion of the channel 212 located outside of the channel central region 225, while in a further embodiment the wall thickness 221 through the entire channel central region 225 is at least twice the thinnest portion of the channel 212 located outside of the channel central region 225. In one embodiment a portion of the channel 212 within the channel central region 225 has a wall thickness 221 that is at least 2.0 mm, and a portion of the channel 212 located outside of the channel central region 225 has a wall thickness 221 that is 1.0 mm or less, while in another embodiment the channel central region 225 has a wall thickness 221 that is at least 2.5 mm, and in yet another embodiment no portion of the channel central region 225 has a wall thickness 221 greater than 3.5 mm. In a further embodiment the portion of the sole 14 in front of the channel central region 225 has a sole thickness that is at least as thick as the maximum channel wall thickness 221 in the channel central region 225, while in an even further embodiment the portion of the sole 14 in front of the channel central region 225 has a sole thickness that is at least twice the thinnest portion of the channel 212 located outside of the channel central region 225, while in another embodiment the portion of the sole 14 in front of the channel central region 225 has a sole thickness that is at least 2.0 mm, and in yet another embodiment the entire portion of the sole 14 in front of the channel central region 225 has a sole thickness that is 2.5-3.5 mm. In addition to the benefits of the channel tuning system 1100 and/or body tuning system 1400 disclosed, the embodiments of this paragraph also stabilize the face 18, lower the peak stress in the channel 212, and reduce the spin imparted on a golf ball at impact.

The rear channel wall 218 and front channel wall 220 define a channel angle β therebetween. In some embodiments, the channel angle β can be between about 10° to about 30°, such as about 13° to about 28°, or about 13° to about 22°. In some embodiments, the rear channel wall 218 extends substantially perpendicular to the ground plane when the club head 2 is in the normal address position, i.e., substantially parallel to the z-axis 65. In still other embodiments, the front channel wall 220 defines a surface that is substantially parallel to the striking face 18, i.e., the front channel wall 220 is inclined relative to a vector normal to the ground plane (when the club head 2 is in the normal address position) by an angle that is within about ±5° of the loft angle 15, such as within about ±3° of the loft angle 15, or within about ±1° of the loft angle 15.

In the embodiment shown, the heel channel wall 214, toe channel wall 216, rear channel wall 218, and front channel wall 220 each have a thickness 221 of from about 0.7 mm to about 1.5 mm, e.g., from about 0.8 mm to about 1.3 mm, or from about 0.9 mm to about 1.1 mm.

As seen in FIGS. 27-28, a weight port 40 may be located on the sole portion 14 of the golf club head 2, and is located adjacent to and rearward of the channel 212. In a further embodiment the weight port 40 is located on the sole portion 14 of the golf club head 2, and is located adjacent to and rearward of the body tuning system 1500. Still a further embodiment has at least one weight port 40 is located on the sole portion 14 of the golf club head 2, and located adjacent to and between the channel 212 and the body tuning system 1500; while an even further embodiment has at least two weight ports 40 is located on the sole portion 14 of the golf club head 2, and located adjacent to and between the channel 212 and the body tuning system 1500. By positioning the weight port 40 rearward of the channel 212, and in some embodiments forward of the body tuning system 1500, the deformation is localized in the area of the channel 212, since the club head 2 is much stiffer in the area of the at least one weight port 40. As a result, the ball speed after impact is greater for the club head having the channel 212 and at least one weight port 40 than for a conventional club head, which results in a higher COR. The weight port 40 may be located adjacent to and rearward of the rear channel wall 218. One or more mass pads may also be located in a forward position on the sole 14 of the golf club head 2, contiguous with both the rear channel wall 218 and the weight port 40. As discussed above, the configuration of the channel 212 and its position near the face 18 allows the face plate to undergo more deformation while striking a ball than a comparable club head without the channel 212, thereby increasing both COR and the speed of golf balls struck by the golf club head. In some embodiments the weight port 40, or ports, are located adjacent to and rearward of the rear channel wall 218. The weight ports 40 are separated from the rear channel wall 218 by a distance of approximately 1 mm to about 10 mm, such as about 1.5 mm to about 8 mm. As discussed above, the configuration of the channel 212 and its position near the face 18 allows the face plate to undergo more deformation while striking a ball than a comparable club head without the channel 212, thereby increasing both COR and the speed of golf balls struck by the golf club head. As a result, the ball speed after impact is greater for the club head having the channel 212 than for a conventional club head, which results in a higher COR.

In some embodiments, the slot 212 has a substantially constant width Wg, and the slot 212 is defined by a radius of curvature for each of the forward edge and rearward edge of the slot 212. In some embodiments, the radius of curvature of the forward edge of the slot 212 is substantially the same as the radius of curvature of the forward edge of the sole 14. In other embodiments, the radius of curvature of each of the forward and rearward edges of the slot 212 is from about 15 mm to about 90 mm, such as from about 20 mm to about 70 mm, such as from about 30 mm to about 60 mm. In still other embodiments, the slot width Wg changes at different locations along the length of the slot 212.

Connection Assembly

Now referencing FIGS. 34-38, a club shaft is received within the hosel bore 24 and is aligned with the centerline axis 21. In some embodiments, a connection assembly is provided that allows the shaft to be easily disconnected from the club head 2. In still other embodiments, the connection assembly provides the ability for the user to selectively adjust the loft-angle 15 and/or lie-angle 19 of the golf club. For example, in some embodiments, a sleeve is mounted on a lower end portion of the shaft and is configured to be inserted into the hosel bore 24. The sleeve has an upper portion defining an upper opening that receives the lower end portion of the shaft, and a lower portion having a plurality of longitudinally extending, angularly spaced external splines located below the shaft and adapted to mate with complimentary splines in the hosel opening 24. The lower portion of the sleeve defines a longitudinally extending, internally threaded opening adapted to receive a screw for securing the shaft assembly to the club head 2 when the sleeve is inserted into the hosel opening 24. Further detail concerning the shaft connection assembly is provided in U.S. patent application Ser. No. 14/074,481, which is incorporated herein by reference.

Figure 34:
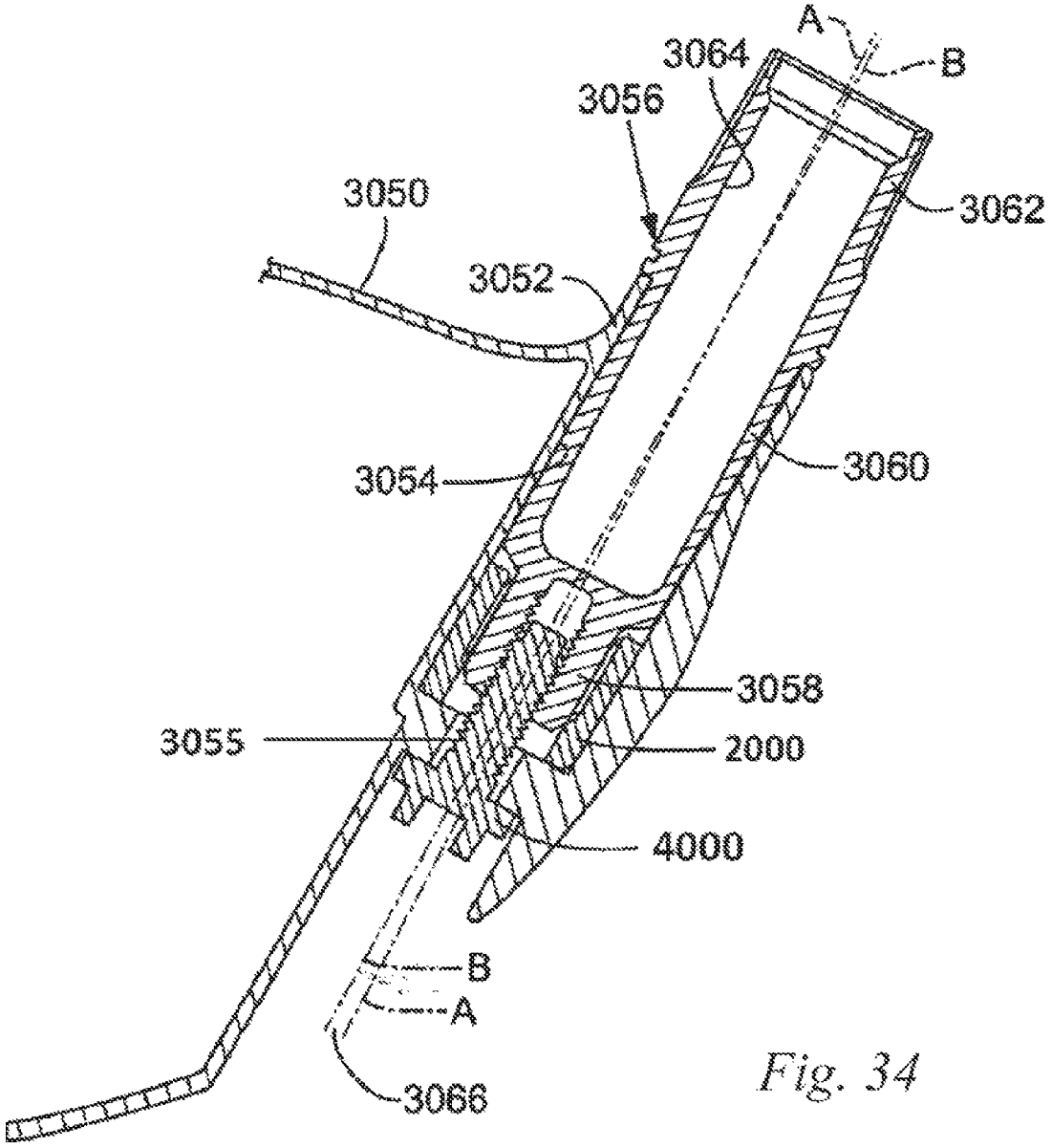
FIG. 34 is an enlarged cross-sectional view of a golf club head having a removable shaft, in accordance with another embodiment.

For example, FIG. 34 shows an embodiment of a golf club assembly that includes a club head 3050 having a hosel 3052 defining a hosel opening 3054, which in turn is adapted to receive a hosel insert 2000. The hosel opening 3054 is also adapted to receive a shaft sleeve 3056 mounted on the lower end portion of a shaft (not shown in FIG. 28) as described in U.S. patent application Ser. No. 14/074,481. The hosel opening 3054 extends from the hosel 3052 through the club head and opens at the sole, or bottom surface, of the club head. Generally, the club head is removably attached to the shaft by the sleeve 3056 (which is mounted to the lower end portion of the shaft) by inserting the sleeve 3056 into the hosel opening 3054 and the hosel insert 2000 (which is mounted inside the hosel opening 3054), and inserting a screw 4000 upwardly through an opening in the sole and tightening the screw into a threaded opening of the sleeve, thereby securing the club head to the sleeve 3056.

The shaft sleeve 3056 has a lower portion 3058 including splines that mate with mating splines of the hosel insert 2000, an intermediate portion 3060 and an upper head portion 3062. The intermediate portion 3060 and the head portion 3062 define an internal bore 3064 for receiving the tip end portion of the shaft. In the illustrated embodiment, the intermediate portion 3060 of the shaft sleeve has a cylindrical external surface that is concentric with the inner cylindrical surface of the hosel opening 3054. In this manner, the lower and intermediate portions 3058, 3060 of the shaft sleeve and the hosel opening 3054 define a longitudinal axis B. The bore 3064 in the shaft sleeve defines a longitudinal axis A to support the shaft along axis A, which is offset from axis B by a predetermined angle 3066 determined by the bore 3064. As described in more detail in U.S. patent application Ser. No. 14/074,481, inserting the shaft sleeve 3056 at different angular positions relative to the hosel insert 2000 is effective to adjust the shaft loft and/or the lie angle.

Figure 35:
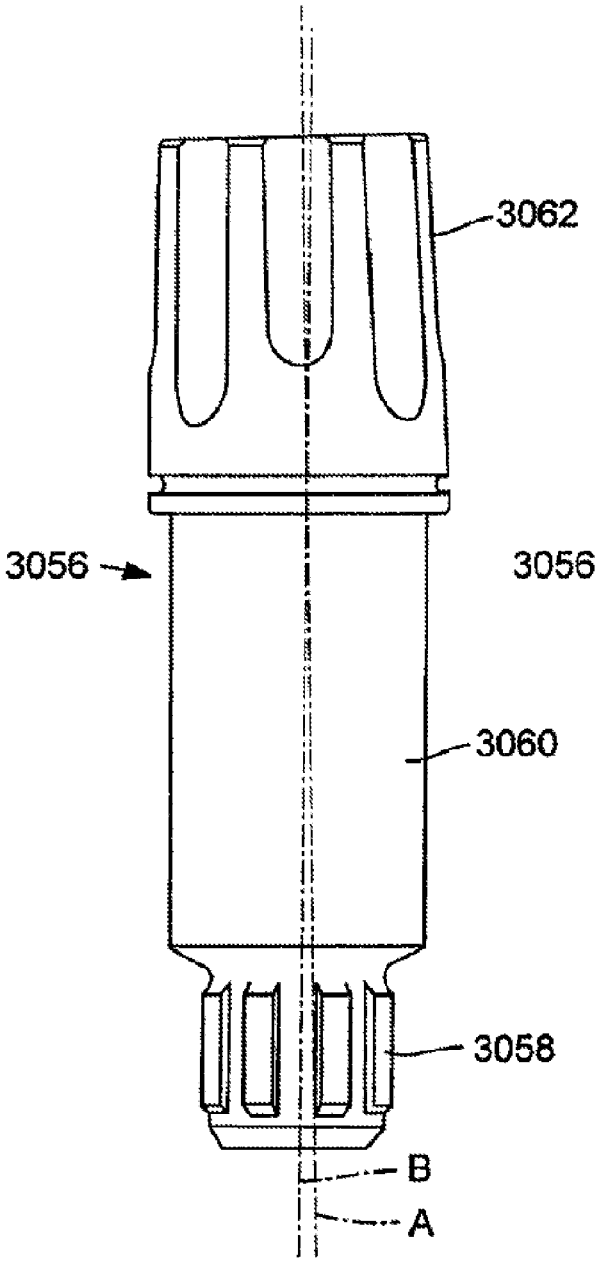
FIG. 35 is a front elevation view of a shaft sleeve of the assembly shown in FIG. 28.
Figure 36:
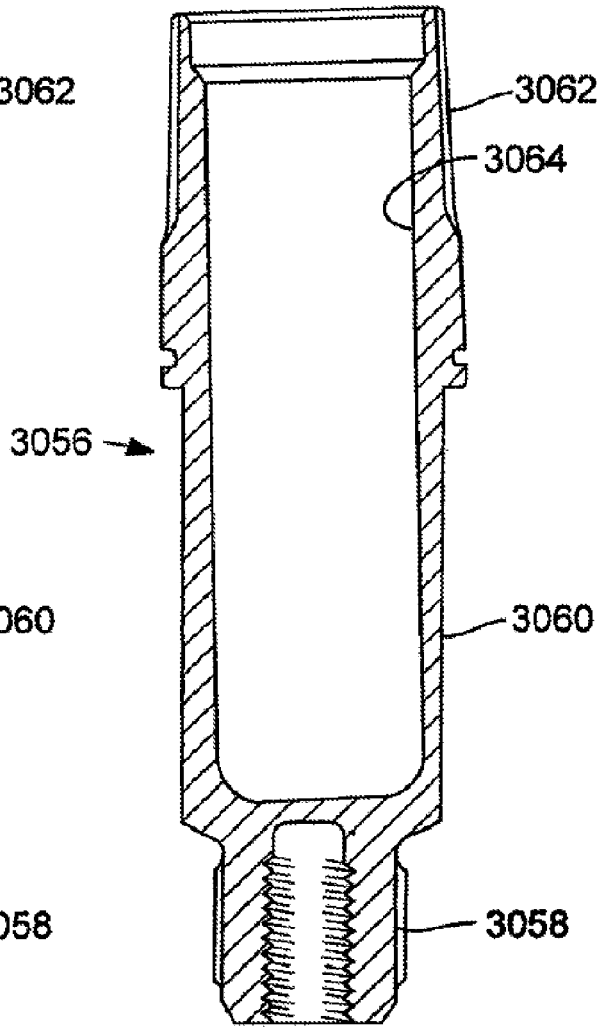
FIG. 36 is a cross-sectional view of a shaft sleeve of the assembly shown in FIG. 28.

In the embodiment shown, because the intermediate portion 3060 is concentric with the hosel opening 3054, the outer surface of the intermediate portion 3060 can contact the adjacent surface of the hosel opening, as depicted in FIG. 34. This allows easier alignment of the mating features of the assembly during installation of the shaft and further improves the manufacturing process and efficiency. FIGS. 35 and 36 are enlarged views of the shaft sleeve 3056. As shown, the head portion 3062 of the shaft sleeve (which extends above the hosel 3052) can be angled relative to the intermediate portion 3060 by the angle 3066 so that the shaft and the head portion 3062 are both aligned along axis A. In alternative embodiments, the head portion 3062 can be aligned along axis B so that it is parallel to the intermediate portion 3060 and the lower portion 3058. Further embodiments incorporate a club head 2 having a shaft connection assembly like that described above in relation to FIGS. 34-36. In some embodiments, the club head 2 includes a shaft connection assembly and a channel or slot, such as those described above. For example, FIGS. 37 and 38A-E show an embodiment of a golf club head 2 having a shaft connection assembly that allows the shaft to be easily disconnected from the club head 2, and that provides the ability for the user to selectively adjust the loft-angle 15 and/or lie-angle 19 of the golf club. The club head 2 includes a hosel 20 defining a hosel bore 24, which in turn is adapted to receive a hosel insert 2000. The hosel bore 24 is also adapted to receive a shaft sleeve 3056 mounted on the lower end portion of a shaft (not shown in FIGS. 34 and 38A-F) as described in U.S. patent application Ser. No. 14/074,481. A recessed port 3070 is provided on the sole, and extends from the bottom portion of the golf club head into the interior of the body 10 toward the crown portion 12. The hosel bore 24 extends from the hosel 20 through the club head 2 and opens within the recessed portion 3070 at the sole of the club head.

Figure 37:
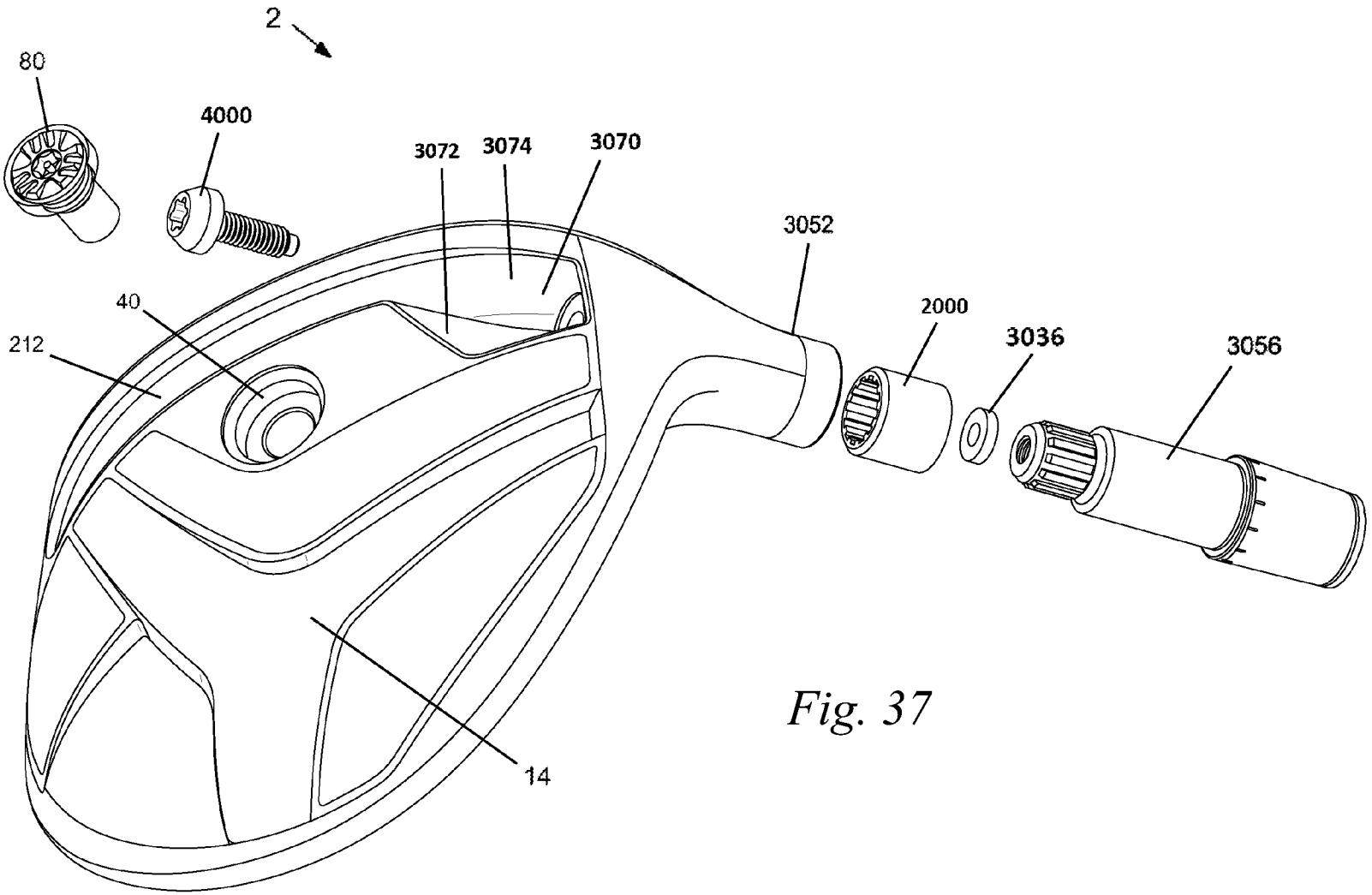
FIG. 37 is an exploded view of a golf club head, according to another embodiment.
Figure 38A:
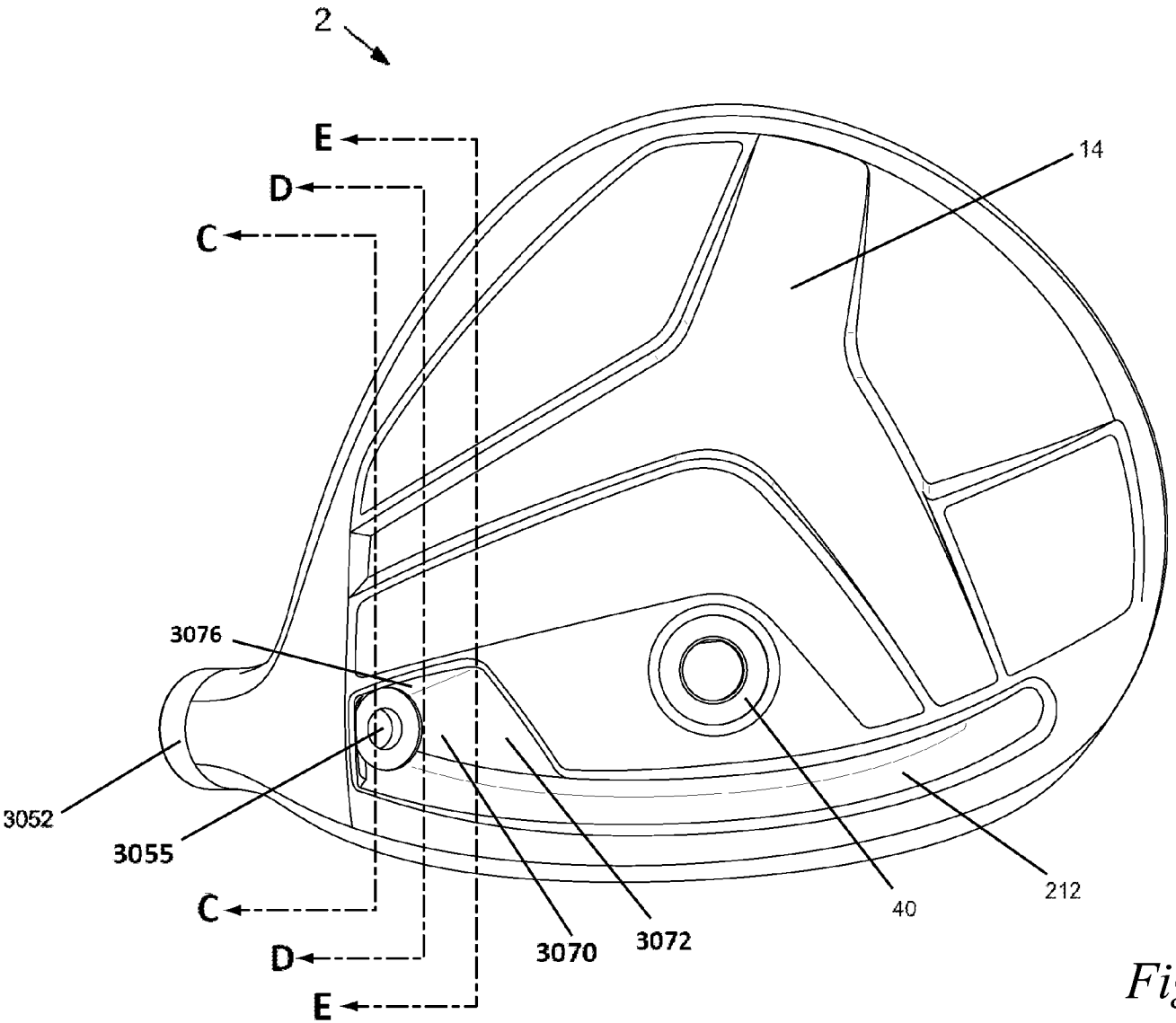
FIG. 38A is a bottom view of the golf club head of FIG. 31.
Figure 38B:
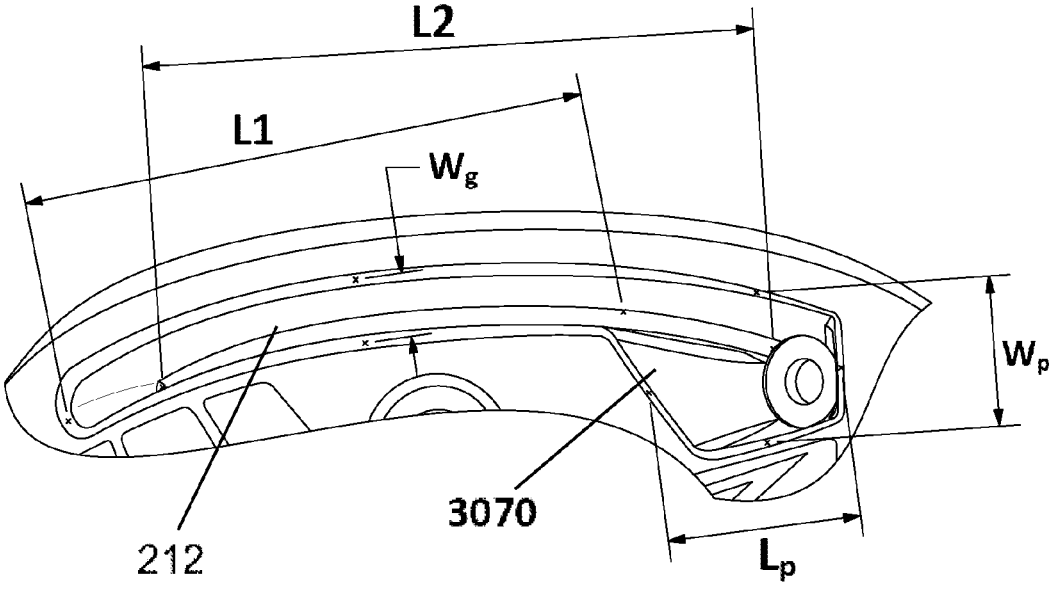
FIG. 38B is an enlarged bottom view of a portion of the golf club head of FIG. 31.

The club head 2 is removably attached to the shaft by the sleeve 3056 (which is mounted to the lower end portion of the shaft) by inserting the sleeve 3056 into the hosel bore 24 and the hosel insert 2000 (which is mounted inside the hosel bore 24), and inserting a screw 4000 upwardly through the recessed port 3070 and through an opening in the sole and tightening the screw into a threaded opening of the sleeve, thereby securing the club head to the sleeve 3056. A screw capturing device, such as in the form of an o-ring or washer 3036, can be placed on the shaft of the screw 4000 to retain the screw in place within the club head when the screw is loosened to permit removal of the shaft from the club head. The recessed port 3070 extends from the bottom portion of the golf club head into the interior of the outer shell toward the top portion of the club head (400), as seen in FIGS. 37 and 38A-E. In the embodiment shown, the mouth of the recessed port 3070 is generally rectangular, although the shape and size of the recessed port 3070 may be different in alternative embodiments. The recessed port 3070 is defined by a port toe wall 3072, a port fore-wall 3074, and/or a port aft-wall 3076, as seen in FIG. 37. In this embodiment, a portion of the recessed port 3070 connects to the channel 212 at an interface referred to as a port-to-channel junction 3080, seen best in the sections FIGS. 38D-E taken along section lines seen in FIG. 38A. In this embodiment, the portion of the channel 212 located near the heel portion of the club head 2 does not have a distinct rear wall at the port-to-channel junction 3080 and the port fore-wall 3074 supports a portion of the channel 212 located near the heel and serves to stabilize the heel portion of the channel 212 while permitting deflection of the channel 212. Similarly, the port-to-channel junction 3080 may be along the port aft-wall 3076 or the port toe wall 3072. Such embodiments allow the recessed port 3070 and the channel 212 to coexist in a relatively tight area on the club head while providing a stable connection and preferential deformation of the portion of the channel 212 located toward the heel of the club head. As shown in FIGS. 38A-E, the channel 212 extends over a portion of the sole 14 of the golf club head 2 in the forward portion of the sole 14 adjacent to or near the striking face 18. The channel 212 extends into the interior of the club head body 10 and may have an inverted "V" shape, a length Lg, a width Wg, and a depth Dg as discussed above. The channel 212 may merge with the recessed port 3070 at the port-to-channel junction 3080. In the embodiment shown in FIG. 38B, the channel width Wg is from about 3.5 mm to about 8.0 mm, such as from about 4.5 mm to about 7.0 mm, such as about 6.5 mm. A pair of distance measurements L1 and L2 are also shown in FIG. 38B, with L1 representing a distance from the toe channel wall 216 to a point within the channel corresponding with the port-to-channel junction 3080, and with L2 representing a distance from a point representing an intersection of the upper channel wall 222 and the toe channel wall 216 to a point on the upper channel wall 222 adjacent to the bore for the screw 4000. In the embodiment shown, the L1 distance is about 58 mm and the L2 distance is about 63 mm.

Also shown in FIG. 38B are measurements for the port width Wp and port length Lp, which define the generally rectangular shape of the recessed port 3070 in the illustrated embodiment. The port width Wp is measured from a midpoint of the mouth of the port fore-wall 3074 to a midpoint of the mouth of the port aft-wall 3076. The port length Lp is measured from a midpoint of the heel edge of the recessed port 3070 to a midpoint of the mouth of the port toe wall 3072. In the embodiment shown, the port width Wp is from about 8 mm to about 25 mm, such as from about 10 mm to about 20 mm, such as about 15.5 mm. In the embodiment shown, the port length Lp is from about 12 mm to about 30 mm, such as from about 15 mm to about 25 mm, such as about 20 mm. In alternative embodiments, the recessed portion 3070 has a shape that is other than rectangular, such as round, triangular, square, or some other regular geometric or irregular shape. In each of these embodiments, a port width Wp may be measured from the port fore-wall 3074 to a rearward-most point of the recessed port. For example, in an embodiment that includes a round recessed port (or a recessed port having a rounded aft-wall), the port width W.sub.p may be measured from the port fore-wall 3074 to a rearward-most point located on the rounded aft-wall. In several embodiments, a ratio Wp/Wg of the port width Wp to an average width of the channel Wg may be from about 1.1 to about 20, such as about 1.2 to about 15, such as about 1.5 to about 10, such as about 2 to about 8.

Figure 38C:
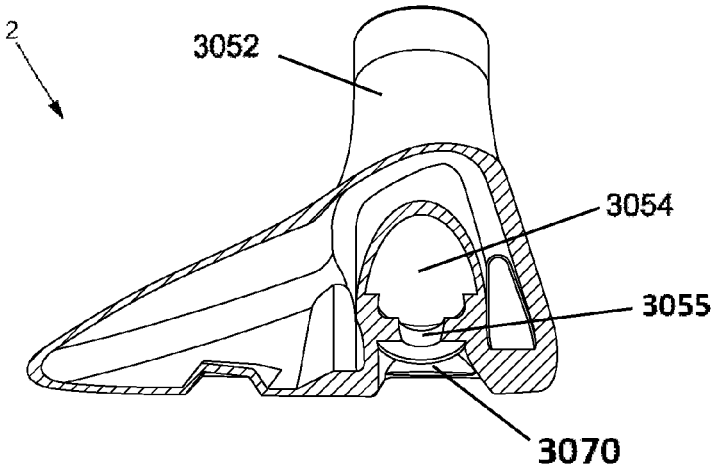
FIG. 38C is a cross-sectional view of the golf club head of FIG. 32A, taken along line C-C.
Figure 38D:
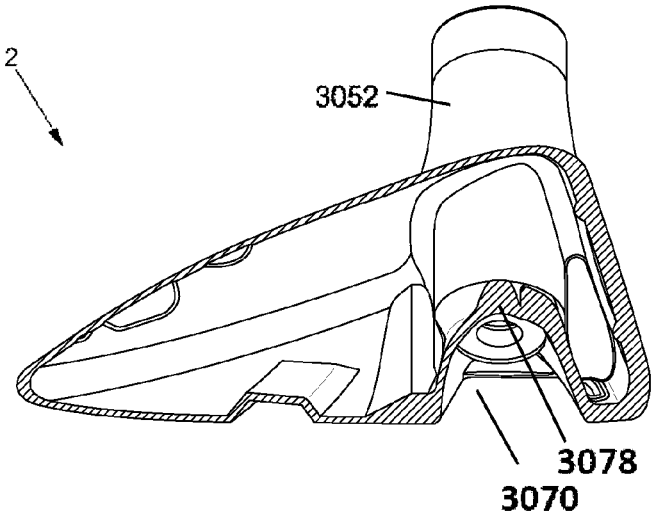
FIG. 38D is a cross-sectional view of the golf club head of FIG. 32A, taken along line D-D.
Figure 38E:
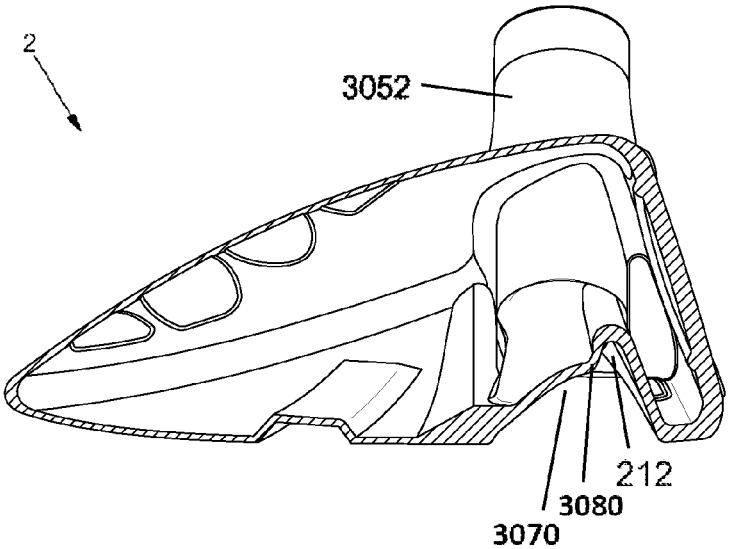
FIG. 38E is a cross-sectional view of the golf club head of FIG. 32A, taken along line E-E.

Turning to the cross-sectional views shown in FIGS. 38C-E, the transition from the area and volume comprising the recessed port 3070 to the area and volume comprising the channel 212 is illustrated. In FIG. 38C, the hosel opening 3054 is shown in communication with the recessed port 3070 via a passage 3055 through which the screw 400 of the shaft attachment system is able to pass. In FIG. 38D, a bottom wall 3078 of the recessed port 3070 forms a transition between the port fore-wall 3074 and the port aft-wall 3076. In FIG. 38E, the port-to-channel junction 3080 defines the transition from the recessed port 3070 to the channel 212.

In the embodiment shown in FIGS. 37 and 38A-E, a weight port 40 is located on the sole portion 14 of the golf club head 2, and is located adjacent to and rearward of the channel 212. As described previously, the weight port 40 can have any of a number of various configurations to receive and retain any of a number of weights or weight assemblies, such as described in U.S. Pat. Nos. 7,407,447 and 7,419,441, which are incorporated herein by reference. In the embodiment shown, the weight port 40 is located adjacent to and rearward of the rear channel wall 218. One or more mass pads may also be located in a forward position on the sole 14 of the golf club head 2, contiguous with both the rear channel wall 218 and the weight port 40. As discussed above, the configuration of the channel 212 and its position near the face 18 allows the face 18 to undergo more deformation while striking a ball than a comparable club head without the channel 212, thereby increasing both COR and the speed of golf balls struck by the golf club head. By positioning the mass pad rearward of the channel 212, the deformation is localized in the area of the channel 212, since the club head is much stiffer in the area of the mass pad. As a result, the ball speed after impact is greater for the club head having the channel 212 and mass pad than for a conventional club head, which results in a higher COR.

Whereas the invention has been described in connection with representative embodiments, it will be understood that it is not limited to those embodiments. On the contrary, it is intended to encompass all alternatives, modifications, combinations, and equivalents as may be included within the spirit and scope of the invention as defined by the appended claims.

The invention claimed is:

1. A golf club head comprising:

a club head body having a leading edge, a trailing edge, an upper portion, a lower portion, a heel portion, a toe portion, a striking face, a rear portion opposite the striking face, and a golf club shaft receiving portion positioned in the heel portion and configured to receive a golf club shaft, the golf club shaft receiving portion comprising an upper shaft opening in the upper portion of the golf club head and a lower shaft opening in the lower portion of the golf club head, with the club head body defining an interior cavity, wherein:

the upper portion is defined as a portion of the golf club head located above a peripheral outline of the golf club head as viewed from a top-down direction;

the lower portion is defined as a portion of the golf club head extending upwards from a lowest point of the club head when in a normal address position, to the peripheral outline of the golf club head;

the striking face including a geometric center defining an origin of a coordinate system when the golf club head is at the normal address position, the coordinate system including:

an x-axis being tangent to the striking face at the origin and parallel to a ground plane, wherein the x-axis extends in a positive direction from the origin to the heel portion of the club head body, a y-axis intersecting the origin being parallel to the ground plane and orthogonal to the x-axis, wherein the y-axis extends in a positive direction from the origin to the rear portion of the club head body, and a z-axis intersecting the origin being orthogonal to both the x-axis and the y-axis, wherein the z-axis extends in a positive direction from the origin to the upper portion of the club head body, wherein:

the heel portion extends towards, and includes, the golf club shaft receiving portion from a y-z plane passing through the origin, and the toe portion is defined as a portion of the golf club head extending from the y-z plane in a direction opposite the heel portion;

an adjustable head-shaft connection assembly that is operable to adjust at least one of a loft angle or a lie angle of a golf club formed when the golf club head is attached to a golf club shaft via the head-shaft connection assembly;

one or more body tuning element connecting elements positioned within the interior cavity toeward of the geometric center of the striking face and connecting the upper portion to the lower portion, the one or more body tuning element connecting elements each having a first end attached to a first internal surface, a second end attached to a second internal surface, and an intermediate portion spanning across the interior cavity from the first end to the second end;

wherein the intermediate portion does not contact any portion of the upper portion or the lower portion and the one or more body tuning element connecting elements do not contact the rear portion of the club head body;

at least one weight configured to engage the lower portion at two or more positions, wherein the two or more positions include a first position and a second position such that the at least one weight is movable between an engagement position in a first portion of the lower portion and an engagement position in a second portion of the lower portion;

a lower recessed portion in the lower portion of the golf club head positioned proximate to the lower shaft opening and at least partially surrounding the lower shaft opening, the lower shaft opening in communication with the upper shaft opening and the lower recessed portion having one or more walls extending into the interior cavity of the club head body;

wherein the first position and the second position are both within the lower portion of the golf club head, and further wherein the first position is positioned in the heel portion and the second position is positioned toewardly of the first position; and wherein the golf club head has a center of gravity (CG) with a head origin x-axis (CGx) coordinate between about 2 mm and about 6 mm and a head origin y-axis (CGy) coordinate between about 15 mm and about 40 mm, and a head origin z-axis (CGz) less than 0 mm.

2. The golf club head of claim 1, wherein the at least one weight is movable between an engagement position in the toe portion and an engagement position in the heel portion.

3. The golf club head of claim 1, further comprising at least three ribs located within the interior cavity, wherein the at least three ribs converge.

4. The golf club head of claim 1, wherein:

there is a face-to-upper portion transition where the striking face connects to the upper portion near a front end of the club head body; and in the y-z plane passing through the origin, a crown height continuously increases starting from the face-to-upper portion transition up to a local maximum.

5. The golf club head of claim 1, wherein a coefficient of restitution of the golf club head measured at the geometric center of the striking face is 0.80 or greater; and wherein a mass of the golf club head is between about 185 grams and about 245 grams;

wherein a maximum dimension from a forward portion to a rearward portion of the golf club head is greater than about 75 mm, wherein the forward portion extends towards the striking face from the CG of the golf club head, and wherein the rearward portion extends towards the trailing edge from the CG of the golf club head.

6. The golf club head of claim 1, wherein an outer perimeter of the lower recessed portion is non-circular.

7. The golf club head of claim 1, wherein the at least one weight has a mass from about 0.5 gram to about 20 grams.

8. The golf club head of claim 1, wherein the at least one weight is a weight assembly.

9. The golf club head of claim 1, wherein the one or more body tuning element connecting elements are integrally cast with the club head body.

10. The golf club head of claim 1, wherein in the two or more positions a central axis of the at least one weight does not intersect the striking face.

11. The golf club head of claim 1, further comprising a crown insert positioned in the upper portion and formed from a different material than the rest of the club head body.

12. The golf club head of claim 1, wherein the first position is positioned in the heel portion proximate the lower recessed portion.

13. A golf club head comprising:

a club head body having a leading edge, a trailing edge, an upper portion, a lower portion, a heel portion, a toe portion, a striking face, a rear portion opposite the striking face, and a golf club shaft receiving portion positioned in the heel portion and configured to receive a golf club shaft, the golf club shaft receiving portion comprising an upper shaft opening in the upper portion of the golf club head and a lower shaft opening in the lower portion of the golf club head, with the club head body defining an interior cavity, wherein:

the upper portion is defined as a portion of the golf club head located above a peripheral outline of the golf club head as viewed from a top-down direction;

the lower portion is defined as a portion of the golf club head extending upwards from a lowest point of the club head when in a normal address position, to the peripheral outline of the golf club head;

the striking face including a geometric center defining an origin of a coordinate system when the golf club head is at the normal address position, the coordinate system including:

an x-axis being tangent to the striking face at the origin and parallel to a ground plane, wherein the x-axis extends in a positive direction from the origin to the heel portion of the club head body, a y-axis intersecting the origin being parallel to the ground plane and orthogonal to the x-axis, wherein the y-axis extends in a positive direction from the origin to the rear portion of the club head body, and a z-axis intersecting the origin being orthogonal to both the x-axis and the y-axis, wherein the z-axis extends in a positive direction from the origin to the upper portion of the club head body, wherein:

the heel portion extends towards, and includes, the golf club shaft receiving portion from a y-z plane passing through the origin, and the toe portion is defined as a portion of the golf club head extending from the y-z plane in a direction opposite the heel portion;

an adjustable head-shaft connection assembly that is operable to adjust at least one of a loft angle or lie angle of a golf club formed when the golf club head is attached to a golf club shaft via the head-shaft connection assembly;

at least one weight configured to engage the lower portion at two or more positions, wherein the two or more positions include a first position and a second position such that the at least one weight is movable between an engagement position in a first portion of the lower portion and an engagement position in a second portion of the lower portion;

wherein the golf club head has a CG with a head origin x-axis (CGx) coordinate between about −2 mm and about 6 mm and a head origin y-axis (CGy) coordinate between about 15 mm and about 40 mm, and a head origin z-axis (CGz) less than 0 mm; and a lower recessed portion in the lower portion of the club head positioned proximate to the lower shaft opening and at least partially surrounding the lower shaft opening, the lower shaft opening in communication with the upper shaft opening and the lower recessed portion having one or more walls extending into the interior cavity of the golf-club head body;

wherein the first position and the second position are both within the lower portion of the golf club head, and further wherein either:

the first position is positioned in the heel portion proximate the lower recessed portion and the second position is positioned toewardly of the first position, or the first position is in a forward portion of the golf club head and the second position is in a rearward portion of the golf club head wherein the forward portion extends towards the striking face from the CG of the golf club head, and wherein the rearward portion extends towards the trailing edge from the CG of the golf club head; and wherein in the two or more positions a central axis of the at least one weight extends through the upper portion;

wherein there is a face-to-upper portion transition where the face connects to the upper portion near the leading edge of the club head body;

wherein in the y-z plane passing through the origin, a crown height continuously increases starting from the face-to-upper portion transition up to a local maximum;

wherein a coefficient of restitution of the golf club head measured at the geometric center of the face is 0.80 or greater;

wherein a mass of the golf club head is between about 185 grams and about 245 grams;

wherein a maximum dimension from a forward portion to a rearward portion of the golf club head is greater than about 75 mm, wherein the forward portion extends towards the striking face from the CG of the golf club head, and wherein the rearward portion extends towards the trailing edge from the CG of the golf club head; and wherein the golf club head has a mass moment of inertia about the CG z-axis, Izz, greater than 360 kg-mm$^2$.

14. The golf club head of claim 13, wherein:

the golf club head has an above ground center-of-gravity location Zup measured in mm;

the golf club head has a moment of inertia about the center-of-gravity z-axis Izz measured in kg-mm$^2$ greater than 360 kg-mm$^2$;

the golf club head has a moment of inertia about the center-of-gravity x-axis Ixx measured in kg-mm$^2$; and Izz and Ixx are related to the above ground center-of-gravity location Zup by the equation $Ixx+Izz \geq 20 \cdot Zup+165$.

15. The golf club head of claim 13, wherein the two or more positions include two or more weight ports, and the two or more weight ports define internal threads that correspond to external threads formed on the at least one weight and wherein each of the two or more weight ports has a central axis that does not extend through the striking face.

16. The golf club head of claim 15, wherein each of the two or more weight ports is circular.

17. The golf club head of claim 13, wherein the at least one weight is movable between an engagement position in the toe portion and an engagement position in the heel portion.

18. The golf club head of claim 13, wherein the at least one weight is movable between an engagement position in the forward portion and an engagement position in the rearward portion.

19. The golf club head of claim 13, wherein the at least one weight has a mass from about 0.5 gram to about 20 grams.

20. A golf club head comprising:

a club head body having a leading edge, a trailing edge, an upper portion, a lower portion, a heel portion, a toe portion, a striking face, a rear portion opposite the striking face, and a golf club shaft receiving portion positioned in the heel portion and configured to receive a golf club shaft, the golf club shaft receiving portion comprising an upper shaft opening in the upper portion of the golf club head and a lower shaft opening in the lower portion of the golf club head, with the club head body defining an interior cavity, wherein:

the upper portion is defined as a portion of the golf club head located above a peripheral outline of the golf club head as viewed from a top-down direction;

the lower portion is defined as a portion of the golf club head extending upwards from a lowest point of the club head when in a normal address position, to the peripheral outline of the golf club head;

the striking face including a geometric center defining an origin of a coordinate system when the golf club head is at the normal address position, the coordinate system including:

an x-axis being tangent to the striking face at the origin and parallel to a ground plane, wherein the x-axis extends in a positive direction from the origin to the heel portion of the club head body, a y-axis intersecting the origin being parallel to the ground plane and orthogonal to the x-axis, wherein the y-axis extends in a positive direction from the origin to the rear portion of the club head body, and a z-axis intersecting the origin being orthogonal to both the x-axis and the y-axis, wherein the z-axis extends in a positive direction from the origin to the upper portion of the club head body, wherein:

the heel portion extends towards, and includes, the golf club shaft receiving portion from a y-z plane passing through the origin, and the toe portion is defined as a portion of the golf club head extending from the y-z plane in a direction opposite the heel portion;

an adjustable head-shaft connection assembly that is operable to adjust at least one of a loft angle or a lie angle of a golf club formed when the golf club head is attached to a golf club shaft via the head-shaft connection assembly;

at least one weight configured to engage the lower portion at two or more positions, wherein the two or more positions include a first position and a second position such that the at least one weight is movable between an engagement position in a first portion of the lower portion and an engagement position in a second portion of the lower portion;

wherein the golf club head has a CG with a head origin x-axis (CGx) coordinate between about 2 mm and about 6 mm and a head origin y-axis (CGy) coordinate between about 15 mm and about 40 mm, and a head origin z-axis (CGz) less than 0 mm; and a lower recessed portion in the lower portion of the golf club head positioned proximate to the lower shaft opening and at least partially surrounding the lower shaft opening, the lower shaft opening in communication with the upper shaft opening and the lower recessed portion having one or more walls extending into the interior cavity of the club head body;

wherein the first position and the second position are both within the lower portion of the golf club head, and further wherein the first position is positioned in the heel portion and the second position is positioned in the toe portion;

wherein a coefficient of restitution of the golf club head measured at the geometric center of the face is 0.80 or greater;

wherein a mass of the golf club head is between about 185 grams and about 245 grams;

wherein a maximum dimension from a forward portion to a rearward portion of the golf club head is greater than about 75 mm, wherein the forward portion extends towards the striking face from the CG of the golf club head, and wherein the rearward portion extends towards the trailing edge from the CG of the golf club head;

wherein the golf club head has a mass moment of inertia about the CG z-axis, Izz, greater than 360 kg-mm$^2$;

wherein the golf club head has an above ground center-of-gravity location Zup measured in mm;

wherein the golf club head has a moment of inertia about the center-of-gravity z-axis Izz measured in kg-mm$^2$ greater than 360 kg-mm$^2$;

wherein the golf club head has a moment of inertia about the center-of-gravity x-axis Ixx measured in kg-mm$^2$; and wherein Izz and Ixx are related to the above ground center-of-gravity location Zup by the equation $Ixx+Izz \geq 20 \cdot Zup+165$.

21. The golf club head of claim 20, wherein the at least one weight is a weight assembly.

22. The golf club head of claim 20, further comprising a face-to-upper portion transition where the face connects to the upper portion near the leading edge of the club head body, wherein in the y-z plane passing through the origin, a crown height continuously increases starting from the face-to-upper portion transition up to a local maximum.

* * * * *